US012616871B2

(12) United States Patent
Domesick

(10) Patent No.: US 12,616,871 B2
(45) Date of Patent: May 5, 2026

(54) ABDOMINAL CORE AND PLANK EXERCISE APPARATUS

(71) Applicant: Michael Domesick, New Britain, CT (US)

(72) Inventor: Michael Domesick, New Britain, CT (US)

( * ) Notice: Subject to any disclaimer, the term of this patent is extended or adjusted under 35 U.S.C. 154(b) by 271 days.

(21) Appl. No.: 17/962,047

(22) Filed: Oct. 7, 2022

(65) Prior Publication Data

US 2023/0048498 A1 Feb. 16, 2023

Related U.S. Application Data

(63) Continuation of application No. 16/368,962, filed as application No. PCT/US2018/055589 on Oct. 12, 2018, now Pat. No. 11,491,364, which is a continuation of application No. 15/783,773, filed on Oct. 13, 2017, now Pat. No. 10,173,092, said application No. 16/368,962 is a continuation-in-part of application No. 15/959,405, filed on Apr. 23, 2018, now Pat. No. 10,286,245, which is a continuation of application No. 15/783,773, filed on Oct. 13, 2017, now Pat. No. 10,173,092, which is a continuation-in-part of application No. 14/631,235, filed on Feb. 25, 2015, now Pat. No. 9,895,573.

(60) Provisional application No. 61/944,154, filed on Feb. 25, 2014.

(51) Int. Cl.

| | |
|---|---|
| ***A63B 23/02*** | (2006.01) |
| ***A63B 21/00*** | (2006.01) |
| ***A63B 21/002*** | (2006.01) |

(52) U.S. Cl.
CPC ..... *A63B 21/4035* (2015.10); *A63B 21/0023* (2013.01); *A63B 2209/00* (2013.01)

(58) Field of Classification Search
CPC ..... A63B 23/02–0205; A63B 21/002–0023; A63B 21/4035
See application file for complete search history.

(56) References Cited

U.S. PATENT DOCUMENTS

| | | | | |
|---|---|---|---|---|
| 5,154,094 | A | 10/1992 | Klieber | |
| 5,163,339 | A * | 11/1992 | Giard, Jr. | B62K 21/125 74/551.8 |
| 5,235,872 | A * | 8/1993 | Giard, Jr. | B62K 21/125 74/551.8 |
| 5,421,901 | A | 6/1995 | Whitney et al. | |
| 5,713,823 | A * | 2/1998 | Walendzak | A63B 22/18 482/141 |
| 5,725,463 | A | 3/1998 | Colonello et al. | |
| D405,132 | S | 2/1999 | Westfall et al. | |
| 5,921,901 | A | 7/1999 | Palacios | |
| 5,967,955 | A | 10/1999 | Westfall et al. | |
| D419,625 | S | 1/2000 | Barnett et al. | |

(Continued)

FOREIGN PATENT DOCUMENTS

| | | | |
|---|---|---|---|
| AU | 201010043 | A4 | 6/2010 |
| AU | 2010100430 | A4 | 6/2010 |

(Continued)

*Primary Examiner* — Joshua T Kennedy

(57) ABSTRACT

An abdominal core and plank exercise apparatus and related methods are provided. The exercise apparatus has an arm support pad and may include a hand grip and movable components for facilitating a user's abdominal strengthening. The apparatus interfaces with a ground surface.

162 Claims, 48 Drawing Sheets

(56) References Cited

U.S. PATENT DOCUMENTS

| | | | | |
|---|---|---|---|---|
| 6,017,297 | A | 1/2000 | Collins | |
| D428,454 | S | 7/2000 | Fischer et al. | |
| D439,291 | S | 3/2001 | Barnett et al. | |
| D446,264 | S | 8/2001 | Fischer et al. | |
| 6,582,347 | B2 * | 6/2003 | Smith | A63B 23/0216 482/907 |
| 6,626,807 | B1 | 9/2003 | Richmond | |
| 6,638,201 | B1 | 10/2003 | Dischler | |
| 6,761,672 | B1 | 7/2004 | Williams | |
| 7,232,404 | B2 | 6/2007 | Nelson | |
| 7,455,633 | B2 | 11/2008 | Brown et al. | |
| 7,601,108 | B2 | 10/2009 | Andrews | |
| 7,611,445 | B2 | 11/2009 | Brown | |
| 7,645,218 | B2 | 1/2010 | Potok | |
| 7,698,967 | B2 | 4/2010 | Ording | |
| 7,775,950 | B2 | 8/2010 | Campanaro | |
| 7,780,585 | B1 | 8/2010 | de Jesus Rivas | |
| 7,938,763 | B2 | 5/2011 | Campanaro | |
| 7,972,251 | B2 | 7/2011 | Peddar | |
| 8,075,457 | B2 | 12/2011 | Campanaro | |
| 8,137,250 | B1 | 3/2012 | Caban | |
| 8,177,732 | B2 | 5/2012 | Einav | |
| D668,304 | S | 10/2012 | Hill | |
| 9,480,871 | B2 | 11/2016 | Domesick | |
| 9,498,664 | B2 | 11/2016 | Anderson | |
| 9,592,419 | B1 * | 3/2017 | Cuffe | A63B 23/0205 |
| 9,895,568 | B2 | 2/2018 | Domesick | |
| 9,895,573 | B2 | 2/2018 | Domesick | |
| 10,173,092 | B2 | 1/2019 | Domesick | |
| 10,286,245 | B2 | 5/2019 | Domesick | |
| 11,491,364 | B2 | 11/2022 | Domesick | |
| 11,596,826 | B2 | 3/2023 | Domesick | |
| 11,844,980 | B2 * | 12/2023 | Brown | A63B 22/18 |
| 2004/0077468 | A1 | 4/2004 | Myles | |
| 2005/0049527 | A1 | 3/2005 | Green | |
| 2005/0209073 | A1 * | 9/2005 | Chen | A63B 23/08 482/79 |
| 2006/0030463 | A1 | 2/2006 | Maloy | |
| 2008/0108487 | A1 | 5/2008 | Bizzell | |
| 2009/0298657 | A1 * | 12/2009 | Potok | A63B 23/1245 482/141 |
| 2010/0004105 | A1 | 1/2010 | Peddar | |
| 2010/0234776 | A1 | 9/2010 | Borden | |
| 2010/0292059 | A1 | 11/2010 | Eschenbach | |
| 2012/0010058 | A1 * | 1/2012 | Sprague | A63B 21/0004 482/141 |
| 2012/0108405 | A1 | 5/2012 | Milo | |
| 2012/0252645 | A1 | 10/2012 | Agostini | |
| 2012/0258843 | A1 * | 10/2012 | Summers | A63B 21/4033 482/93 |
| 2013/0065736 | A1 | 3/2013 | Chen | |
| 2014/0005007 | A1 | 1/2014 | Ho | |
| 2014/0011649 | A1 | 1/2014 | Carney | |
| 2014/0087925 | A1 | 3/2014 | Dupuis | |
| 2014/0187394 | A1 | 7/2014 | Blahnik et al. | |
| 2014/0187395 | A1 | 7/2014 | Blahnik | |
| 2014/0287893 | A1 | 9/2014 | Price | |
| 2015/0238795 | A1 | 8/2015 | Domesick | |
| 2017/0304675 | A1 * | 10/2017 | Panes | A63B 23/0216 |

FOREIGN PATENT DOCUMENTS

| | | | |
|---|---|---|---|
| CI | 207506920 | U | 6/2018 |
| CN | 202028112 | U | 11/2011 |
| CN | 102961855 | A | 3/2013 |
| DE | 10058195 | C2 | 6/2002 |
| DE | 102014109387 | B3 | 12/2015 |
| EP | 2111268 | B1 | 10/2009 |
| EP | 2223721 | A1 | 9/2010 |
| FR | 2488514 | A1 | 2/1982 |
| FR | 2817156 | A3 | 5/2002 |
| WO | WO2006120047 | A1 | 11/2006 |
| WO | WO2009042255 | A1 | 4/2009 |
| WO | WO2013009306 | A1 | 1/2013 |

* cited by examiner

Fig. 6.1
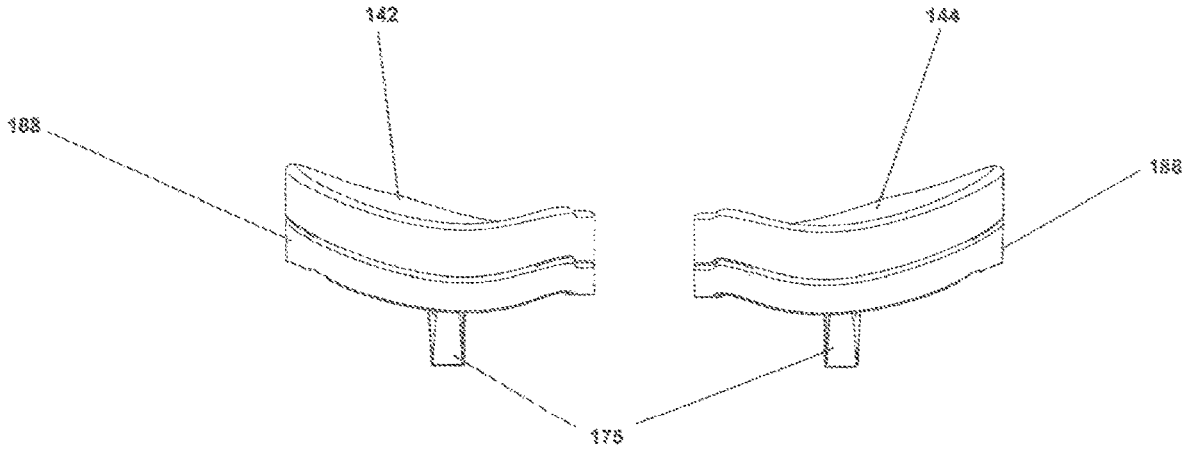

Fig. 6.2
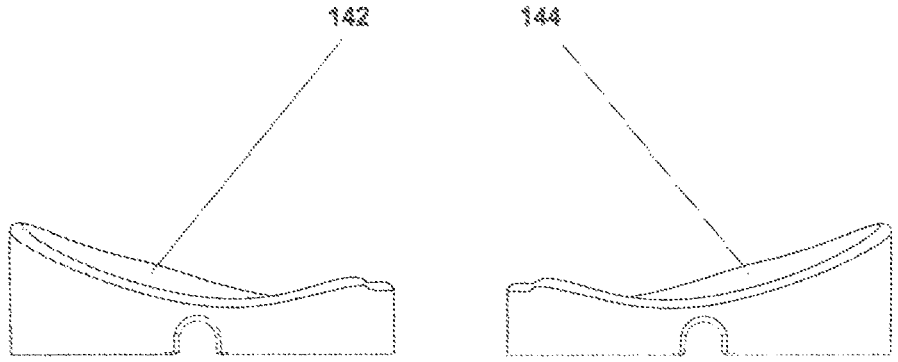

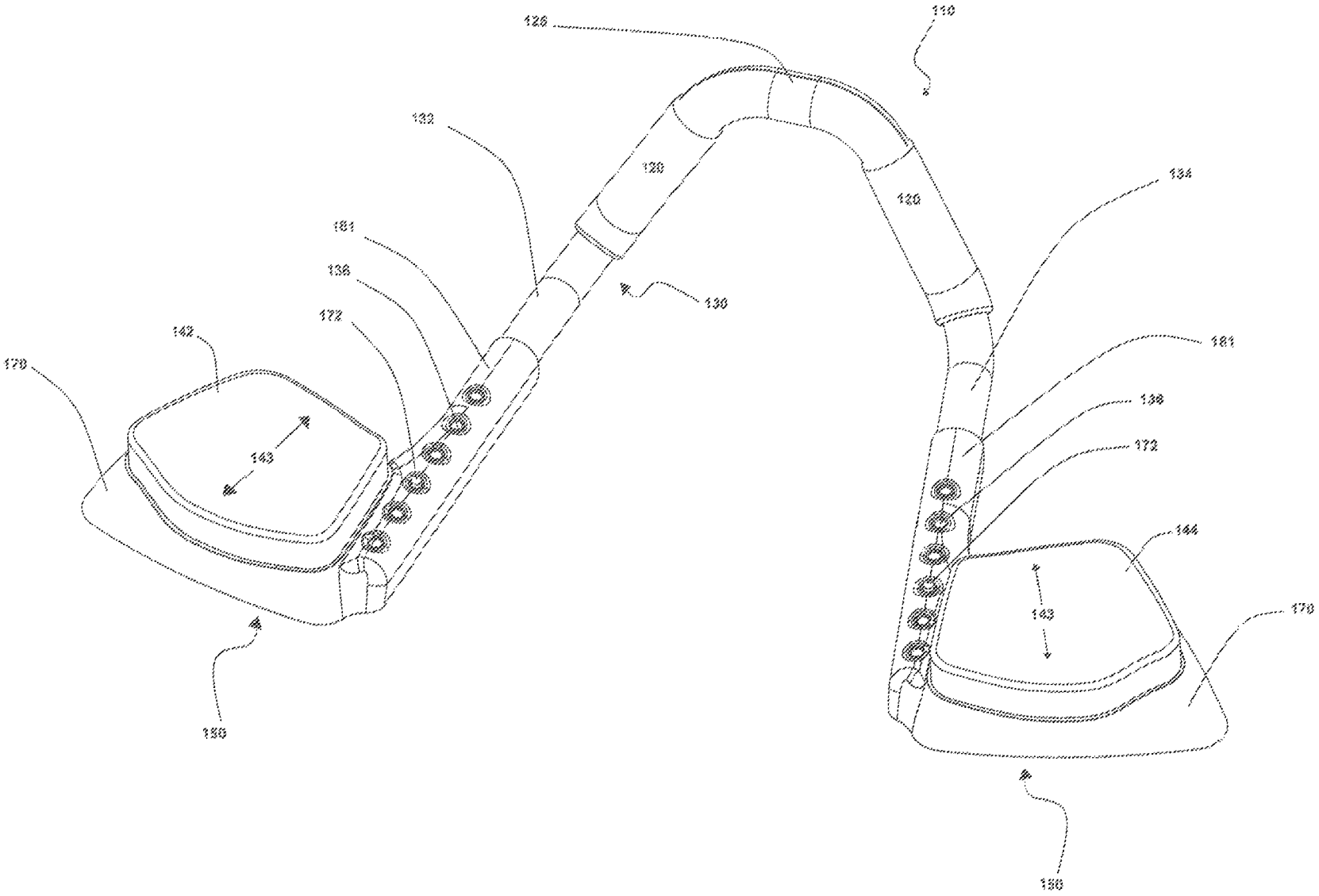
Fig. 12.1

Fig. 12.2
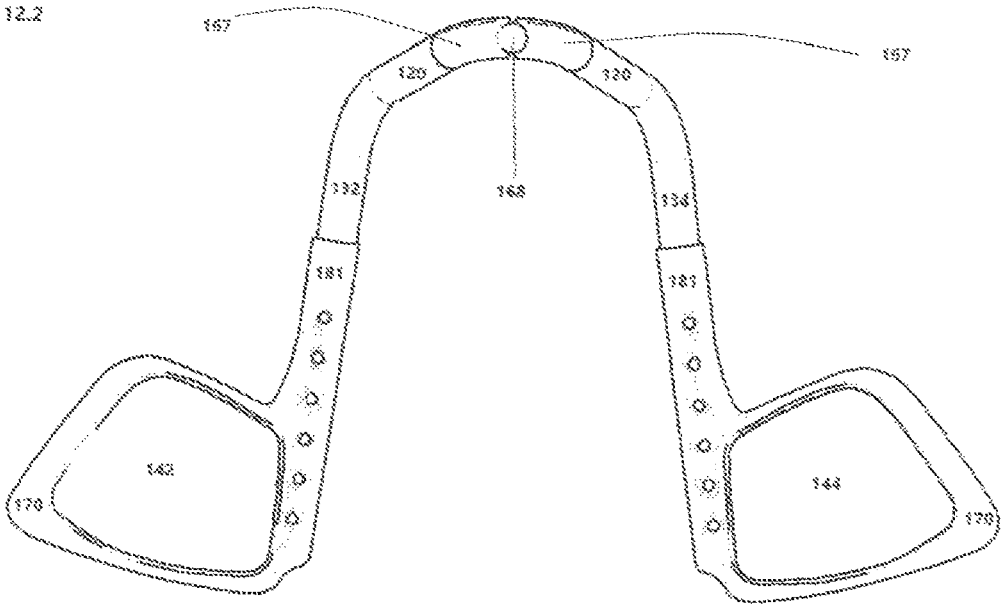

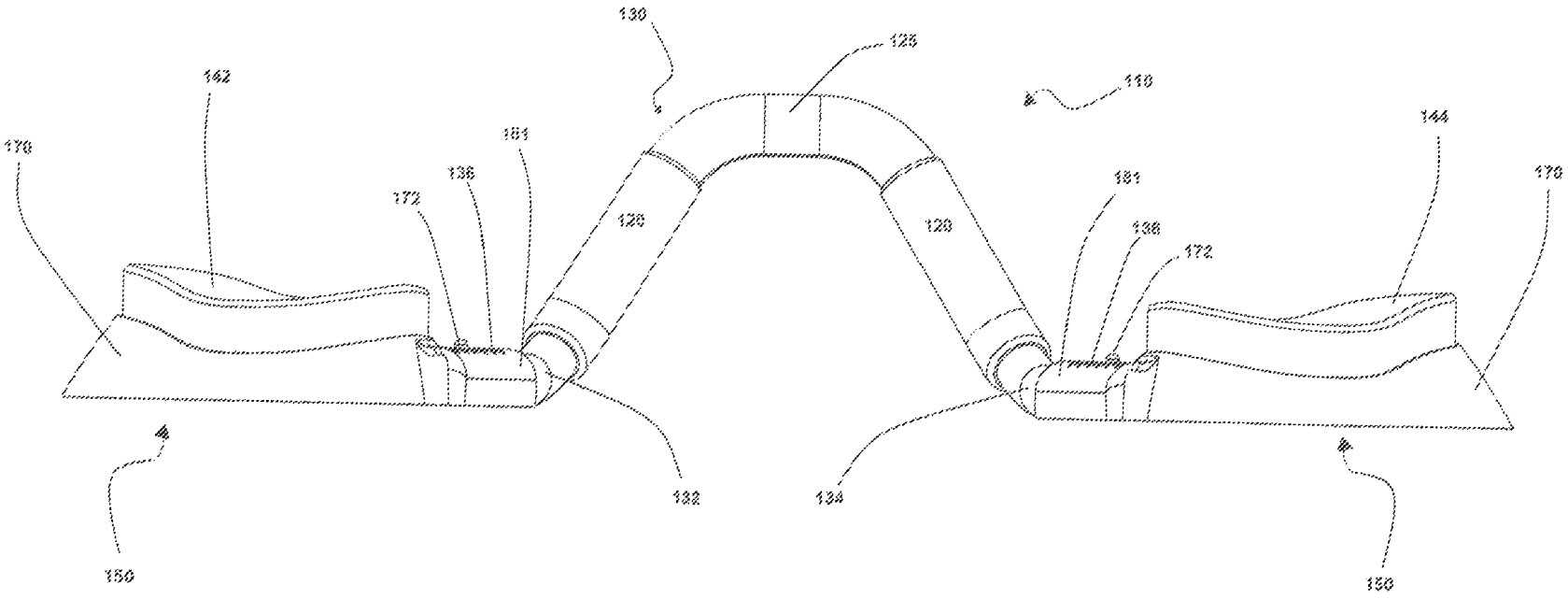
Fig. 12.3

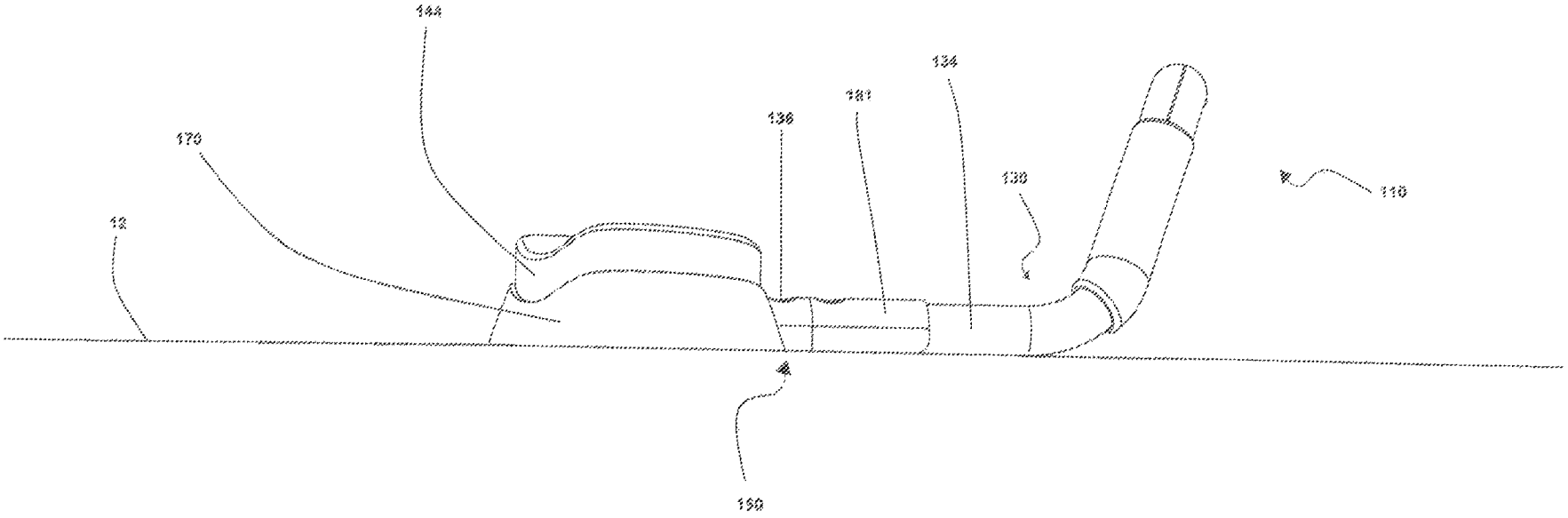
Fig. 12.4

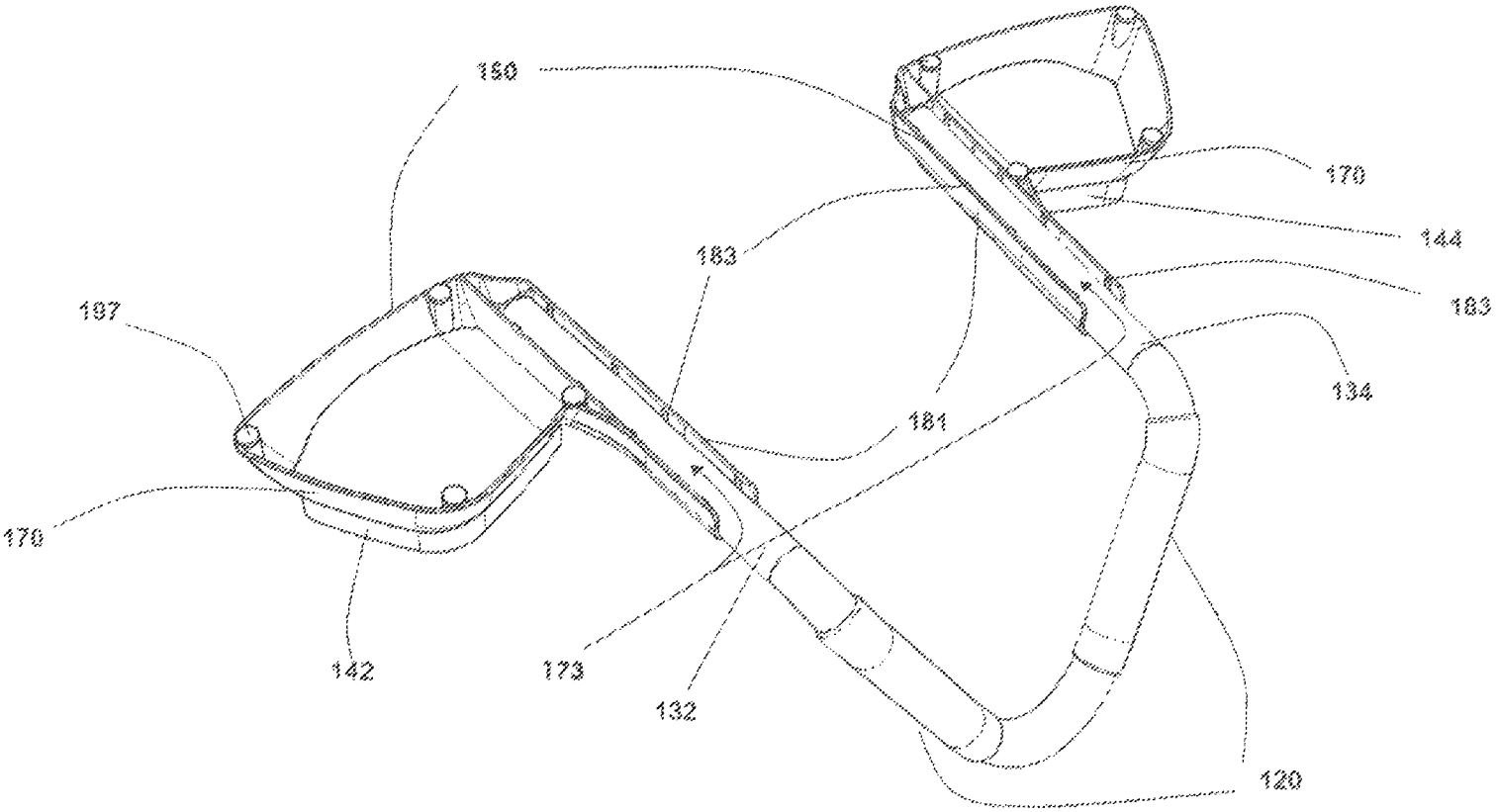
Fig. 12.5

Fig. 12.6
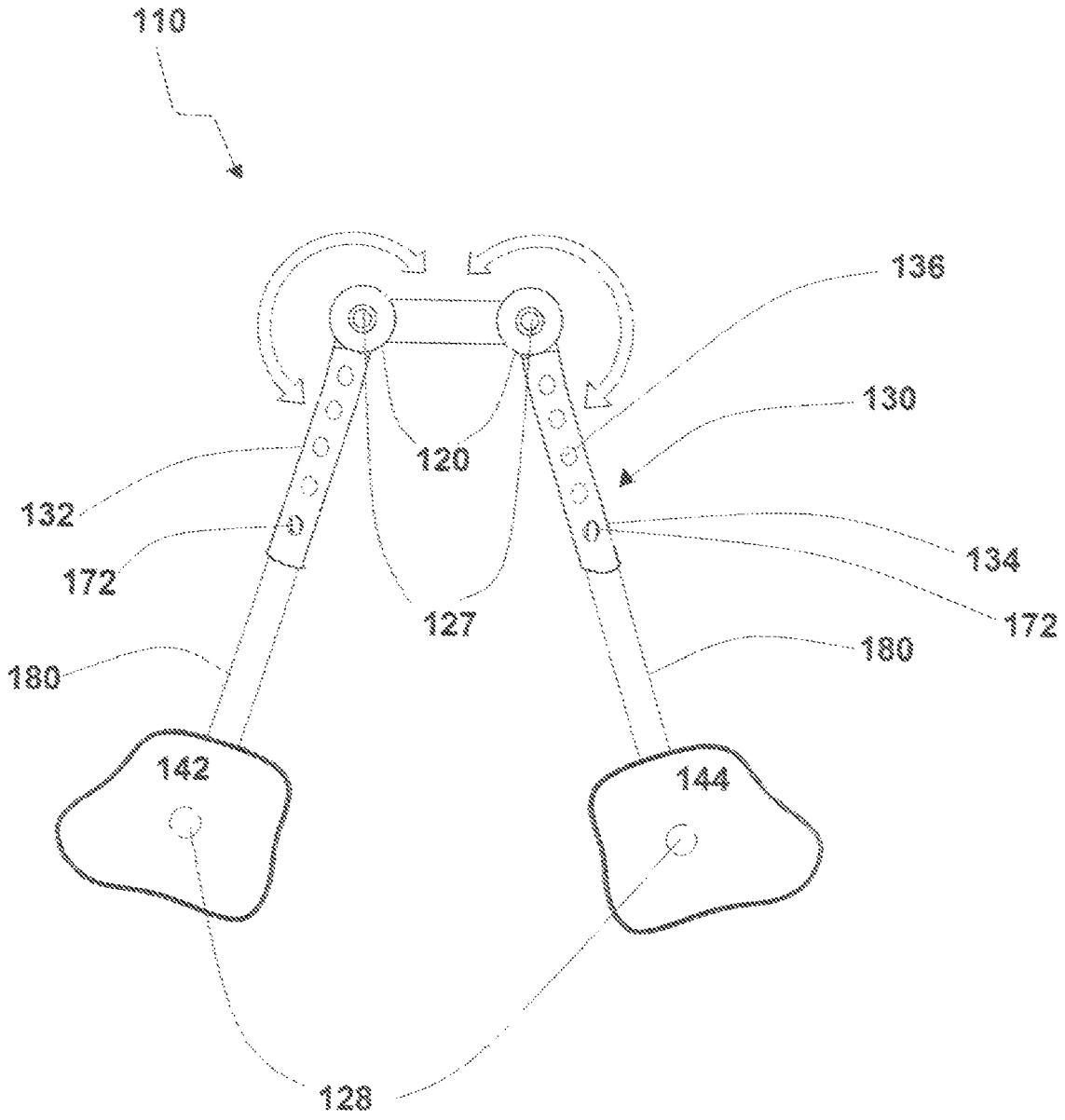

Fig. 12.7
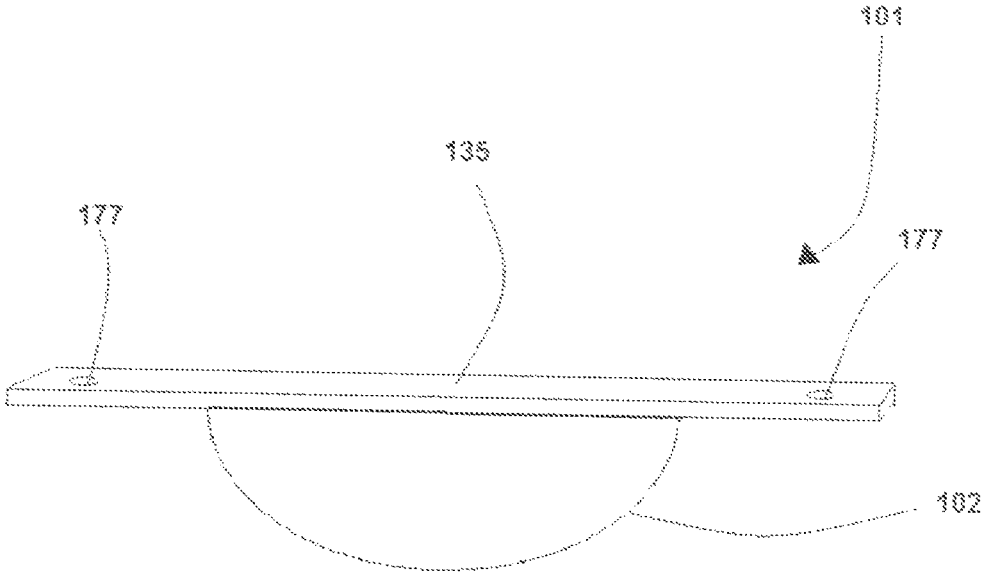

Fig. 12.8
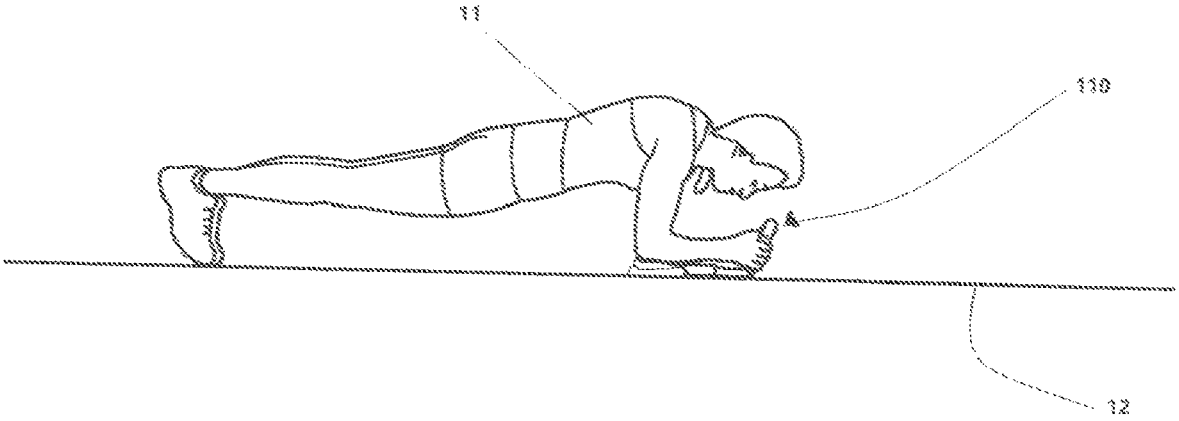

Fig. 20.1
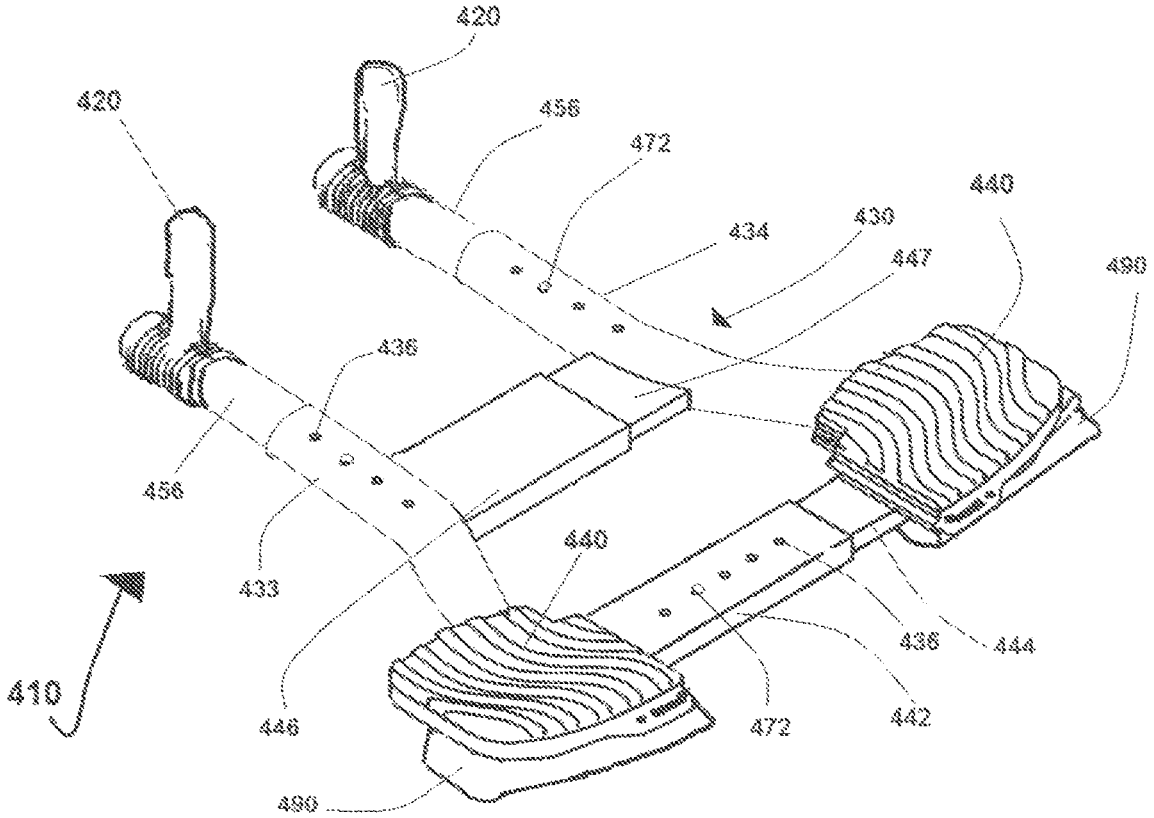

Fig. 20.2
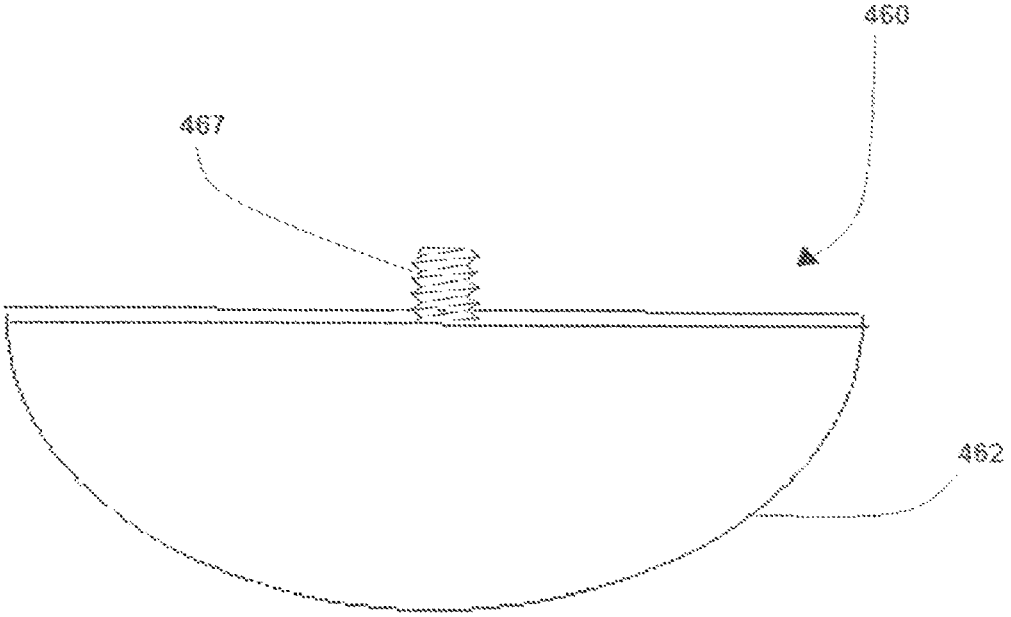

Fig. 20.3
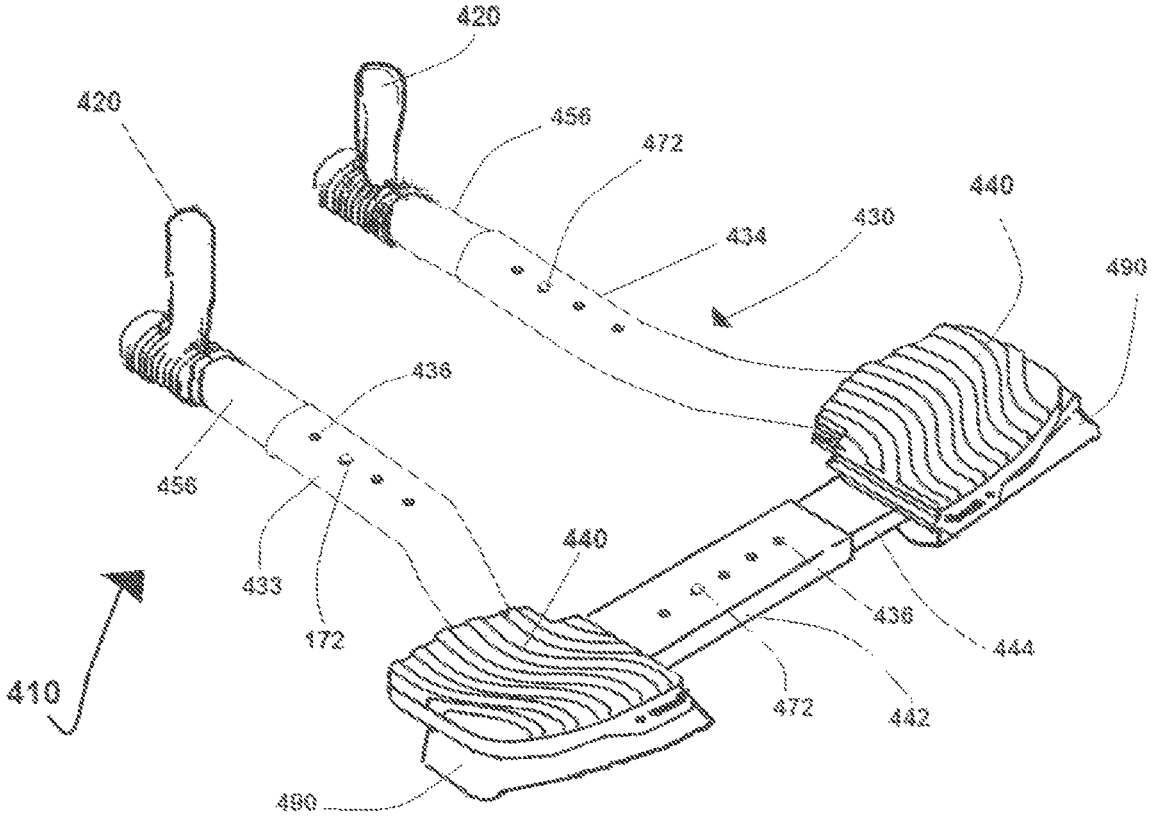

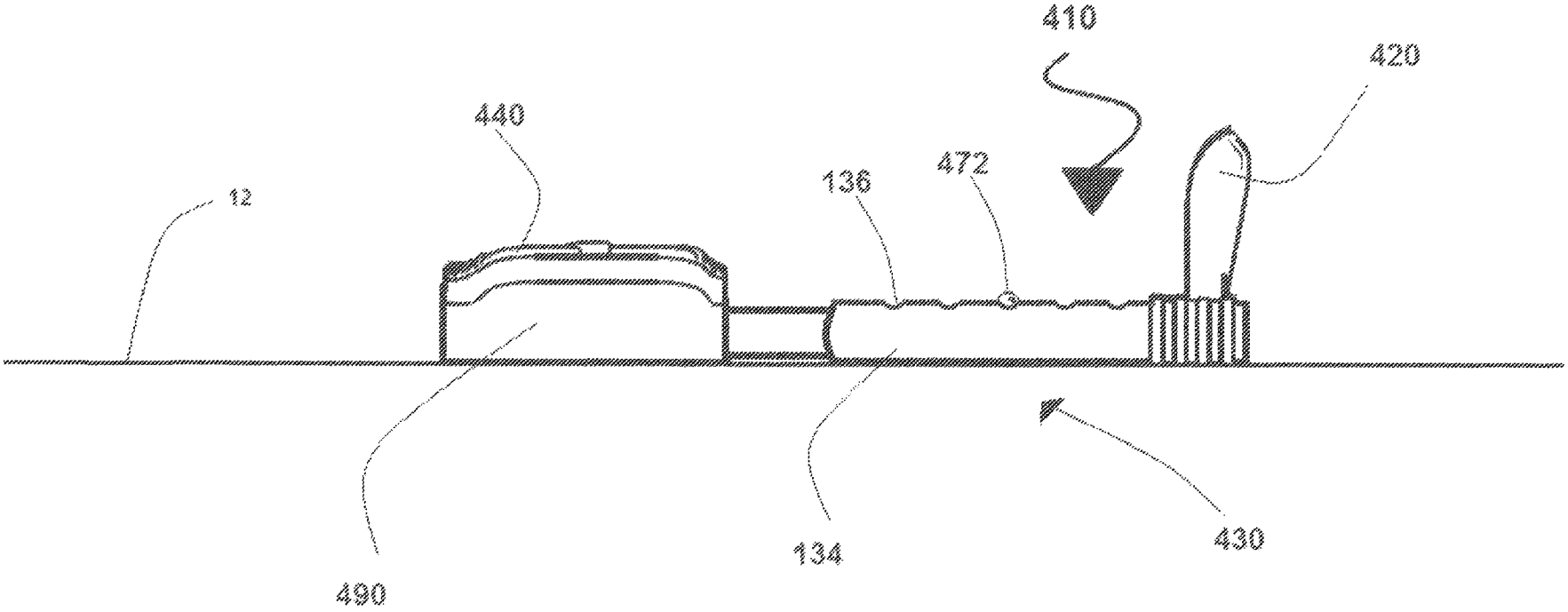
Fig. 20.4

Fig. 20.5
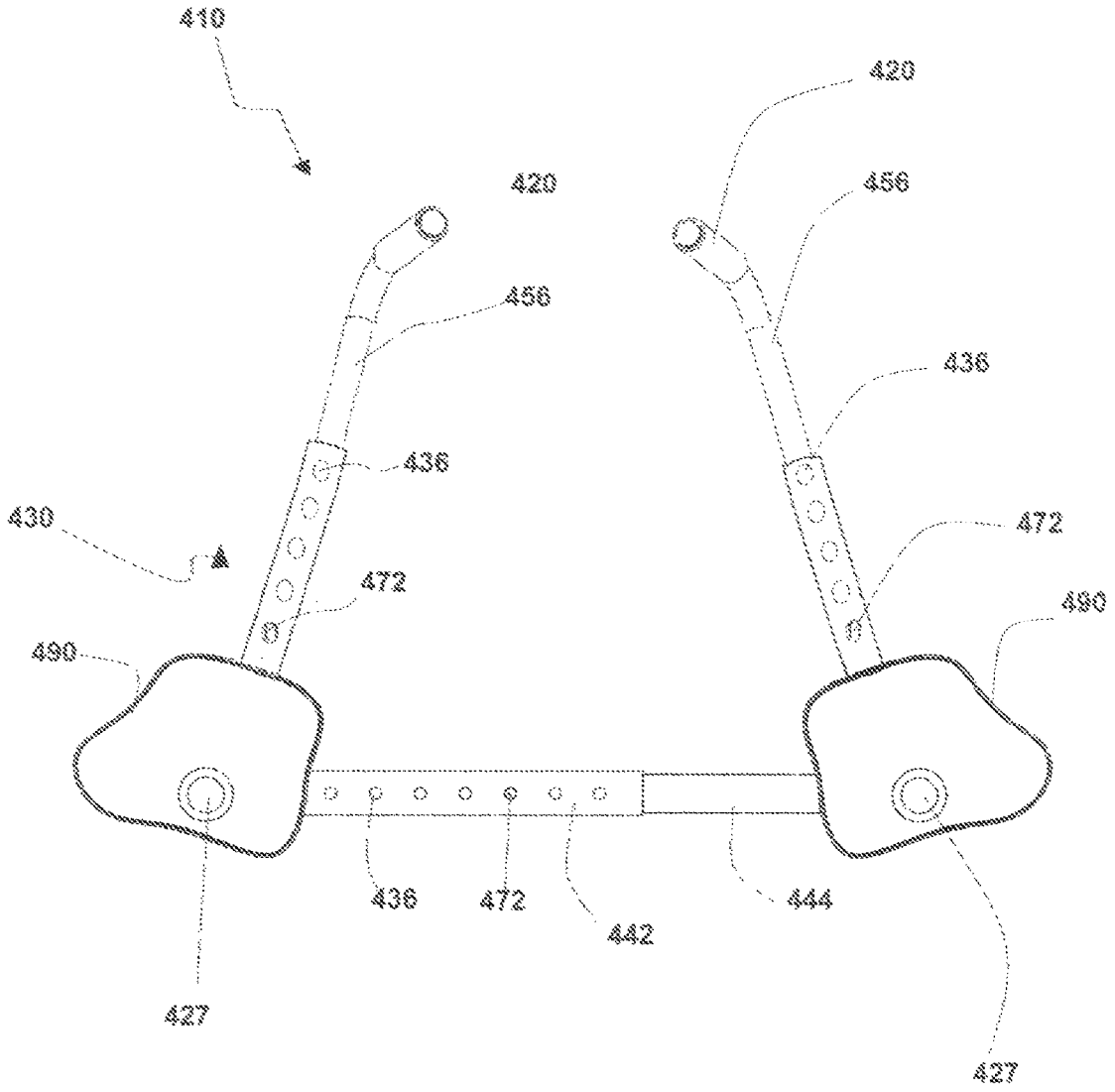

Fig. 24.1
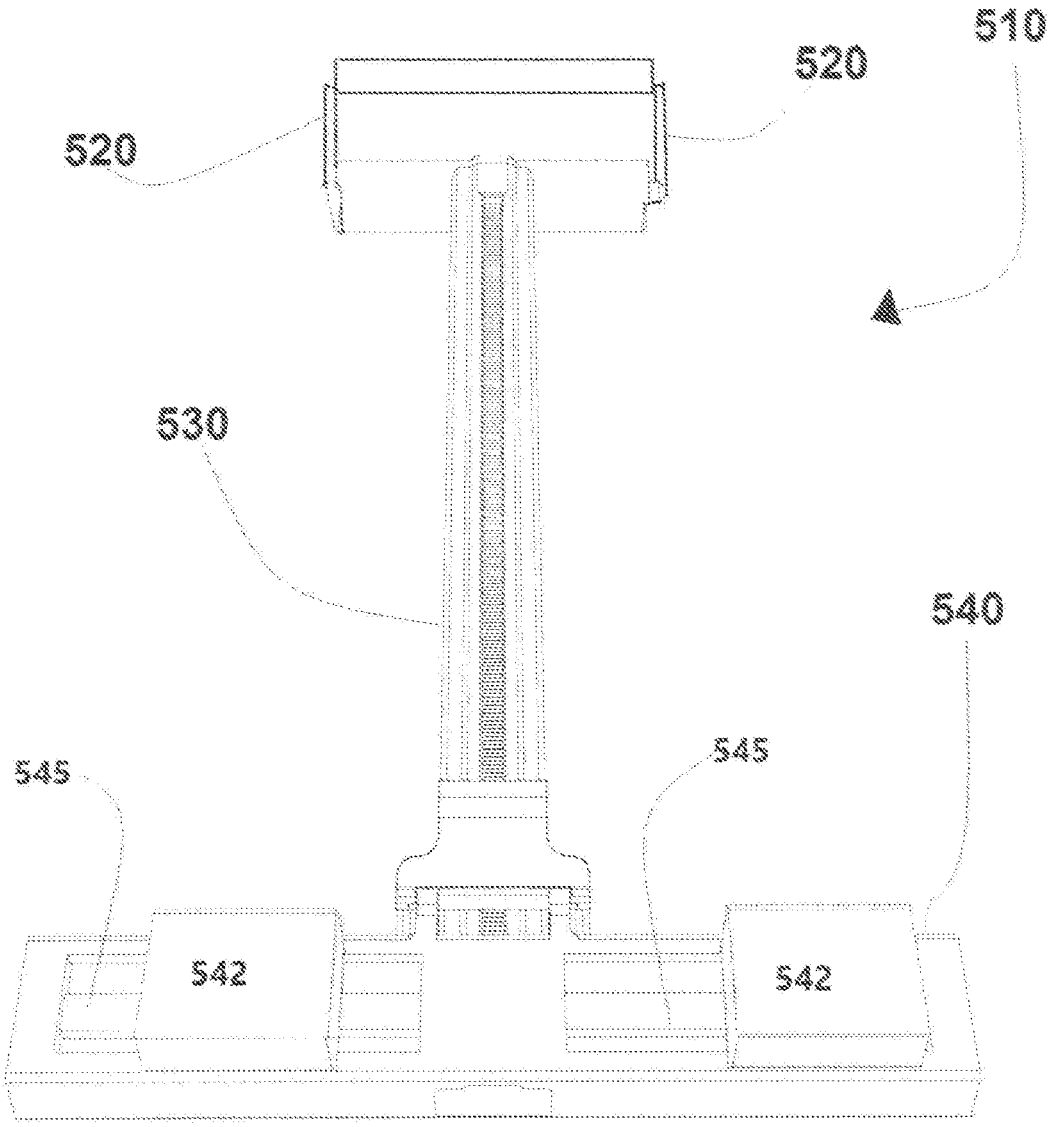

ABDOMINAL CORE AND PLANK EXERCISE APPARATUS

CROSS REFERENCE TO RELATED APPLICATIONS

This application is being filed as a continuation of U.S. patent application Ser. No. 16/368,962, filed on Mar. 29, 2019. Application Ser. No. 16/368,962 is both a national stage entry of International Application No. PCT/US18/55589, filed on Oct. 12, 2018, and a continuation-in-part of U.S. patent application Ser. No. 15/959,405, filed on Apr. 23, 2018, now U.S. Pat. No. 10,286,245.

PCT/US18/55589 and Ser. No. 15/959,405 are continuations of U.S. patent application Ser. No. 15/783,773, filed on Oct. 13, 2017, now U.S. Pat. No. 10,173,092.

U.S. patent application Ser. No. 15/783,773 is a continuation-in-part of U.S. patent application Ser. No. 14/631,235, filed on Feb. 25, 2015, now U.S. Pat. No. 9,895,573. Application Ser. No. 14/631,235 claims priority to U.S. Provisional Application No. 61/944,154, filed on Feb. 25, 2014.

This application claims the benefit of the above-described applications.

FIELD OF THE DISCLOSURE

The present disclosure is generally related to exercise devices and more particularly is related to an abdominal core and plank exercise apparatus and related methods.

BACKGROUND OF THE DISCLOSURE

A plank exercise is a core strength exercise. The most common plank is the front plank which is held in a push-up position with the body's weight borne on forearms, elbows, and toes. FIG. 1 is a side view illustration of person 10 in a front plank position, in accordance with the prior art. This type of exercise may also be known as a front hold, hover, or abdominal bridge. As is shown in FIG. 1, when in the front plank position, a person 10 may maintain a push-up-like stance with his or her forearms in contact with the ground surface 12. In this position, the body weight of the person 10 is transferred through their feet and through their upper arms to the ground 12. Relevant to this disclosure, the transfer of the weight through the upper arms to the ground 12 places significant forces on the person's elbows, which are in contact with the ground 12.

Variations on the plank exercise include alternative positions, such as the side plank, the reverse plank, the push-up plank, and/or the so-called 'superman' plank. FIG. 2 is a side view illustration of person 10 in a side plank position, in accordance with the prior art. In the side plank, the person 10 maintains a static position with a single forearm and single foot in contact with the ground 12. In this position, the body weight of the person 10 is transferred through his or her single foot and single arm which maintain contact with the ground 12. Relevant to this disclosure, the transfer of the weight through the single upper arm to the ground 12 places a significant force on the elbow of the person which is in contact with the ground 12.

Plank exercises may further include the use of training devices to enhance the effect of the exercise on the person. As is well-known in the art, these training devices may include a padded mat or weighted athletic balls which the person balances his or her body weight on while maintaining a plank position or a modified plank position. In all variations of the plank position, the person may experience a balance and core conditioning exercise increasing strength, control, and coordination of the muscles within the person's body. The health benefits of plank exercises are well documented throughout the health, fitness, and exercise science industries. However, there are also some drawbacks of plank exercise, including the discomfort a user experiences.

Some devices are available to assist plank exercises. One device includes a unitary shell with handle grips and a platform, and a sliding device positioned on an underside of the platform. A user may grasp the handle grips with his or her elbows in contact with the platform and his or her knees in contact with the ground surface. The user then exercises his or her abdominal muscles by sliding the unitary shell on the ground relative to his or her knees. A similar device uses independent sliding carriages for each arm of the user, whereby a plank position can be assumed on the carriages. It is noted that other plank exercise assisting devices, functioning under the same principles as described herein, may also exist in the conventional art.

These devices, along with other conventional devices, have many shortcomings. One major shortcoming is that users are highly susceptible to inadvertent injury. Further, the devices require a user's forearm to be positioned in such a way that their body weight, transferred through their elbow and into the device, may discomfort the user. Additionally, conventional devices often have handle grips that are not ergonomically safe. For example, many devices have handle grips positioned aligned higher than the user's arm, which results in an upward pitching of the user's wrist. Long-term, this position can result in strain on the user's wrist and forearm. This position may also prevent a user from exerting downward pressure on handle grips in order to leverage their body into an elevated position specific to a plank exercise, and without further forcing their arm and/or elbow into a pad. In another example, the conventional handle grips force the user's forearms and wrist into an ergonomically inefficient position.

Thus, a heretofore unaddressed need exists in the industry to address the aforementioned deficiencies and inadequacies.

SUMMARY OF THE DISCLOSURE

Embodiments of the present disclosure provide an abdominal core and plank exercise apparatus (hereinafter 'exercise apparatus'). Briefly described, one embodiment, among others, can be implemented as follows. An exercise apparatus includes (i) a frame member; (ii) at least one arm support pad connected to the frame member; (iii) a hand grip; and (iv) a ground-interface surface is positioned along at least a portion of the frame member.

For example, when the user adopts an exercise position with a forearm supported on the at least one forearm support pad, at least a portion of the user's body weight is conveyed from the forearm, through the forearm support pad, and through the ground-interface surface to an underlying ground surface.

The present disclosure also contemplates methods of using an exercise apparatus, including for example repositioning the at least one forearm support pad.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 6.1-6.2 are each a rearward view of arm support pads.

FIG. 12.1 is an isometric illustration of an exercise apparatus, in accordance with the fifth exemplary embodiment of the present disclosure.

FIG. 12.2 is an isometric illustration of an exercise apparatus which uses a hinged element to connect left and right halves thereof, in accordance with the fifth exemplary embodiment of the present disclosure.

FIG. 12.3 is a rear-view illustration of an exercise apparatus, in accordance with the fifth exemplary embodiment of the present disclosure.

FIG. 12.4 is a profile illustration of an exercise apparatus, in accordance with the fifth exemplary embodiment of the present disclosure.

FIG. 12.5 is a bottom illustration of an exercise apparatus, in accordance with the fifth exemplary embodiment of the present disclosure.

FIG. 12.6 is a top-down illustrations of an exercise apparatus, in accordance with a sixth exemplary embodiment of the present disclosure.

FIG. 12.7 is a side-view illustration of a destabilization device compatible with, among other embodiments, the sixth exemplary embodiment of the present disclosure.

FIG. 12.8 is a side-view illustration of an exercise apparatus in use with a user, in accordance with, for example, the fifth exemplary embodiment of the present disclosure.

FIG. 20.1 is an isometric view illustration of the exercise apparatus, in accordance with a ninth exemplary embodiment of the present disclosure.

FIG. 20.2 is a side-view illustration of a destabilization device compatible with the ninth exemplary embodiment of the present disclosure.

FIG. 20.3 is an isometric view illustration of a variation of the exercise apparatus of FIG. 20.1, in accordance with the ninth exemplary embodiment of the present disclosure.

FIG. 20.4 is a side-view illustration of the exercise apparatus of FIG. 20.1, in accordance with the ninth exemplary embodiment of the present disclosure.

FIG. 20.5 is a top-down view illustration of a variation of the exercise apparatus, in accordance with the ninth exemplary embodiment of the present disclosure.

DETAILED DESCRIPTION

Figure 3:
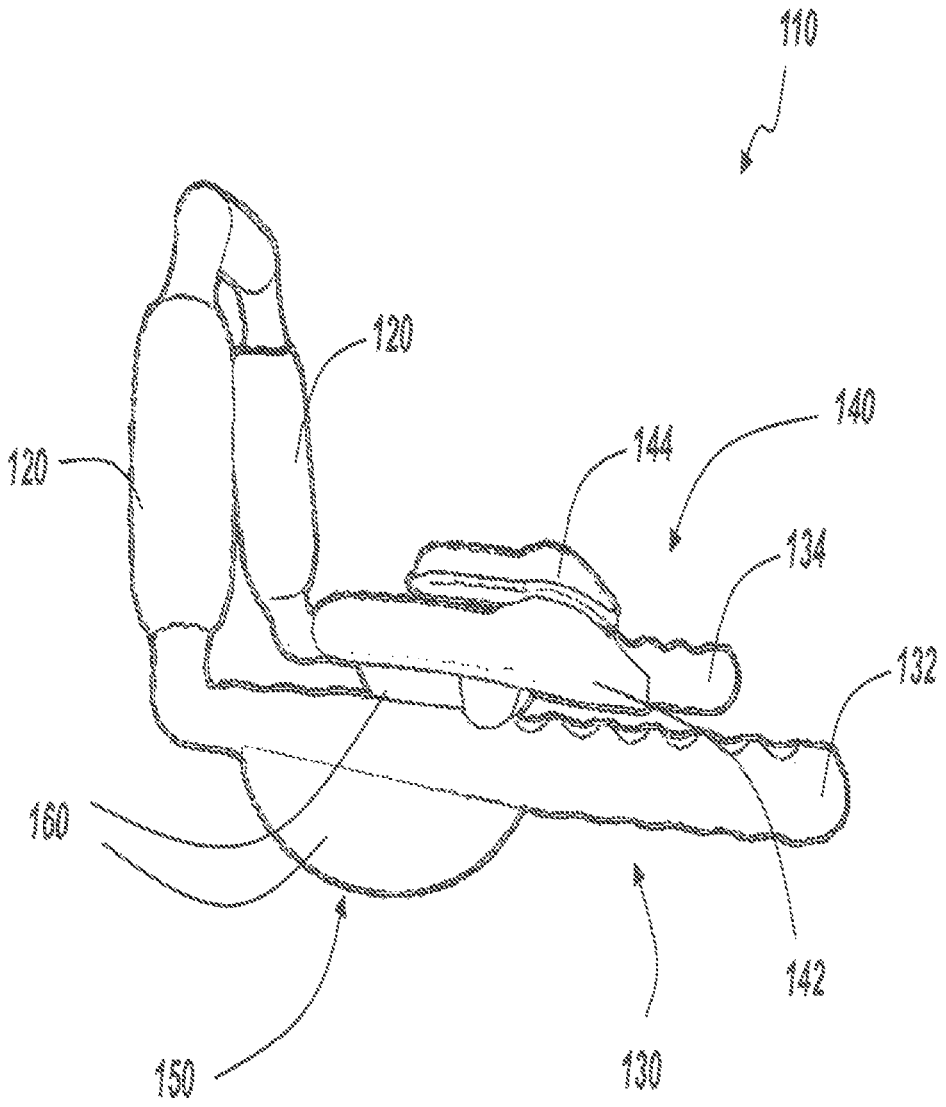
FIG. 3 is a side-view illustration of an exercise apparatus, in accordance with a first exemplary embodiment of the present disclosure.

FIG. 3 is a side-view illustration of an exercise apparatus 110, in accordance with a first exemplary embodiment of the present disclosure. The exercise apparatus 110, which may be referred to herein as 'apparatus 110' (any apparatus-reference numeral—e.g., 110, 210, 410—is used only as shorthand for the figure set of the exemplary embodiment then under discussion) includes a hand grip 120. A frame member 130 is associated with the hand grip 120. At least one arm support pad 140 is connected to the frame member 130, wherein a distance between the hand grip 120 and the at least one arm support pad 140 is adjustable. A ground-interface surface 150 is positioned along at least a portion of the frame member 130.

Figure 1:
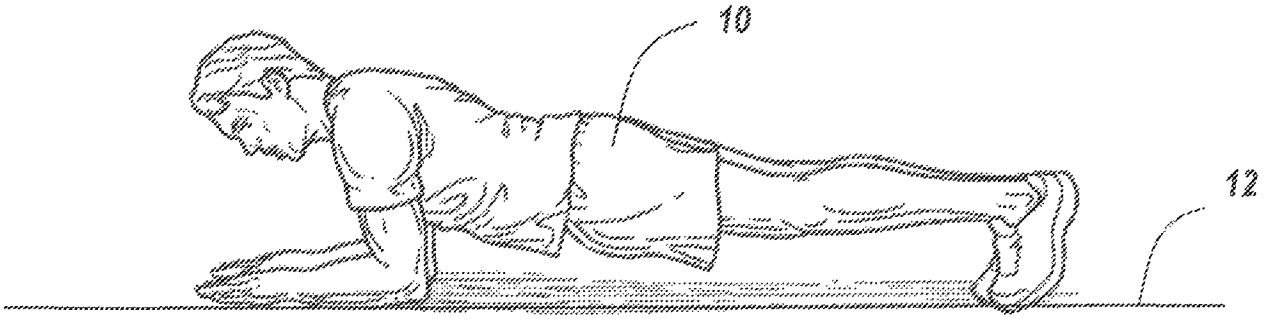
FIG. 1 (Prior Art)
FIG. 1 is a side view illustration of person 10 in a front plank position, in accordance with the prior art.

The apparatus 110 may be used to assist or aid in abdominal core conditiong and plank exercises. For example, when the apparatus 110 is used, the user may be positioned in a conventional plank position, as is shown in FIG. 1, but with his or her hands grasping the hand grip 120 and his or her forearms in contact with the at least one arm support pad 140. The apparatus 110 may offer significant benefits to users, as detailed throughout this disclosure. Further, it is noted that the apparatus 110 may include many variations in structure, components, and function, all of which are considered within the scope of the present disclosure.

Relative to FIG. 3, the frame member 130 may be a bifurcated frame member having a first leg 132 and a second leg 134. Each of the first and second legs 132, 134 may be positioned on opposing sides of the hand grip 120 such that the first and second legs 132, 134 are connected between the hand grip 120 and the at least one arm support pad 140. Further, it may be common for the at least one arm support pad 140 to include a first arm support pad 142 and a second arm support pad 144, each connected to one of the first and second legs 132, 134 of the frame member 130. Other designs of the apparatus 110 may include a single frame member 130 that is positioned substantially central to the hand grip 120 and/or the at least one arm support pad 140, as is discussed relative to FIG. 23-24.

As is shown in FIG. 3, the hand grip 120 may be integrally formed within a forward section of the bifurcated frame member 130, wherein each of the first and second legs 132, 134 extend from opposing sides of the hand grip 120, respectively. The hand grip 120 may include an ergonomic structure that can be grasped by the user's hand when using the apparatus 110. The hand grip 120 may include, for example, a substantially cylindrical structure which is covered, partially or fully, with padding, foam, texturized material, or another material to enhance ease of use of the hand grips 120. The hand grip 120 may also have a position that provides fully ergonomic use of the apparatus 110. These ergonomic positions may include the hand grip 120 being positioned slightly below a plane of the user's arm when resting on the arm support pad 140, such that the user's wrist can bend slightly downward, and/or the hand grip 120 being positioned at an angle, relative to a vertical position, inwardly toward a center of the apparatus 110. Other orientations of the hand grips may also be used to enhance ergonomic use of the apparatus 110. The first and second legs 132, 134 of the frame member 130 may extend from the hand grip 120 in a variety of configurations, such as a straight extension, as shown in FIG. 3. Commonly, the first and second legs 132, 134 of the frame member 130 may include a tubular member which has a rigid, durable construction capable of supporting the body weight of the user.

The first and second arm support pads 142, 144 may include structures which are positioned on or carried by the first and second legs 132, 134, such that the first and second arm support pads 142, 144 can be positioned along a length of the first and second legs 132, 134. Commonly, the first and second arm support pads 142, 144 include a rigid or semi-rigid structure having a curvilinear shape which matches or substantially matches a human forearm shape. The curvilinear shape may be characterized as a curvilinear arm contact surface which can substantially conform to an outer radial surface of the forearm of the user when the user is positioned with his or her forearm on the arm support pad. The first and second arm support pads 142, 144 may include padding to increase comfort of the user when his or her body weight is placed on the first and second arm support pads 142, 144.

When in use, the apparatus 110 may be positioned on a ground surface, which may include any type of athletic supporting surface, such as pavement, a grassy field, a gym floor, or others. The apparatus 110 may include a number of points which make contact with the ground surface. Primarily, the ground-interface surface 150 may be used to interface the contact between the apparatus 110 and the ground surface, and other points along the apparatus 110 may aid or assist in supporting the apparatus 110 on the ground. The ground-interface surface 150 may be any surface or surfaces along a bottom edge of the frame member 130 or other structures extending from the frame member 130.

Figure 4:
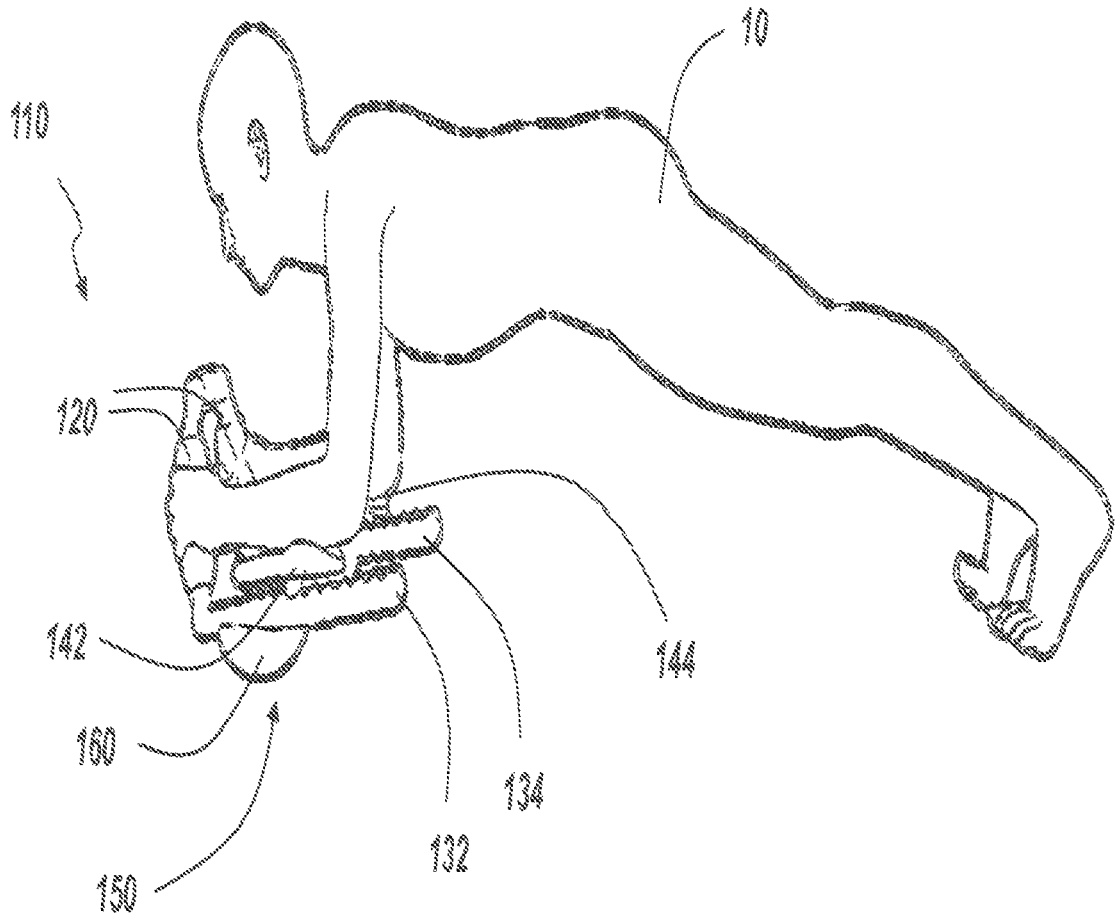
FIG. 4 is a side-view illustration of an exercise apparatus in use with person 10, in accordance with the first exemplary embodiment of the present disclosure.

FIG. 4 is a side-view illustration of an exercise apparatus 110 in use with person 10, in accordance with the first exemplary embodiment of the present disclosure. The person 10 in FIG. 4 is positioned in a plank exercise position on the apparatus 110, whereby the user is grasping the hand grip 120 and his or her forearms positioned on the first and second arm support pads 142, 144. The position of the user's spaced forearms and less-spaced hands may form a triangular shape, which may correspond to a heightened ergonomic position. In this position, the user's body weight is being transferred through his or her feet to a surface of the ground 12 and through his or her upper arms and into the apparatus 110. Specific to the transfer of forces through the user's arms, unlike conventional devices which require the force to be transferred directly through the localized area of the elbow, the apparatus 110 allows the force to be distributed across the user's forearms and into the first and second arm support pads 142, 144, as well as through the user's hands to the hand grip 120. This distribution of force may lessen the chance of injury or discomfort to the user. Furthermore, the user may use his or her hands to stabilize the plank position on the apparatus 110, in contrast to a plank exercise without a hand grip.

Relative to FIGS. 3-4, the apparatus 110 may have the ground-interface surface 150 positioned on a destabilizing device 160. The destabilizing device 160 may be removably connectable to the frame member 130, or one or both of the first and second legs 132, 134 by inserting it into a slot thereon or unscrewing it therefrom. The destabilizing device 160 may facilitate a destabilizing movement of the frame member 130 controllable by the user. The destabilizing movement may include, for example, a pivoting of the frame member 130 about a pivot axis located within the destabilizing device 160. This pivoting movement may be achieved by providing a ground-interface surface 150 which is positioned along the curved surface of the destabilization device 160. In this example, the ability of the apparatus 110 to pivot may allow the user to achieve an enhanced exercise, since destabilization utilizes additional muscles within the user's torso and upper body. The destabilizing device 160 can be moved or positioned along the length of the first and second legs 132, 134 to connect thereto at different attachment points. Varying the point of attachment of the destabilization device 160 to the frame member 130 may vary the degree of instability or destabilization of the apparatus 110, which can be used to effect different exercises on the apparatus 110. It is also noted that the destabilization device 160 may include a variety of different shapes and/or curvatures to effect different levels of instability, such as, for example, shortened curvatures, enlarged curvatures, constant radii curvatures, or variable radii curvatures, to name a few.

It is important to note that the destabilized movement of the apparatus 110 may include rotational movement about one or more axes. In some cases, such as shown in FIGS. 3-4, the rotational movement may be limited to movement in a single degree of freedom, e.g., rotational movement about an axis of curvature of the curved surface of the destabilizing device 160. This single degree of freedom movement may allow the apparatus 110 to pivot or rock about the destabilizing device 160, which provides an enhanced plank exercise experience. A variety of other destabilizing devices 160 can be employed with the apparatus 110, as are discussed relative to other figures.

Figure 5:
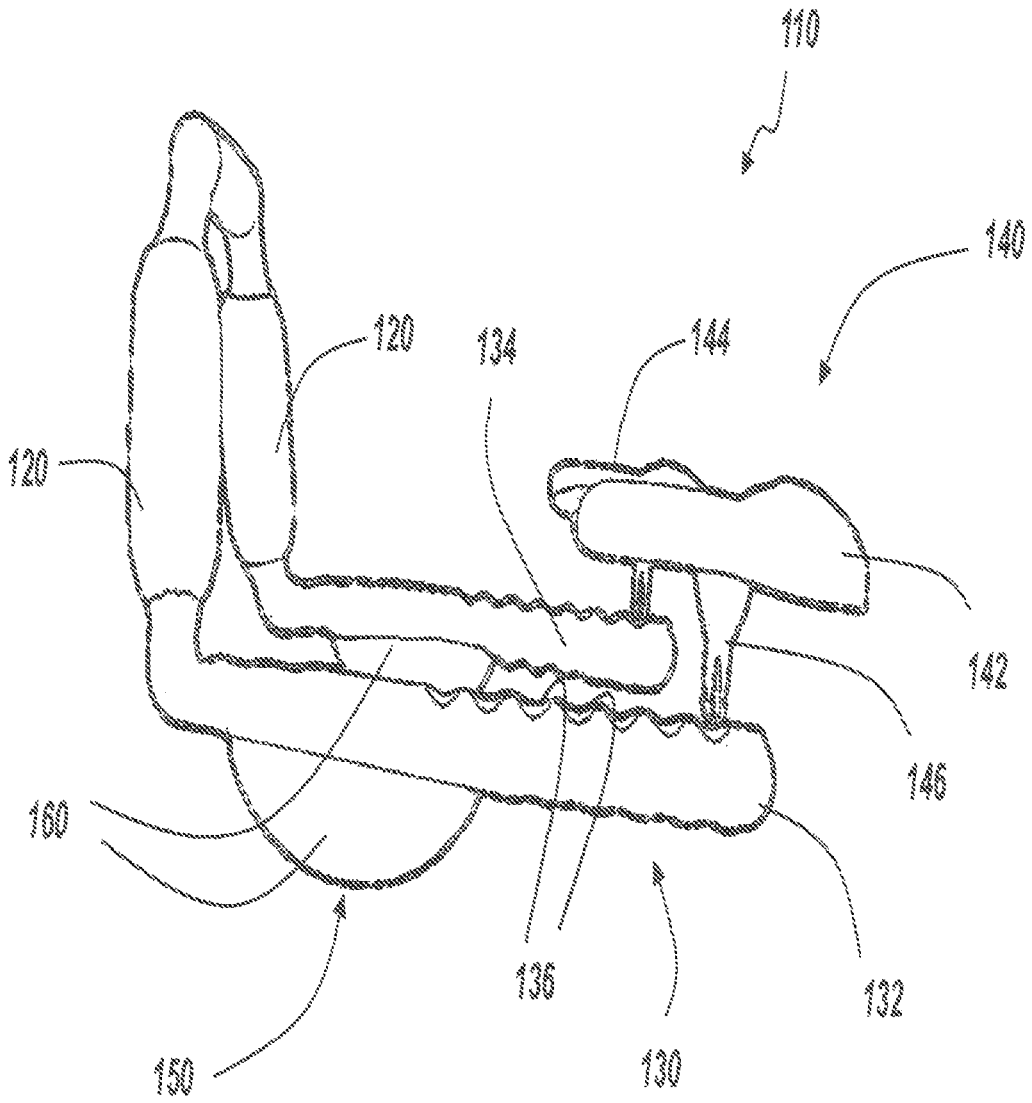
FIG. 5 is a side-view illustration of an exercise apparatus, in accordance with the first exemplary embodiment of the present disclosure.

FIG. 5 is a side-view illustration of an exercise apparatus 110, in accordance with the first exemplary embodiment of the present disclosure. One of the benefits of the apparatus 110 is its ability to be easily adjusted to users of different body sizes. One way of achieving this adjustability is by adjusting a distance between the hand grip 120 and the at least one arm support pad 140 by moving the at least one arm support pad 140 along a length of the frame member 130. There may be a number of ways to achieve this adjustability, one of which includes utilizing a plurality of holes 136 positioned at spaced intervals within the frame member 130, or within each of the first and second legs 132, 134 of the frame member 130. These holes 136 may receive an extended connector 146 which is positioned on the at least one arm support pad 140, or on both of the first and second arm support pads 142, 144. Similarly, the destabilizing device 160 may be adjustable between positions along the length of the frame member 130 to vary a point of controlled, destabilized movement. The destabilizing device 160 may incorporate the same or similar extended connector 146 as the arm support pads 140.

The extended connector 146 may include, for example, a male fastener which can be positioned within the hole 136 to locate the arm support pad 140 substantially above or proximate to the hole 136. By varying the positioning of the extended connector 146 within the plurality of holes 136, the user can select which positioning of the arm support pad 140 is desired. The extended connector 146 may include features to retain it within the hole 136, such as a biased or snap connector. One type of extended connector 146 may utilize a tab and slot system, where when the extended connector 146 is moved into the hole, a tab on the interior sidewall of the hole 136 is received within a shortened slot in the extended connector 146. Once the extended connector 146 achieves a fully-inserted position, the tab may be positioned beyond the slot where the extended connector 146 may be rotated to lock the extended connector 146 within the hole 136.

Figure 6:
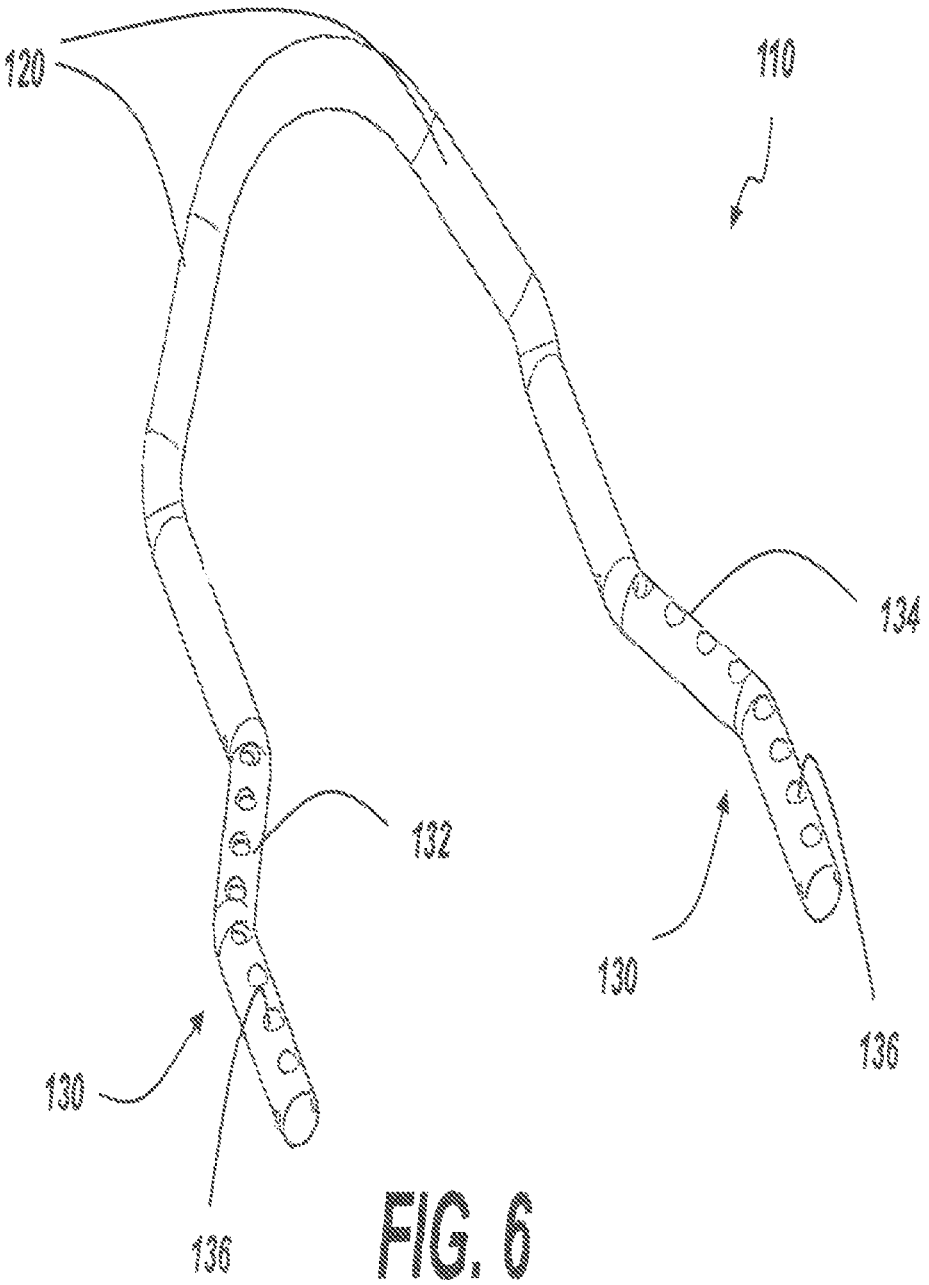
FIG. 6 is an isometric view illustration of an exercise apparatus, in accordance with a second exemplary embodiment of the present disclosure.

FIG. 6 is an isometric view illustration of an exercise apparatus 110, in accordance with the second exemplary embodiment of the present disclosure. Specifically, FIG. 6 depicts the hand grips 120 formed integral with a bifurcated frame member 130 having first and second legs 132, 134, which rest in contact with the ground surface. In some embodiments, the hand grips 120 may also be constructed of separate parts made of metal, plastic, rubber or other similar materials. Each of the first and second legs 132, 134 may have a specific shape which allows for more adjustability of the apparatus 110. As is shown, each of the first and second legs 132, 134 may include holes 136 which are positioned for arm support pad attachment along various portions of the first and second legs 132, 134. These various portions of the first and second legs 132, 134 may include straight and angularly positioned lengths, such that the relative distance between the first leg 132 and the second leg 134 can be variable, dependent on which location along the first and second leg 132, 134 is selected. As is further shown in FIG. 6, the relative distance from the first leg 132 to the second leg 134 can be variable along one section of the frame member 130, e.g., the angularly-positioned, middle section, and constant along a different section of the frame member 130, e.g., the section proximate to a terminating end of each of the first and second legs 132, 134. Any combination of variable and/or constant distances may be used.

FIGS. 6.1-6.2 each presents an isometric, rearward view of various embodiments of the first and second arm support pads 142, 144 compatible with the apparatus 110 of FIG. 6. Each of the first and second arm support pads 142, 144 have a soft, resiliently deformable surface. Relative to FIG. 6.1, the first and second arm support pads 142, 144 feature an attachment peg 175 extending from rigid pad structural member 188. Due to the round shape of attachment peg 175, the first and second arm support pads 142, 144 shown in FIG. 6.1 are rotatable. FIG. 6.2 illustrates the first and second arm support pads 142, 144 with a concave female shape on an underside thereof, allowing it to matably connect with the first and second legs 132, 134. In some embodiments, the concavity on the underside of the first and second arm support pads 142, 144 may itself be formed of soft, resiliently material that still allows the first and second arm support pads 142, 144 to connect with the first and second legs 132, 134.

Figure 7:
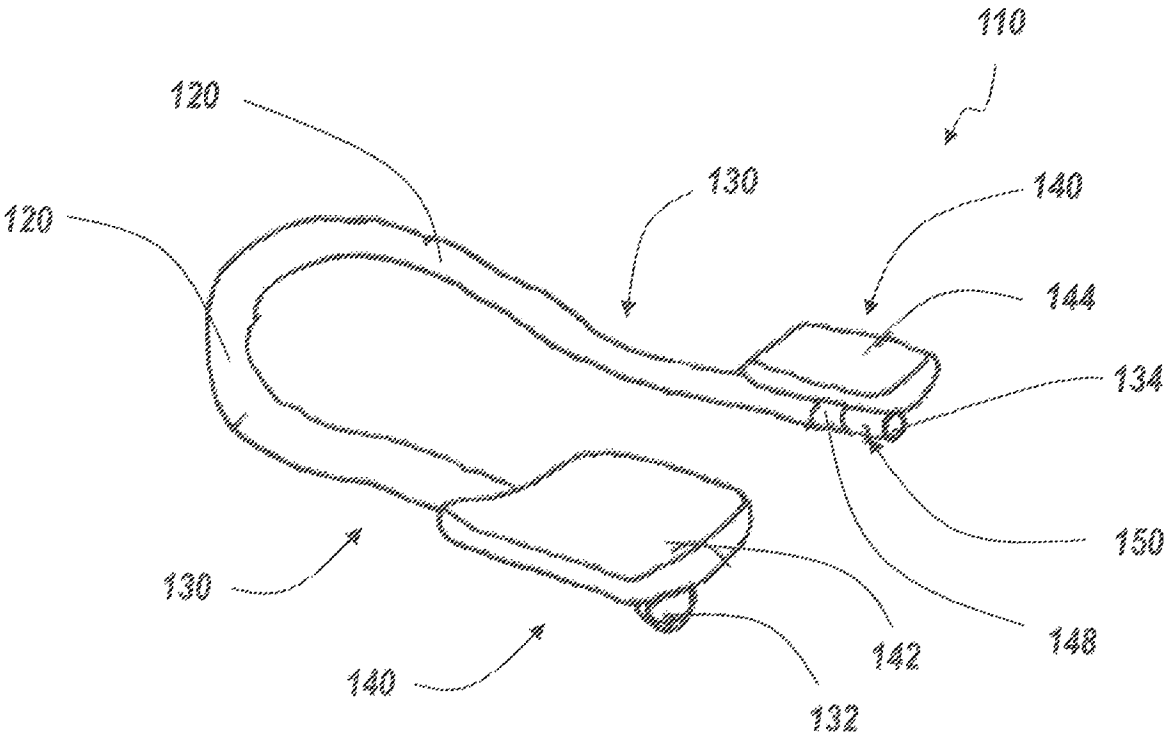
FIG. 7 is an isometric view illustration of an exercise apparatus, in accordance with a third exemplary embodiment of the present disclosure.

FIG. 7 is an isometric view illustration of an exercise apparatus 110, in accordance with the third exemplary embodiment of the present disclosure. FIG. 7 illustrates the apparatus 110 having a bifurcated frame member 130 with first and second legs 132, 134 that are integrally connected to the hand grip 120. The arm support pad 140 includes first and second arm support pads 142, 144 which are positioned on each of the first and second legs 132, 134, respectively. Instead of using holes and extended connectors, the first and second arm support pads 142, 144 may utilize a strap 148 which is connected to each of the first and second arm support pads 142, 144 and positioned around each of the first and second legs 132, 134, respectively. The strap 148 may be movable along the length, or a portion of the length, of the first and second legs 132, 134 to adjust the position of the first and second arm support pads 142, 144. The strap 148 may include a variety of components to enhance usability, include a high-friction material coating an exterior of the strap 148. The exterior of the strap 148 surface having the high-friction material may act as the ground-interface surface 150 to retain the apparatus 110 in place during use.

Figure 8:
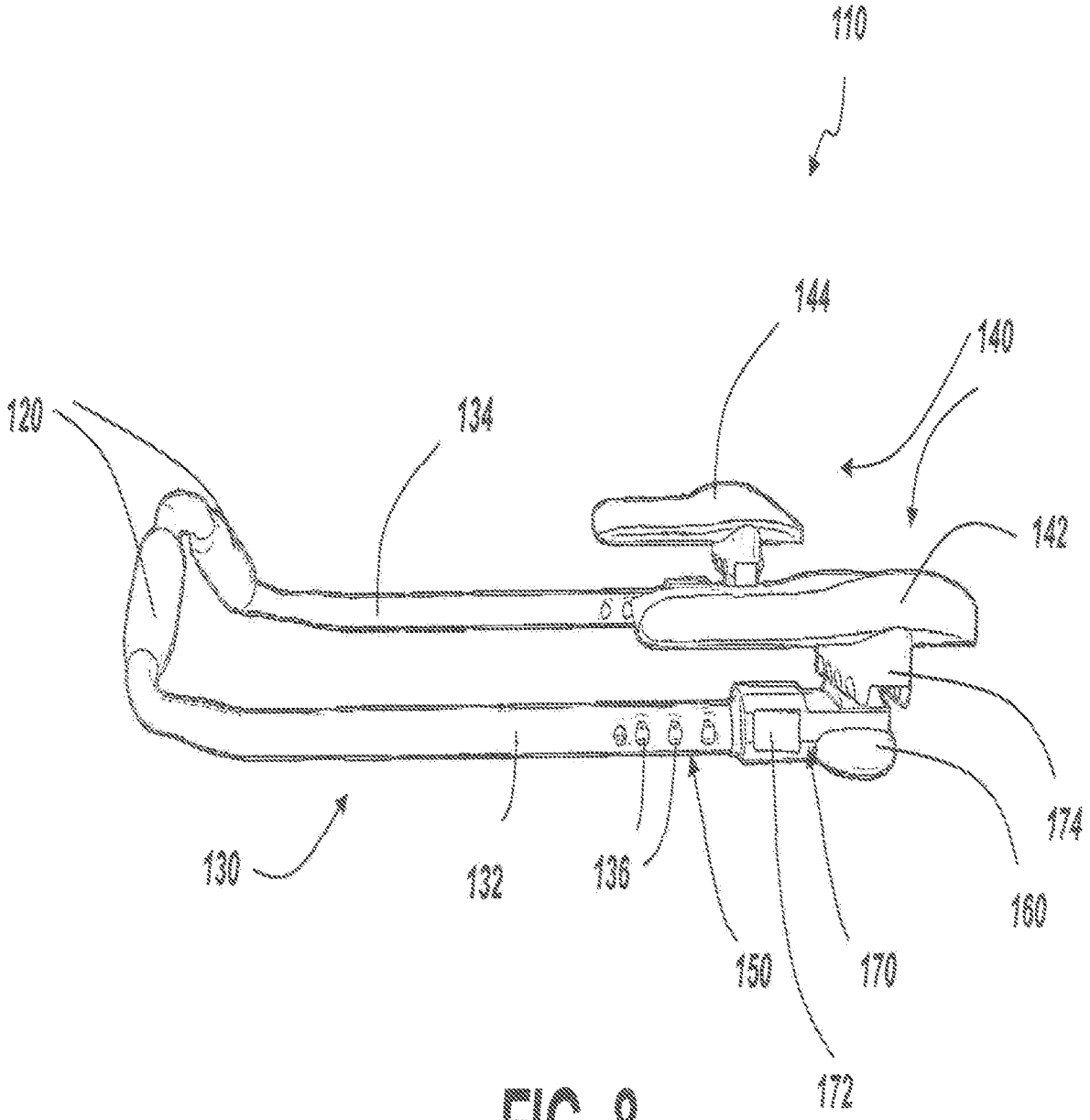
FIG. 8 is a side-view illustration of an exercise apparatus, in accordance with a fourth exemplary embodiment of the present disclosure.

FIG. 8 is a side-view illustration of an exercise apparatus 110, in accordance with the fourth exemplary embodiment of the present disclosure. The exercise apparatus 110 includes the hand grip 120 and a bifurcated frame member 130 extending from the hand grip 120, wherein first and second legs 132, 134 are connected to either side of the hand grip 120. The arm support pad 140 includes first and second arm support pads 142, 144 which are each connected to one of the first and second legs 132, 134. A distance between the hand grip 120 and the first and second arm support pads 142, 144 is adjustable. A ground-interface surface 150 is positioned along at least a portion of the frame member 130.

The apparatus 110 of FIG. 8 includes some variations relative to FIGS. 3-7. For example, the apparatus 110 of FIG. 8 may include side-mounted holes 136 positioned along each of the first and second legs 132, 134. The first and second arm support pads 142, 144 may be carried on a hub 170 which interfaces between the first and second legs 132, 134 and the first and second arm support pads 142, 144, respectively. The hub 170 may be connected to the destabilizing device 160 and include one or more extended connectors (not shown) that can be engaged with one of the plurality of holes 136 to adjust the location of the arm support pads 140 along the frame member 130. To control engagement of the extended connectors with the holes 136, an actuatable engagement device 172 may be used, where actuation of the actuatable engagement device 172 disengages the extended connector from the hole 136 to permit the arm support pad 140 to move along at least a portion of the length of the frame member 130. The actuatable engagement device 172 may include a button or other feature which can be depressed to disengage the extended connector from the hole 136. Various designs may be used to facilitate the internal functioning of the actuatable engagement device 172.

Figure 9:
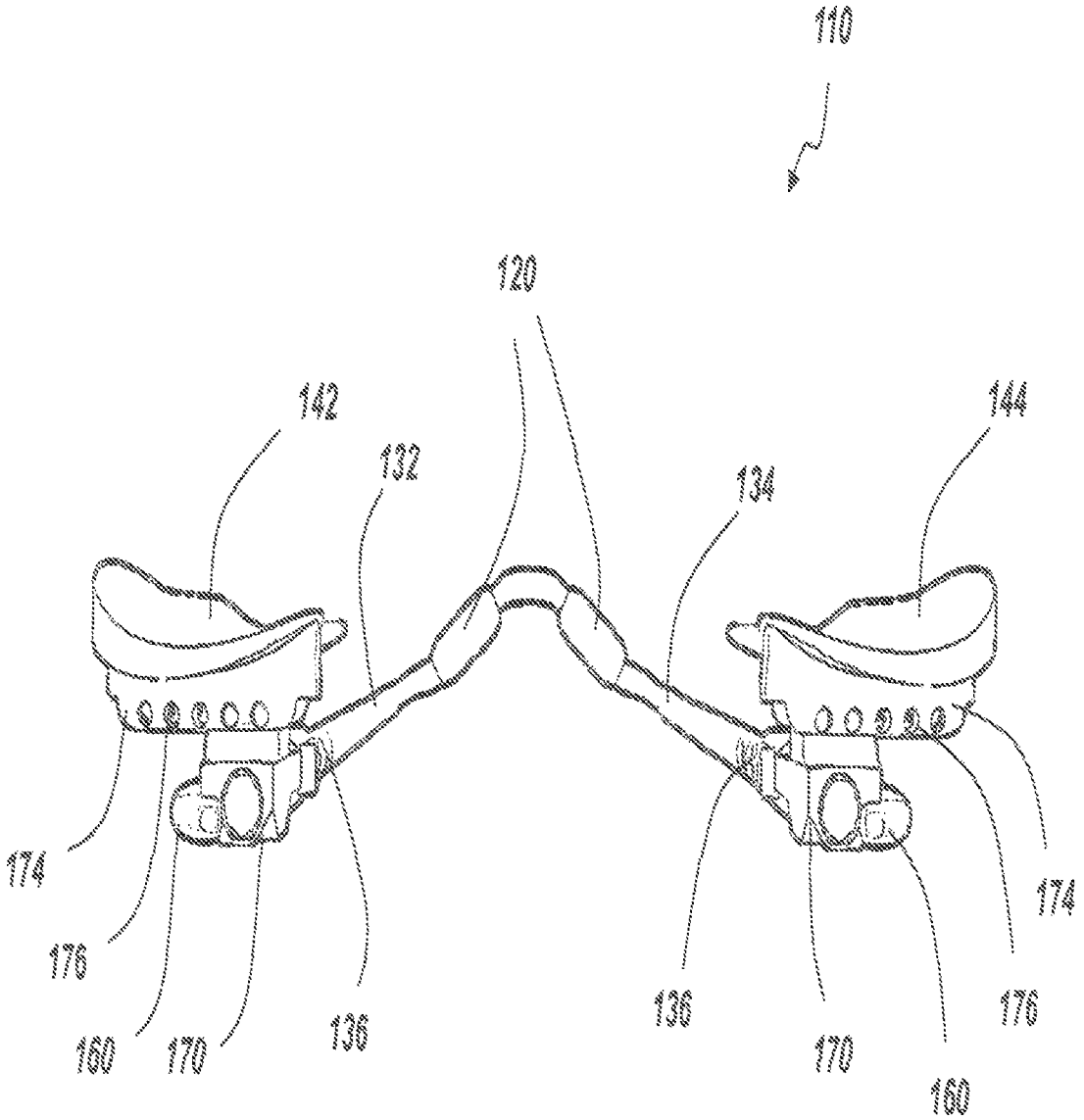
FIG. 9 is a rear-view illustration of an exercise apparatus, in accordance with the fourth exemplary embodiment of the present disclosure.

It is further noted that a variety of mechanical interfaces may be used to facilitate the adjustment or sliding of the first and second arm support pads 142, 144 on the first and second legs 132, 134, respectively. For example, the first and second legs 132, 134 may have a substantially cylindrical shape, a partially cylindrical shape, or a non-cylindrical shape such as a square shape, e.g., when square tubing members are used to form the first and second legs 132, 134. Any cross-sectional shape of the first and second legs 132, 134 may be utilized and the hub 170, or another component to coordinate adjustment of the first and second arm support pads 142, 144, may have a corresponding shape. In another example, the hub 170 may be positioned only on an upper half of each of the first and second legs 132, 134, as opposed to fully encircling the first and second legs 132, 134. It is also possible to use any number or type of grooves, ridges, guiding features, or other structural designs that facilitate successful movement of the first and second arm support pads 142, 144 on the first and second legs 132, 134, all of which are considered to be within the scope of the present disclosure. FIG. 9 is a rear-view illustration of an exercise apparatus 110, in accordance with the fourth exemplary embodiment of the present disclosure. The hub 170 may also include a lateral movement device 174 which supports the first and second arm support pads 142, 144 and controls a lateral movement thereof. The lateral movement of the first and second arm support pads 142, 144, as depicted in FIGS. 8-9, may be along a lateral direction which is oriented substantially perpendicular to a length of the frame member 130 and a length of the first and second legs 132, 134. Thus, while the plurality of holes 136 and the extended connector, or similarly functioning device, may allow adjustability of the first and second arm support pads 142, 144 along the length of the first and second legs 132, 134, the lateral movement device 174 may control movement of the first and second arm support pads 142, 144 in a different direction. Lateral movement of the first and second arm support pads 142, 144 may facilitate the varied shoulder widths of users, allowing the apparatus 110 to properly match each user's body size. While the lateral movement device 174 may include a variety of mechanical structures to facilitate lateral movement, the lateral movement device 174 of FIG. 9 may include a plurality of holes 176 spaced at intervals along the length of the lateral movement device 174. A portion of the hub 170 may extend upward into the lateral movement device 174 and a biasable pin or other fastener may connect the lateral movement device 174 to the hub 170.

Figure 2:
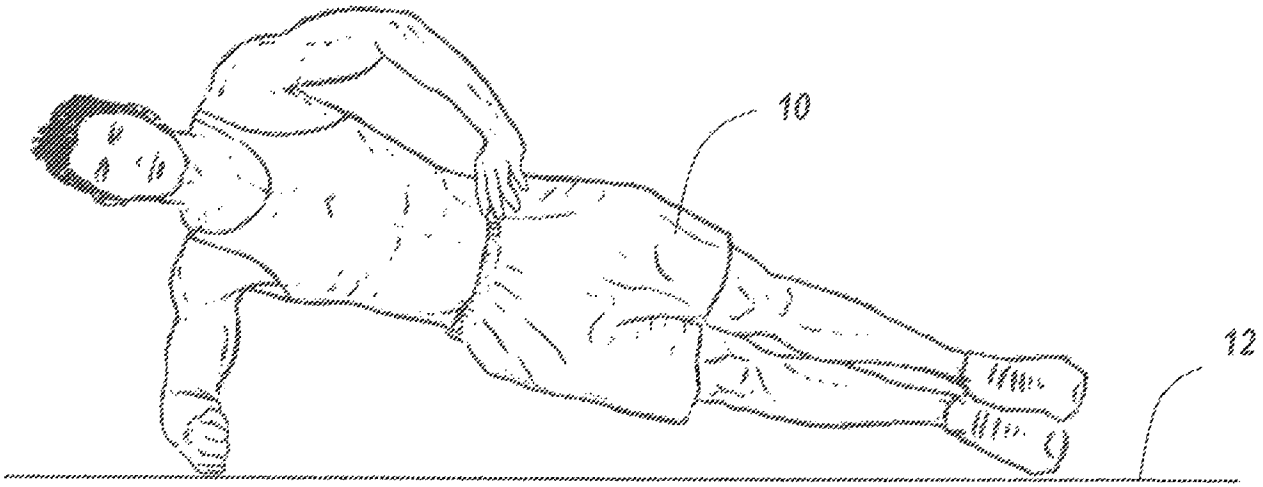
FIG. 2 (Prior Art)
FIG. 2 is a side view illustration of person 10 in a side plank position, in accordance with the prior art.
Figure 10:
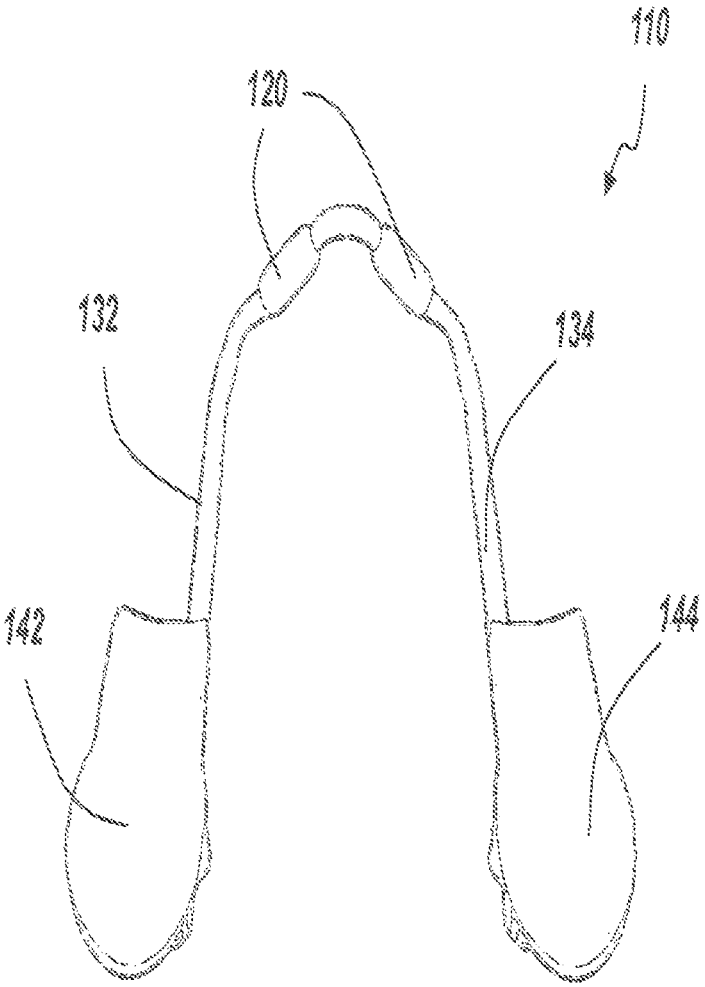
FIGS. 10-11 are top-view illustrations of an exercise apparatus, in accordance with the fourth exemplary embodiment of the present disclosure.
Figure 11:
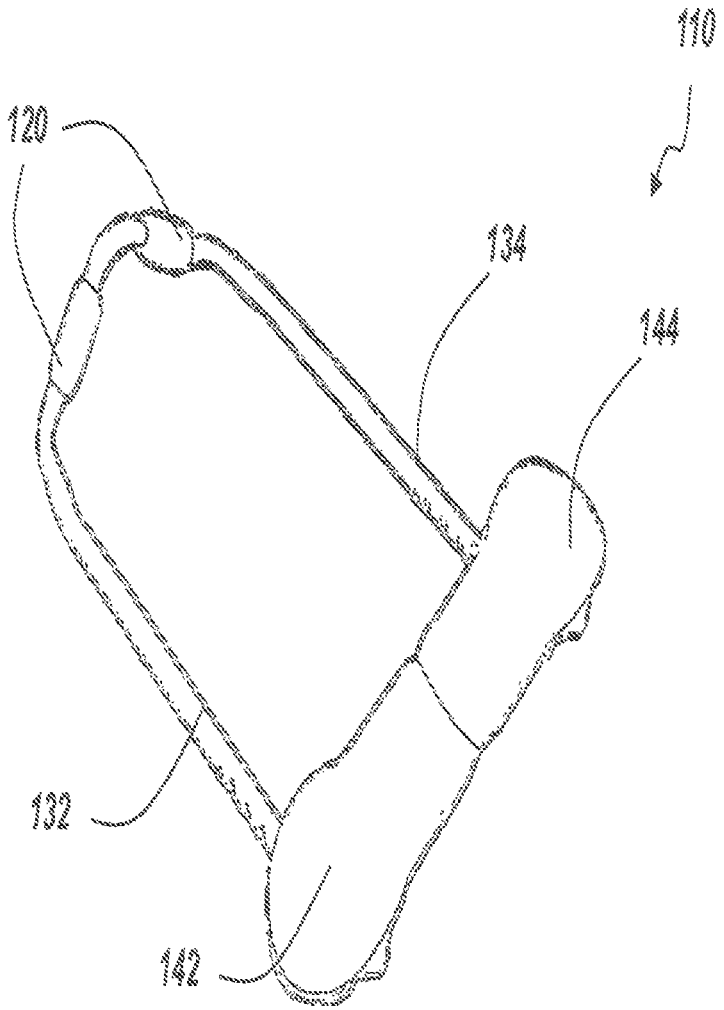

FIGS. 10-11 are top-view illustrations of an exercise apparatus 110, in accordance with the fourth exemplary embodiment of the present disclosure. While FIG. 10 illustrates the first and second arm support pads 142, 144 in a straight-forward orientation, it is possible for the first and second arm support pads 142, 144 to be rotated to achieve an inward-facing orientation, as shown in FIG. 11. Rotation of the first and second arm support pads 142, 144 may be about a substantially vertical axis positioned through each of the first and second arm support pads 142, 144. The rotation of the first and second arm support pads 142, 144 may be limited to a specific degree of movement, such as a 90 degree movement. This 90 degree movement of each of the first and second arm support pads 142, 144 may allow the separate first and second arm support pads 142, 144 to abut or substantially abut one another to provide, in effect, a combined arm support pad 140. The combined arm support pad 140 may be used primarily for users in a side plank position, as shown in FIG. 2, where the user's forearm can be positioned in the combined arm support pad 140 to provide additional support during the exercise.

While a 90 degree rotation of the first and second arm support pads 142, 144 may be common to form the combined arm support pad 140, a rotation of less than 90 degrees may also have benefits. For example, rotation of the first and second arm support pads 142, 144 may also help orient the user's wrist at a comfortable trajectory to the hand grips 120, thereby adjusting the first and second arm support pads 142, 144 for users with different arm or body sizes. The adjustability of the first and second arm support pads 142, 144 allows the user to achieve a comfortable trajectory to the hand grips 120, regardless of their body size or personal trajectory preference.

Figure 12:
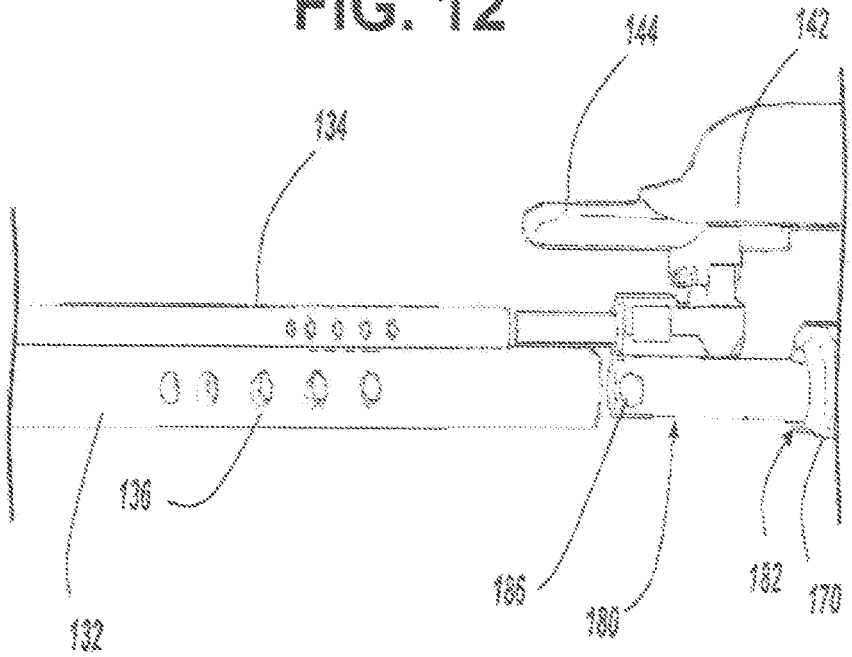
FIG. 12 is a partially exploded side-view illustration of an exercise apparatus, in accordance with a fifth exemplary embodiment of the present disclosure.

FIG. 12 is a partially exploded side-view illustration of an exercise apparatus 110, in accordance with the fifth exemplary embodiment of the present disclosure. As is shown in FIG. 12, the first and second arm support pads 142, 144 may attach to the first and second legs 132, 134 using a post 180 which can be positioned inside each of the first and second legs 132, 134. The post 180 has an outer diameter that is smaller than an inner diameter of the first and second legs 132, 134. The hub 170 supporting the first and second arm support pads 142, 144 may include an interior cavity 182 which can receive the distal end of the first and second legs 132, 134 when the post 180 of each of the first and second arm support pads 142, 144 is positioned in the first and second legs 132, 134, respectively.

The post 180 may further include a groove 184 therein which runs along a length of the post 180. The groove 184 may engage with a fastener 186, such as a blunt-tip screw, which can be positioned through one of the holes 136 in the first and second legs 132, 134 (in FIG. 12, the fastener 186 is shown engaged with the groove 184). When the post 180 is positioned within the interior of the leg 132, for example, the post 180 may be moved therein with the end of the fastener 186 engaged with the groove 184. A tip of the post 180 may have a stop to prevent the fastener 186 from exiting the groove 184, thereby preventing disconnection of the first and second arm support pads 142, 144 from the first and second legs 132, 134, respectively.

As shown in FIG. 12.1, the first and second arm support pads 142, 144 may be carried on a hub 170, sometimes referred to herein as a pad support member, that may include an attachment interface member for the first and second legs 132, 134, respectively.

In some embodiments, the hub 170 may include a rotatable interface to alter the orientation the first and second arm support pads 142, 144 relative to the hand grips 120. The first and second arm support pads 142, 144 include arm support portions 143 which generally provide a user-contact surface positioned anteriorly to a user's arm during use. In the preferred embodiment, apparatus 110 is arranged that the user-contact surface of arm support portions 143 are parallel or substantially parallel with a flat ground surface. As shown in FIG. 12.1, the first and second legs 132, 134 are angled in slightly toward one another, in an arrangement that allows a user to vary the lateral distance between first and second arm support pads 142, 144 by moving either of them along a length of frame member 130. In another embodiment, however, the first and second legs 132, 134 may be arranged substantially parallel to one another. In the preferred embodiment, the spacing between the first and second legs 132, 134, or between the first and second arm support pads 142, 144, or both, generally corresponds with the spacing of a typical user's shoulders and allows the user to assume a comfortable position during planking exercises.

As further illustrated in FIG. 12.1, in the preferred embodiment, hub 170 is composed of plastic or similar material. The ground-interface surface 150 is positioned about the apparatus 110, including, in the case of the preferred embodiment specifically illustrated in FIG. 12.1, being positioned on a lower surface of the hub 170, so as to allow it to be in stable contact with the ground. Preferably in the case of the embodiment of the apparatus 110 illustrated in FIG. 12.1, the ground-interface surface 150 is configured to sit flush with the ground surface regardless of the positioning of the first and second arm support pads 142, 144 or the user's body weight on the apparatus 110. Such configuration allows the apparatus 110 to be used for elbow planks, side planks and push-up planks, without losing stability on the ground surface. In one embodiment, the hub 170 may have openings that allow users to grasp around the edges of the first and second arm support pads 142, 144 while doing, for example, push-ups on them. In some embodiments, it is anticipated that allowing additional ways to adjust the first and second arm support pads 142, 144. For lateral adjustments, for example, a lateral adjustment feature utilizing a version of hub 170 with a movably attached upper portion that is slidable with respect to a lower portion could be employed. One such lateral adjustment feature might be similar to the one included in the hub 170 of FIG. 8-9. Additionally, as will be noted, a lateral connection member 125 may be positioned between a left and right half of the apparatus 110. Variations of the lateral connection member 125 could be used in embodiments wherein the lateral connection member 125 is adjustable in length or contains a hinged element, allowing the distance between said left and right halves of the apparatus 110 to be varied by extending said lateral connection member 125 or rotating the left and right legs 132, 134 around a vertical axis thereof. For example, FIG. 12.2 illustrates a top-down view of an embodiment of the apparatus 110 with a hinged version of the lateral connection member 125, facilitating radial adjustment of the left and right legs 132, 134 around said hinged element's vertical axis. Such hinged element can be used to alter the angulation of the left and right legs 132, 134 relative to one another, from angled inward toward one another, to parallel to one another, to a diverging attitude manually without tooling so as to alter the lateral distance between the pads. In the embodiment of the apparatus 110 shown in FIG. 12.2, left and right hinged elements 167 in the lateral connection member 125 rotate about a rotational axis member 168 and are removably connectable to one another by a small amount of user-supplied force without tools allowing them to unsnap from one another. Detaching the left and right hinged elements 167 provide increased user options, allowing the left and right halves of the apparatus 110 to be severable from each other in order to serve as completely independent arm supports capable of resting in stable contact with the ground surface.

The hub 170 may be connected to one or more extended connectors, such as extended connector member 181, which can engage with left and right legs 132, 134. As shown in FIG. 12.1, the extended connector member 181 includes holes 136 to allow adjustment of the arm support pads 142, 144, but could just as easily have fewer holes or no holes, relying instead on flexible clamp members 183 (referenced elsewhere herein). In another embodiment, the connector member 181 may be a separate tube or similar structure attached to the left and right arm support pads, respective, and the holes 136 may be situated on such separate tube or similar structure or on the left and right legs 132, 134. To control engagement with the holes 136, the left and right arm support pads can be repositioned, either by sliding them or removing them from the left and right legs 132, 134 and repositioning them at the desired position. The desired position may held by an actuatable engagement device 172, which can be spring-activated or a protrusion sufficient to be inserted in one of the holes 136. The actuatable engagement device 172 may include a button or other feature which can be depressed to help disengage the extended connector from the hole 136. Various designs may be used to facilitate the internal functioning of the actuatable engagement device 172. In the preferred embodiment, as shown in FIG. 12.1, the actuatable engagement device 172 is a pop-up connector. In another embodiment, the left and right legs may be adjustable in a telescopic manner, enjoying any locking device that is known in the field of telescoping tubes. At the same time, it should be noted, that a version of apparatus 11, as with that of all of the many various embodiments in the present disclosure, may be non-adjustable with respect to the left and right arm support pads, such that their relative distance to the hand grips 120 and/or to one another, are invariable and that the positioning of the grips 120 may also be invariable. Likewise, various variations of embodiments disclosed in the present disclosure may make use of a single forearm pad sized to accommodate both forearms of the user. And, in addition, in various embodiments, the frame, each arm support member and hand grips (or any combination of any of the foregoing) may be of one, unitary integral construction. For example, each arm support member, including any attachment structure, may be made entirely of soft, padded material, such as, for example, foam rubber.

The hand grips 120, which may be composed of plastic, rubber or other similar material and, in some embodiments, may have a non-symmetrical shape or other features that may be re-oriented by the user into a desired position by rotating the hand grips 120 about their mounting sites. In the preferred embodiment, the hand grips 120 are mounted on an upturned portion of the left and right legs 132, 134. In some embodiments, the arcuate structure of frame 130 may be composed of separate segments that join together and can be disassembled for flatter storage.

It is further noted that a variety of mechanical interfaces may be used to facilitate the adjustment the first and second arm support pads 142, 144. For example, the first and second legs 132, 134 may have a substantially cylindrical shape, a partially cylindrical shape, or a non-cylindrical shape such as a square shape, e.g., when square tubing members are used to form the first and second legs 132, 134. Any cross-sectional shape of the first and second legs 132, 134 may be utilized and the hub 170, or another component to coordinate adjustment of the first and second arm support pads 142, 144, may have a corresponding shape. It is also possible to use any number or type of grooves, ridges, guiding features, or other structural designs that facilitate successful movement of the first and second arm support pads 142, 144, all of which are considered to be within the scope of the present disclosure. In another example, the hub 170 may be positioned on the first and second legs 132, 134 in such a manner that it does not fully encircle the first and second legs 132, 134. Such arrangement allows the frame member 130 to rest closer to the ground than it otherwise would, and facilitates repositioning the left and right arm support pads by removably attaching them to the left and right legs 132, 134.

FIG. 12.3 is a rear-view illustration of an exercise apparatus 110, in accordance with the fifth exemplary embodiment of the present disclosure. FIG. 12.4 is a profile illustration of an exercise apparatus 110, in accordance with the fifth exemplary embodiment of the present disclosure. FIG. 12.5 is a bottom illustration of an exercise apparatus 110, in accordance with the fifth exemplary embodiment of the present disclosure. (Numbered features depicted in FIGS. 12.3-12.5 have the same description applicable to those features with the same numbers described relative to FIG. 12.1 above.)

Relative to FIG. 12.5, the lower surface of the hub 170 includes a tube receptacle member 173 wherein the left and right legs 132, 134, as the case may be, is removably secured. The tube receptacle 173 is lined with flexible clamp members 183, which in the preferred embodiment are arcuate plastic rib members formed in the sides of the tube receptacle 173. The tube receptacle 173 and the extended connector 181 are appropriately shaped, sufficiently flexible and resiliently deformable so as to receive the left and right legs 132, 134 when the hub 170 is pressed down thereon and adequately secure it therein. As a result, the hub 170 can be slidably moved, lifted, and replaced on the left and right legs 132, 134, as the case may be, in the desired position by the user by hand and without tooling. Likewise, in the preferred embodiment, no additional fasteners other than the flexible clamp members 183 are needed to secure the hub 170 to the frame member 130. One benefit of this is, in the preferred embodiment, is that the frame member 130 is able to be in direct communication with the ground surface or in very close proximity thereto (e.g., an inch or less). Further illustrated in FIG. 12.5 are anti-skid members 197, preferably composed of rubber, vinyl, polyurethane, plastic or similar material, facilitating stable positioning of the apparatus 110 on the ground surface.

In addition, the first and second legs 132, 134 of the apparatus 110 may have a rotatable connection 127 to the frame member 130 as shown in FIG. 12.6, allowing further adjustments. Likewise, the first and second arm support pads 142, 144 may have a rotatable connection structure 128 to the frame member 130. Of course, many adjustment mechanisms described in the present disclosure may be combined or omitted from the apparatus 110 in order to provide a satisfactory user experience.

As shown in FIG. 12.7, a destabilizing apparatus 101 similar to destabilizing device 460 (as described elsewhere herein) may be connected to the apparatus 110. For example, in the embodiment shown in FIG. 12.7, a cross-bar 135 mounted perpendicular to the first and second legs 132, 134 of the apparatus 110 of FIG. 12.1 allows for fasteners to be positioned at openings 177 to mount the destabilizing apparatus 101 to the first and second legs 132, 134. The destabilization device 101 may include a spherical structural member or, as shown in FIG. 12.7, a semispherical structural member 102, which has a lowered edge that is positioned to contact a ground surface. The destabilization device 101 may also enclose a spherical structural member in a casing to provide a ball-and-joint-arrangement. The cross-bar 135 may be removably detachable as by, for example, screwing it and unscrewing it from the apparatus 110. Further, a destabilization device similar to destabilization device 160 shown, among other places, in FIG. 9.

FIG. 12.8 is a side-view illustration of an exercise apparatus in use with a user 11, in accordance, e.g., with the fifth exemplary embodiment of the present disclosure.

Figure 13:
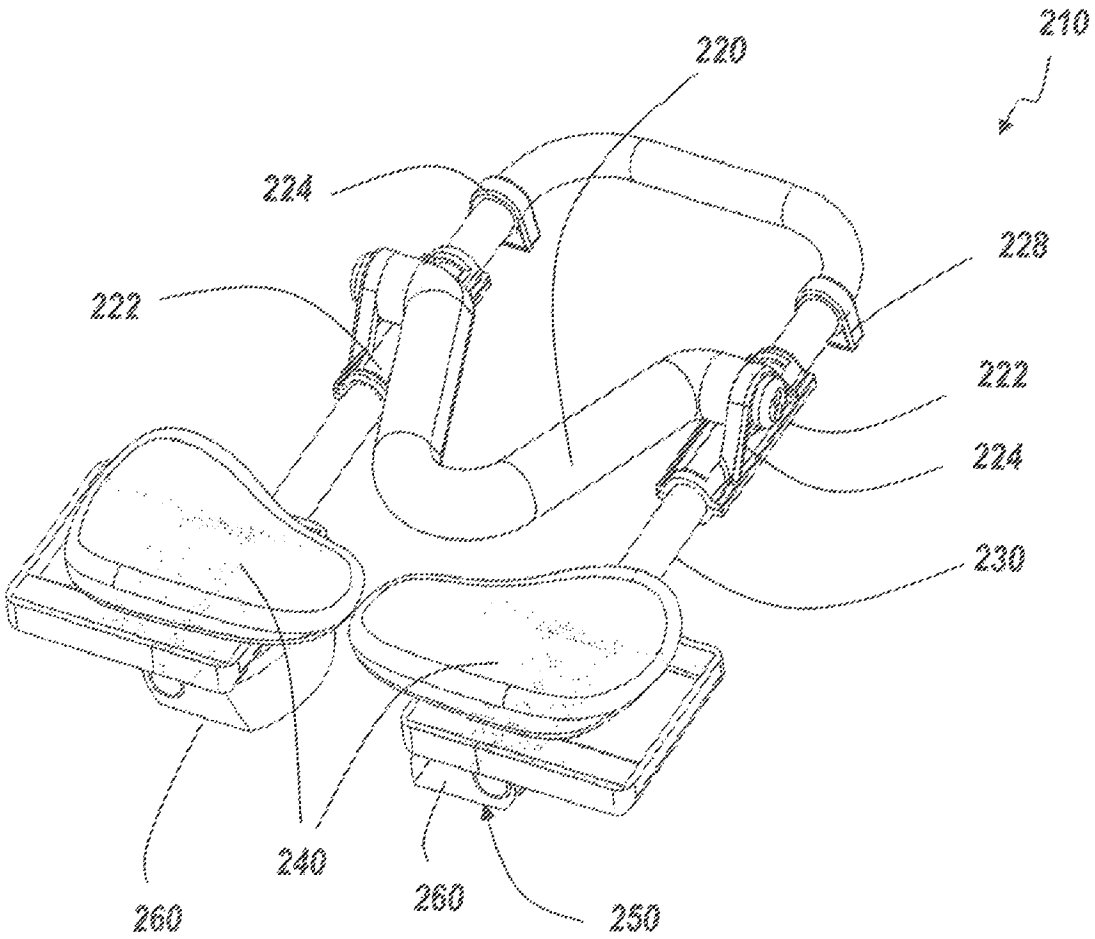
FIG. 13 is an isometric view illustration of an exercise apparatus, in accordance with a seventh exemplary embodiment of the present disclosure.

FIG. 13 is an isometric view illustration of an exercise apparatus 210, in accordance with a seventh exemplary embodiment of the present disclosure. The exercise apparatus 210, which may be referred to herein as 'apparatus 210' may be substantially similar to the apparatus 110 described with respect to FIGS. 3-12, and may include any of the features, components, or functions discussed relative to FIGS. 3-12. The apparatus 210 of FIG. 13 includes a hand grip 220. A frame member 230 is associated with the hand grip 220. At least one arm support pad 240 is connected to the frame member 230, wherein a distance between the hand grip 220 and the at least one arm support pad 240 is adjustable. A ground-interface surface 250 is positioned along at least a portion of the frame member 230.

Figure 14:
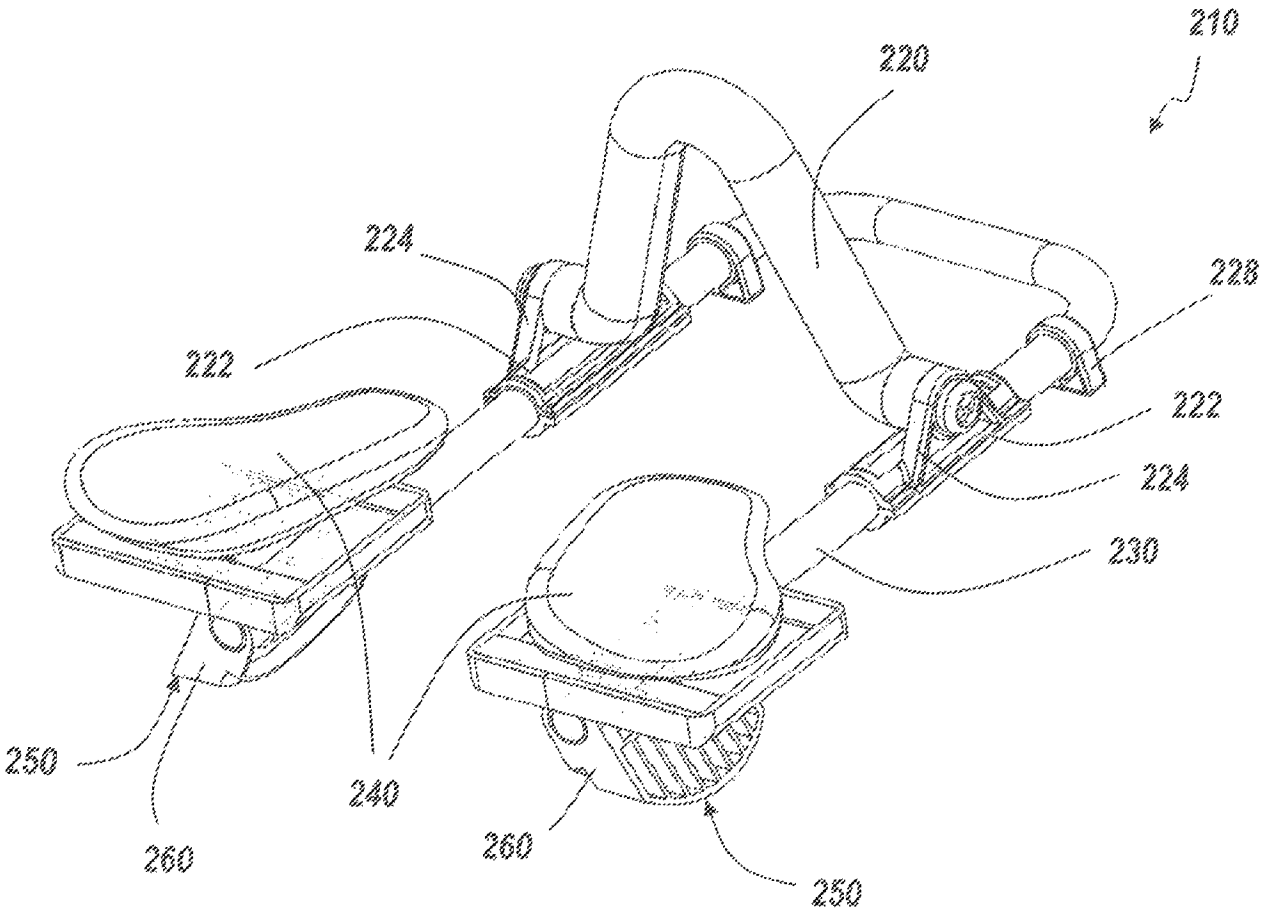
FIG. 14 is an isometric view illustration of the exercise apparatus of FIG. 13, in accordance with the seventh exemplary embodiment of the present disclosure.

FIG. 14 is an isometric view illustration of the exercise apparatus 210 of FIG. 13, in accordance with the seventh exemplary embodiment of the present disclosure. Relative to FIGS. 13-14, the apparatus 210 includes a destabilization device 260 which is positioned substantially underneath the arm support pad 240 (or each arm support pad present). The destabilization device 260 may function in the same manner as described in FIGS. 3-5, with the added function that the destabilization device 260 shown in FIGS. 13-14 may be movable between an extended position, shown in FIG. 14, where the ground-interface surface 250 positioned on the curved surface of the destabilization device 260 is contactable to a ground surface and a retracted position, shown in FIG. 13, where the ground-interface surface 250 positioned on the curved surface of the destabilization device 260 is removed from a contactable position with the ground surface. To achieve the movement between the extended and retracted positions, the destabilization device 260 may pivot about an axis, thereby allowing a specific surface or the destabilization device 260 to be oriented toward a ground surface. In FIG. 13, a flat edge of the destabilization device 260 may be oriented downward (toward the ground surface) and in FIG. 14, the curved surface may be oriented downward. When a user desires to use the apparatus 210 without destabilization, the user may select the configuration shown in FIG. 13. When the user desires an enhanced exercise by destabilizing the apparatus 210 with the curved surface of the destabilization device 260, the user would position the destabilization device 260 as shown in FIG. 14. It is noted that the foot pads 228 positioned along a front of the frame member 230 may act as ground-support devices at any point of use of the apparatus 210.

Relative to FIGS. 13-14 further, it is noted that the arm support pads 240 are also able to rotate, in the same manner as described relative to FIGS. 10-11, to provide arm trajectory user-adjustment of the apparatus 210 or to convert the apparatus 210 from a front plank orientation to a side plank orientation.

Relative to FIGS. 13-14, the apparatus 210 includes a hand grip 220 that is adjustable along the length of the frame member 230, whereby a distance between the hand grip 220 and the arm support pad 240 can be adjusted. The hand grip 220 may include a carriage 222 which is positioned about the frame member 230, or a portion thereof, and can be moved along the length of the frame member 230. The apparatus 210 may also include other devices for permitting movement of the hand grip 220 along the frame member 230. The carriage 222 may include a raised support 224 which receives an end of the hand grip 220 therein, such that the hand grip 220 can be rotated relative to the raised support 224. Accordingly, the hand grip 220 may be rotated between a lowered position, as shown in FIG. 13, and a raised position, as shown in FIG. 14. In the lowered position, the hand grip 220 may be stowed for convenient storage of the apparatus 210, whereas the raised position of the hand grip 220 may be a position where a user is actively using the apparatus 210. In some variations, rotating the hand grip 220 may provide benefits in the ergonomic use of the apparatus 210, not just to make the apparatus 210 more convenient for storage. For example, a user may rotate the hand grip 220 into a more comfortable angle.

It is also noted that the movable hand grip 220 may include two separate halves which operate independently of one another or which can be operated together. Other variations of movable hand grips 220 may include hand grips 220 with male extenders that allow the hand grips 220 to connect or pop in to the frame member 230 along a length of the frame member 230, to allow adjustment of the positioning of the hand grips 220.

Figure 15:
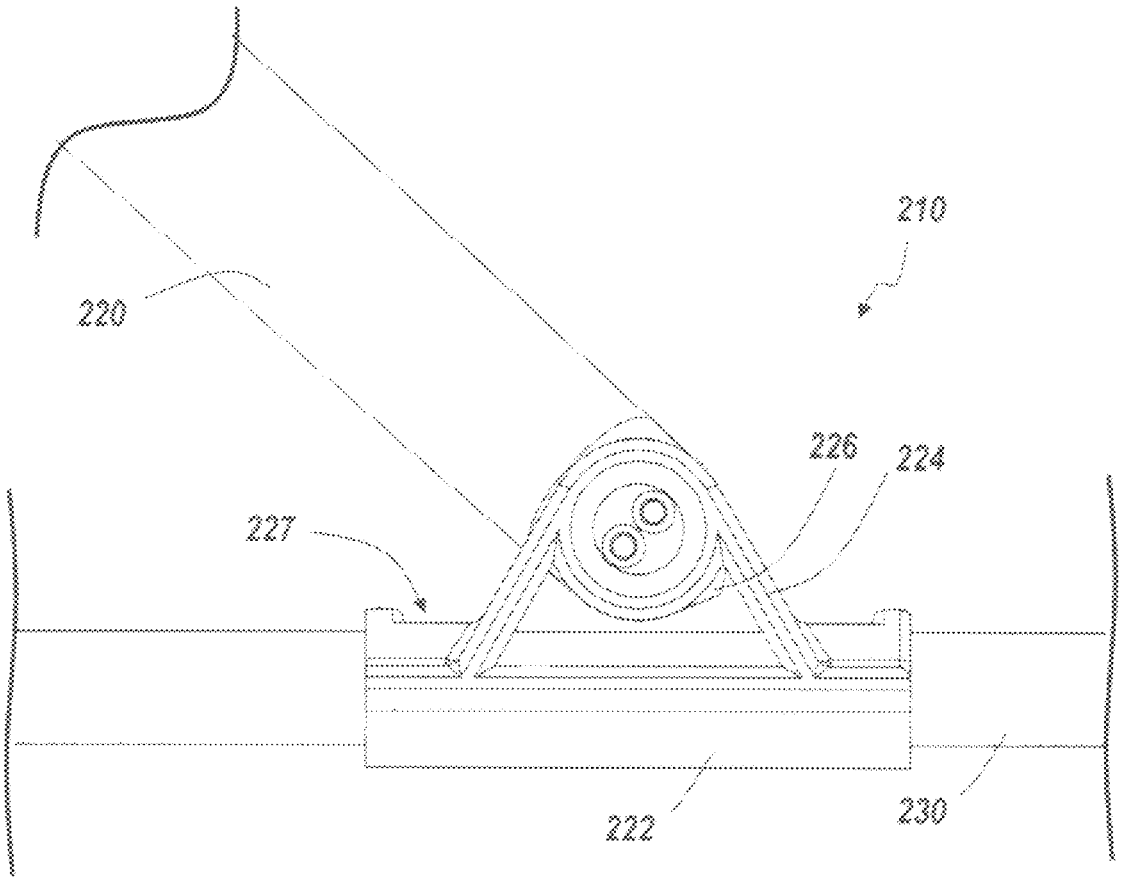
FIGS. 15-16 are side-view illustrations of the carriage and raised support of the exercise apparatus of FIGS. 13-14, in accordance with the seventh exemplary embodiment of the present disclosure.
Figure 16:
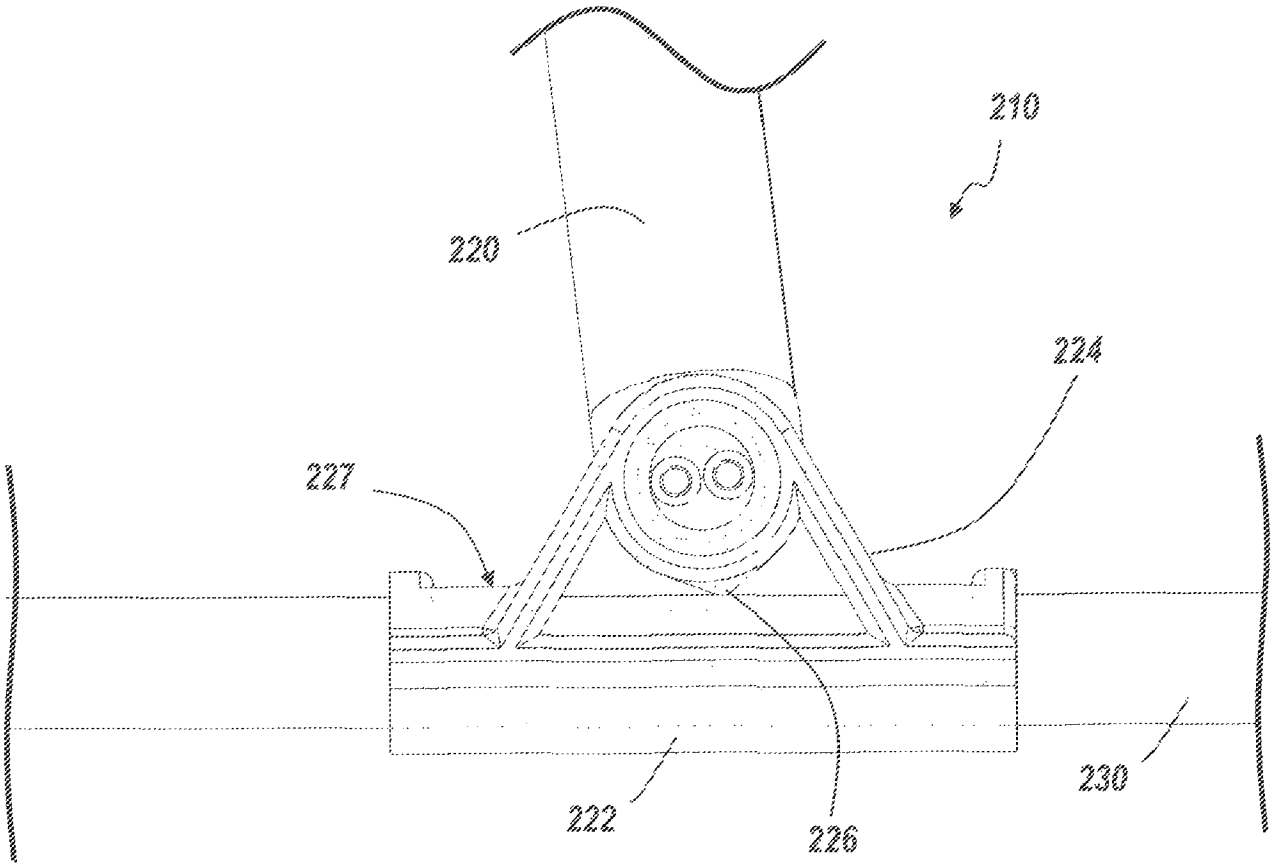
Figure 17:
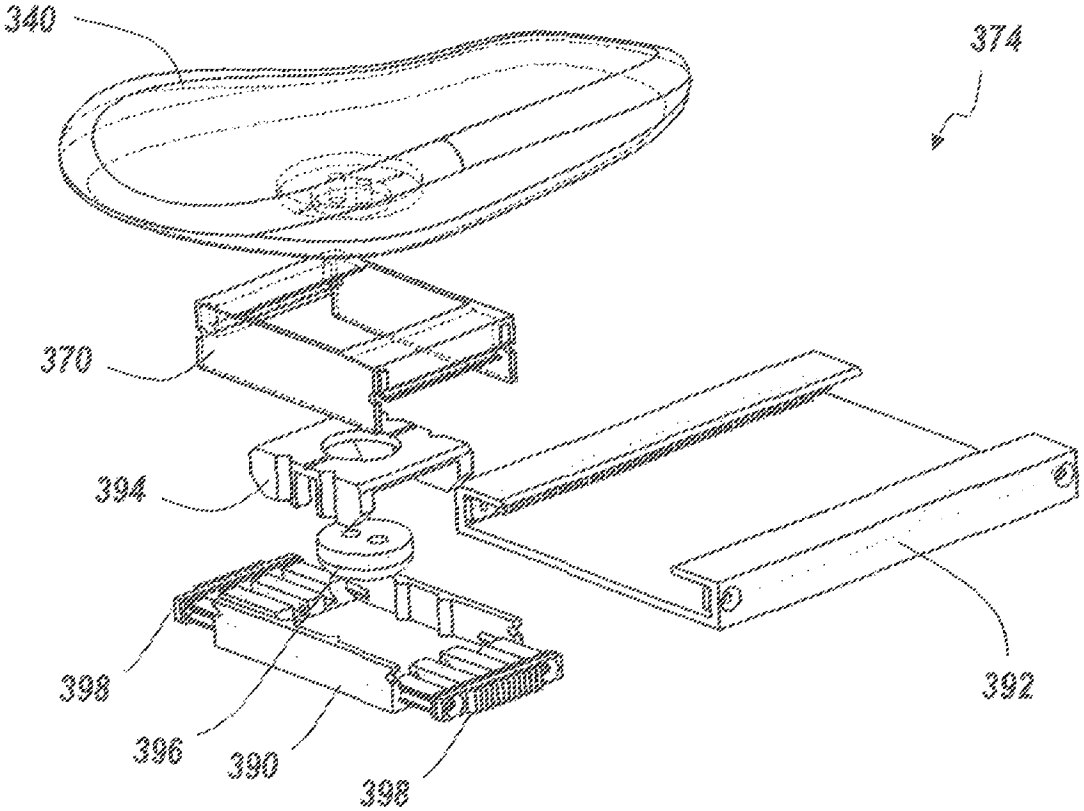
FIG. 17 is an exploded view illustration of a lateral movement device for use with an exercise apparatus, in accordance with the seventh exemplary embodiment of the present disclosure.

FIGS. 15-16 are side-view illustrations of the carriage 222 and raised support 224 of the exercise apparatus 210 of FIGS. 13-14, in accordance with the seventh exemplary embodiment of the present disclosure. Relative to FIGS. 13-16, rotation of the hand grip 220 may be controlled, at least in part, with a frictional cam 226 which is connected to the hand grip 220 at a lower part thereof and is positioned to contact the frame member 230. The frictional cam 226 may include a rubberized structure which is rotatable opposite the hand grip 220. As is shown in FIGS. 15-16, the frictional cam 226 may be positioned proximate to the rotatable joint on which the hand grip 220 can rotate, such that when the hand grip 220 is in a fully or partially lowered position (FIGS. 13 and 15), the frictional cam 226 is free from contact. When the hand grip 220 is moved to the raised position (FIGS. 14 and 16), the frictional cam 226 may contact the frame member 230 through an aperture 227 within the carriage 222. The contact between the frictional cam 226 and the frame member 230 through the aperture 227 may be sufficient to retain the hand grip 220 in the raised position. Further, this contact may also be sufficient to limit the movement of the carriage 222 along the frame member 230.

Figure 18:
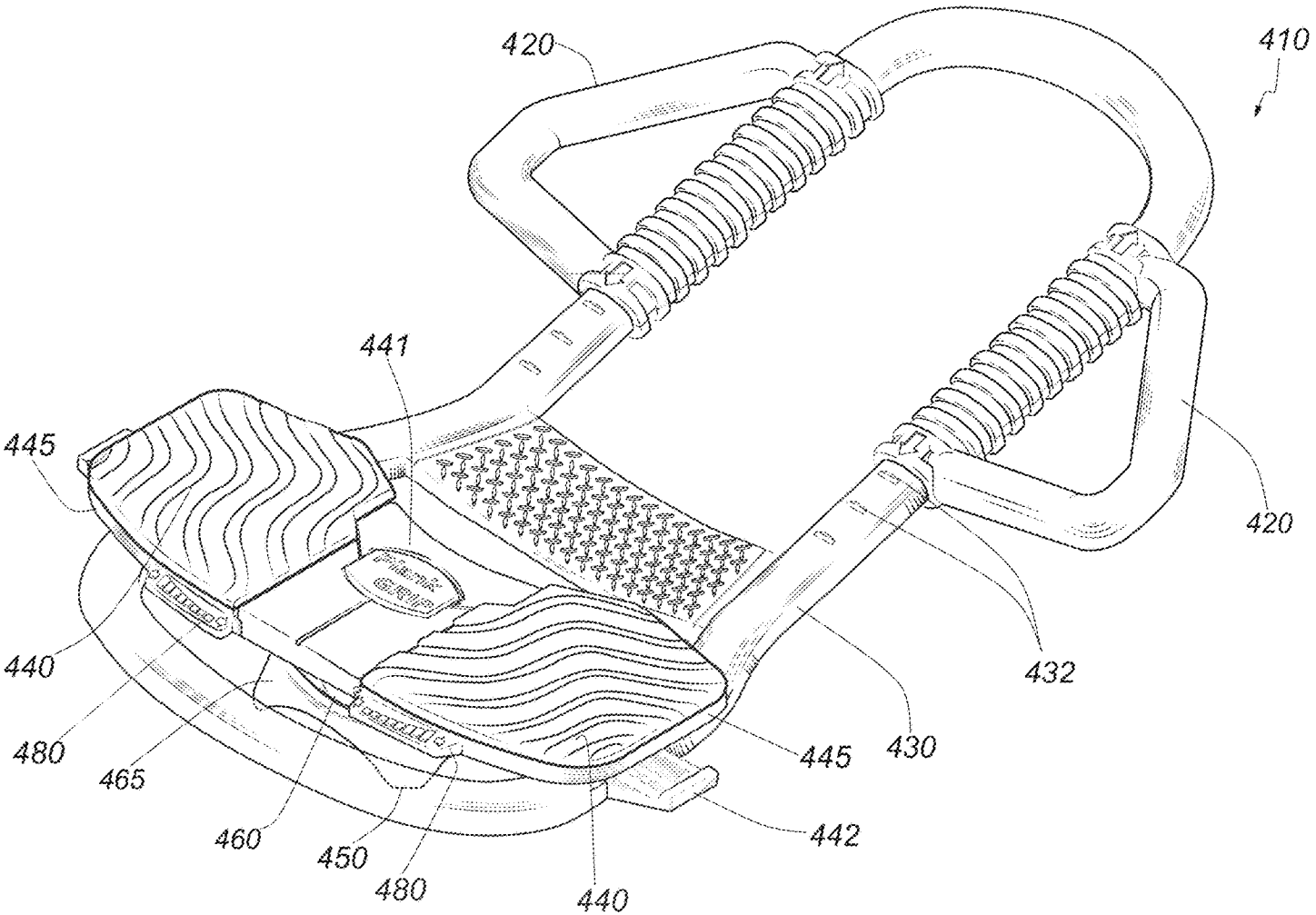
FIG. 18 is an isometric view illustration of an exercise apparatus, in accordance with an eighth exemplary embodiment of the present disclosure.

FIG. 18 is an isometric view illustration of an exercise apparatus 410, in accordance with an eighth exemplary embodiment of the present disclosure. The exercise apparatus 410, which may be referred to herein as 'apparatus 410' may be substantially similar to other apparatuses described within this disclosure and may include any of the features, components, or functions discussed relative to any other figure herein. The apparatus 410 of FIG. 18 includes: a frame member 430; at least one arm support pad 440 is connected to the frame member 430; a hand grip 420; and a ground-interface surface 450 is positioned along at least a portion of the frame member 430.

The apparatus 410 of FIG. 18 includes a hand grip 420 configuration formed by two distinct pyramidal members positioned on portions of the frame member 430. The hand grips 420, with their pyramidal form, include annularly ribbed, tubular sections that are sleeved over the inclined sides of the frame member 430, providing a tactile interface for gripping. The ribbed texture enhances the inherently grippable sides of the frame member 430, whose inverted U-shape is characterized by its grippability, even without the pyramidal members. Additionally, the sloped outer segments and base of the pyramidal hand grips 420 offer alternative gripping surfaces, further improving the user's handling of the apparatus 410.

Also relative to FIG. 18, the hand grips 420 may be movable by repositioning them along the frame member 430, which may include cavities 432 at a plurality of pre-selected postions, spaced at intervals, on a surface thereof that securely engage each hand grip 420. This engagement may be overcome when a sufficient force is applied to the hand grip 420, such that a locking structure of the hand grip 420 is disengaged from the cavity on the frame member 430. In one of many possible variations, as previously noted, the movable hand grips 420 may include male ridges or extenders that can be connected to, or popped into, the frame member 430 along its length to provide adjustment of the hand grips 420. When separate hand grips 420 are used, as shown in FIG. 18, the hand grips 420 themselves may be adjusted laterally on tracks or with holes.

Figure 19:
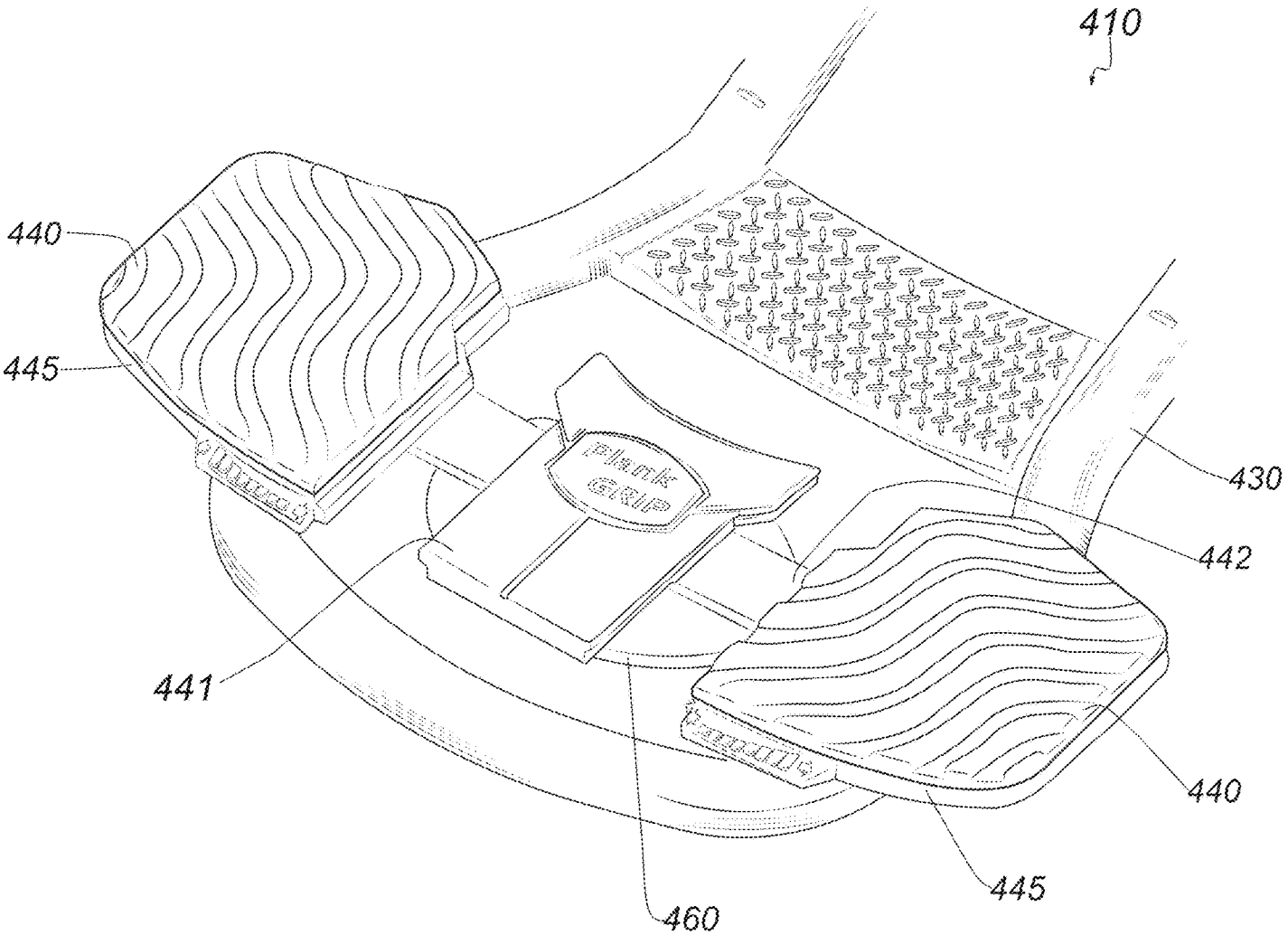
FIG. 19 is a detailed isometric view illustration of an exercise apparatus of FIG. 18, in accordance with the eighth exemplary embodiment of the present disclosure.

FIG. 19 is a detailed isometric view illustration of an exercise apparatus 410 of FIG. 18, in accordance with the eighth exemplary embodiment of the present disclosure. Relative to FIGS. 18-19, the apparatus 410 may have arm support pads 440 with underlying support member 445 positioned on a unitary support bar 442, including engagement features (470*a*, 470*b*, FIG. 20).

In one embodiment, the longitudinally slotted unitary support bar 442 allows the arm support pads 440 to translate along its length. A center arm support pad 441 occupies a generally central position relative to the sides of the frame member 430. The center arm support pad 441 may be used alone or in combination with the left and right arm support pads 440 by moving the left and right arm support pads 440 toward the center, and in some arrangements the same arm support pads 440 may also be used to support the user's hands during a push-up plank or standard pushups. Accordingly, the arm support pads 440 may be moved between an extended and retracted position on the unitary support bar 442. FIG. 18 further illustrates an adjustment gauge 480 that may accompany the arm support pads 440, providing progressively larger or smaller geometric shapes with directional markers.

Figure 20:
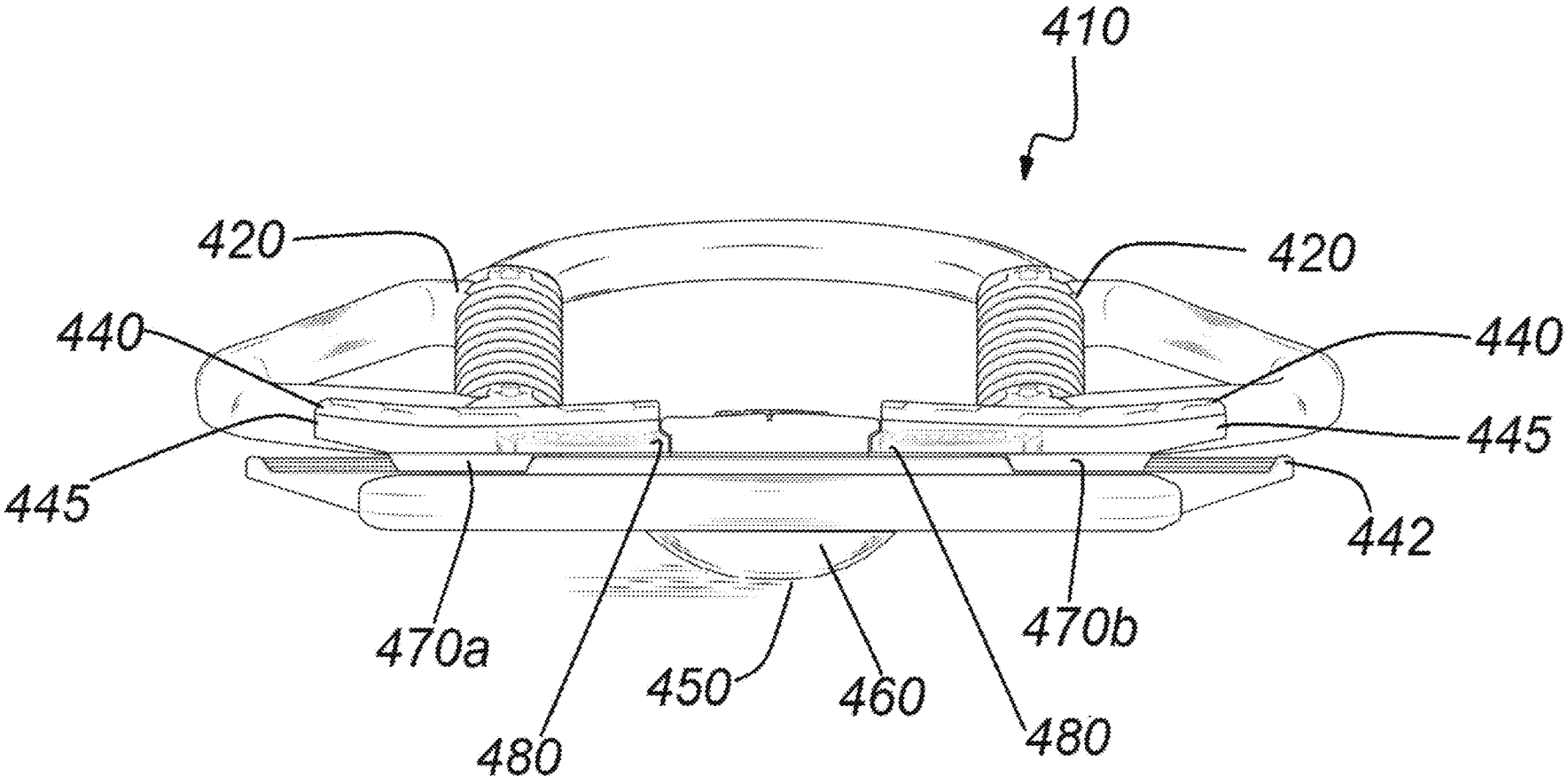
FIG. 20 is an illustration of an exercise apparatus of FIG. 18, in accordance with the eighth exemplary embodiment of the present disclosure.
Figure 20A:
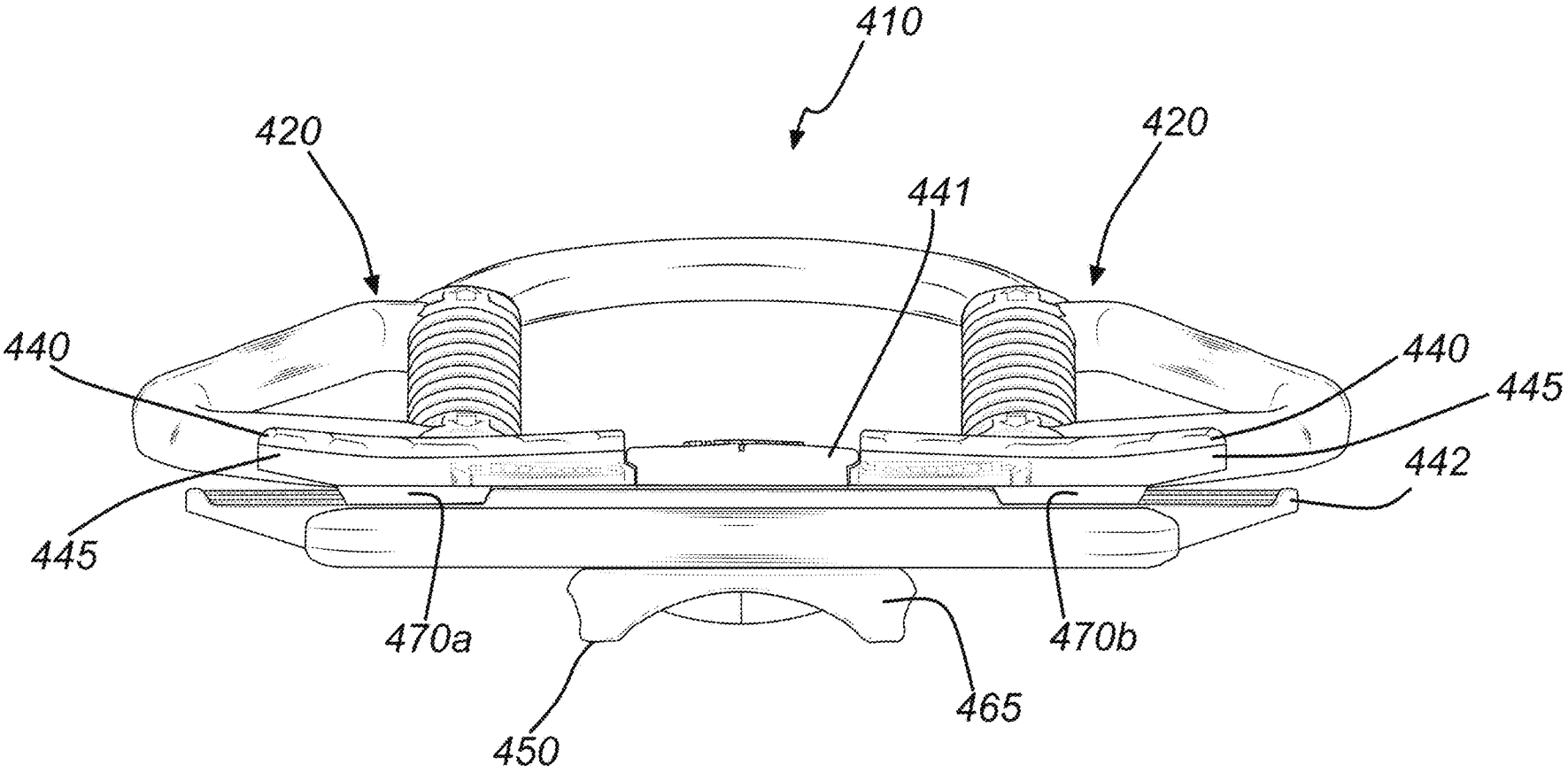
FIG. 20A is another illustration, in rear-view, of the exercise apparatus, in accordance with the eighth exemplary embodiment of the present disclosure.
Figure 20B:
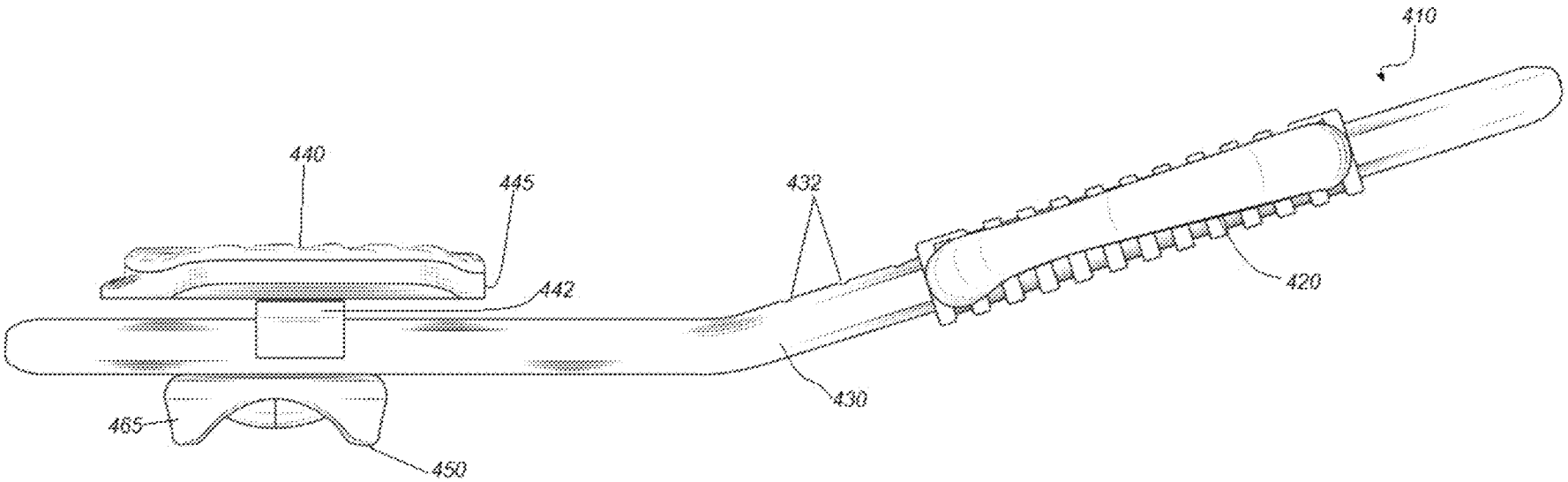
FIG. 20B is a side view of an exercise apparatus of FIG. 18, in accordance with the eighth exemplary embodiment of the present disclosure.
Figure 20C:
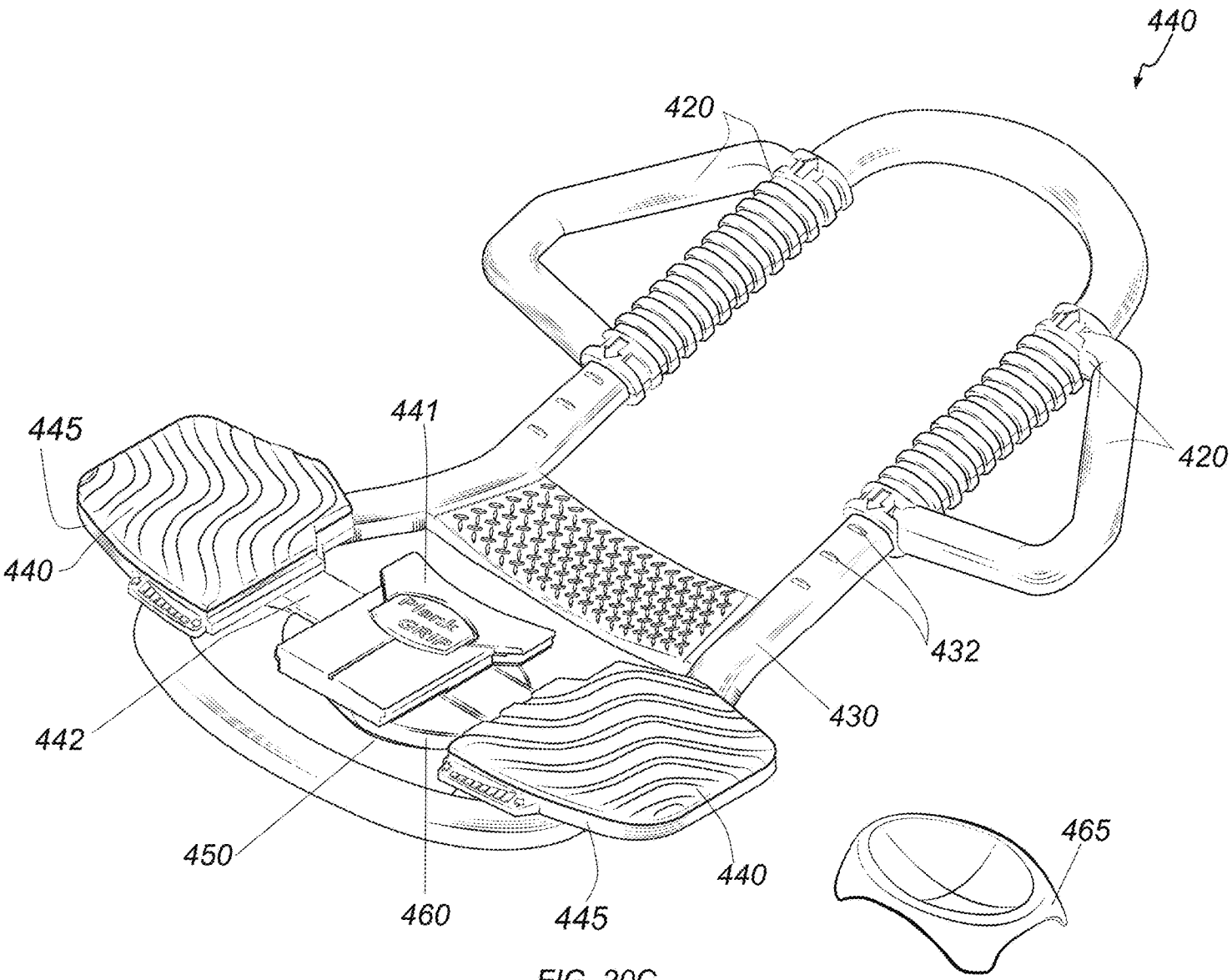
FIG. 20C is another isometric view of an exercise apparatus of FIG. 18, in accordance with the eighth exemplary embodiment of the present disclosure.
Figure 20D:
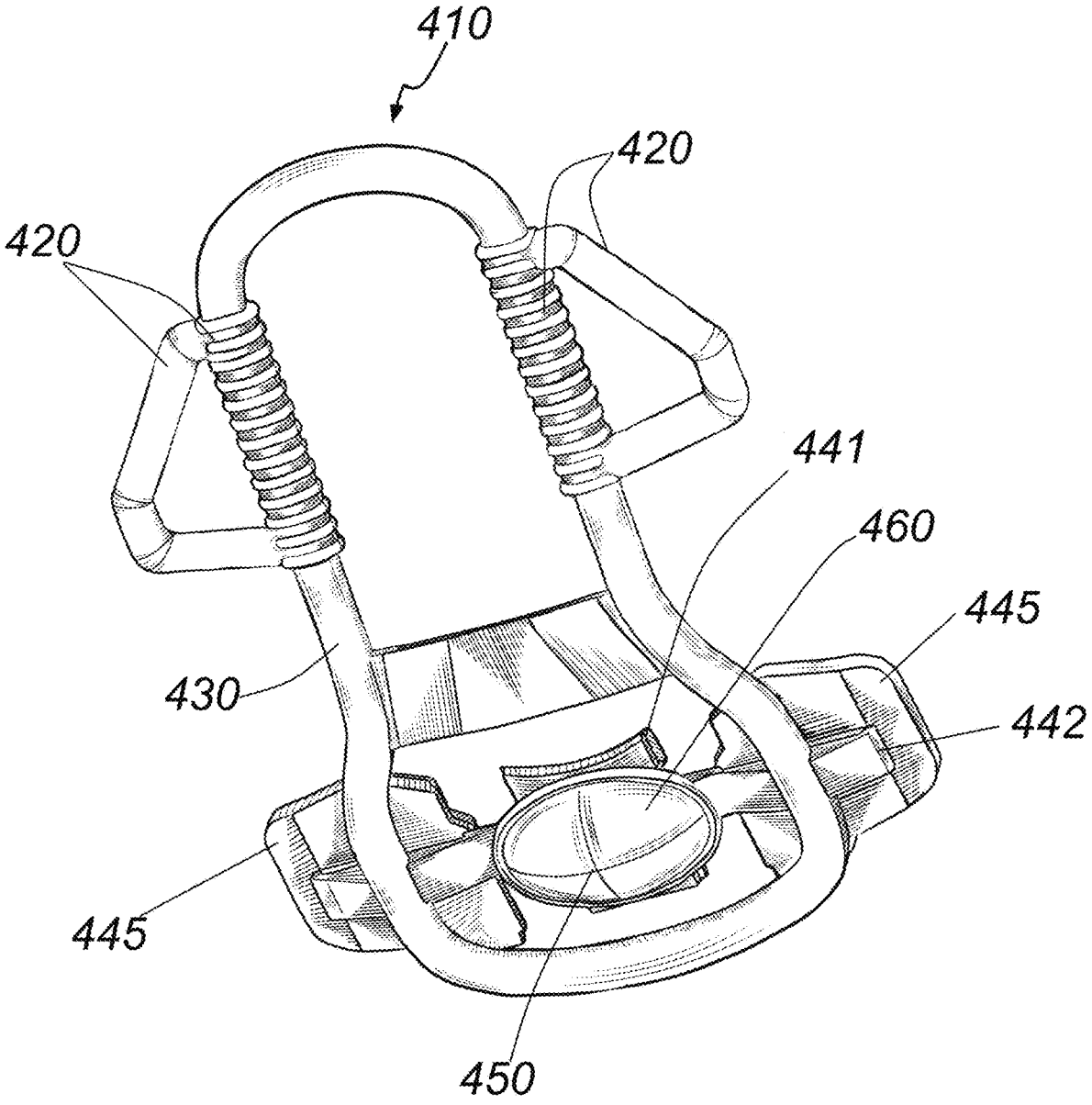
FIG. 20D is an isometric view of the underside the exercise apparatus of FIG. 18, in accordance with the eighth exemplary embodiment of the present disclosure.
Figure 20E:
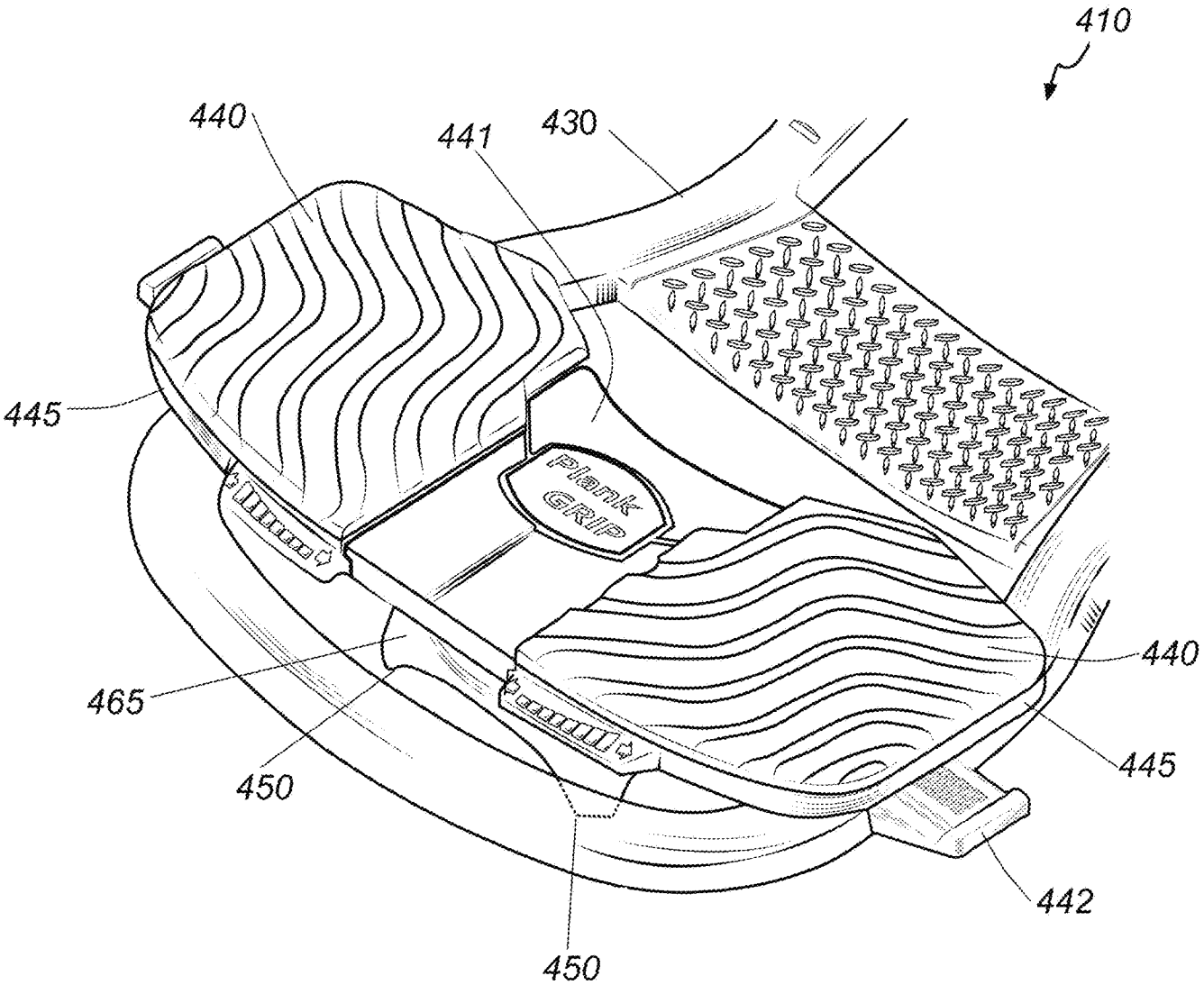
FIG. 20E is an isometric view of the rear section of the exercise apparatus of FIG. 18, in accordance with the eighth exemplary embodiment of the present disclosure.
Figure 20F:
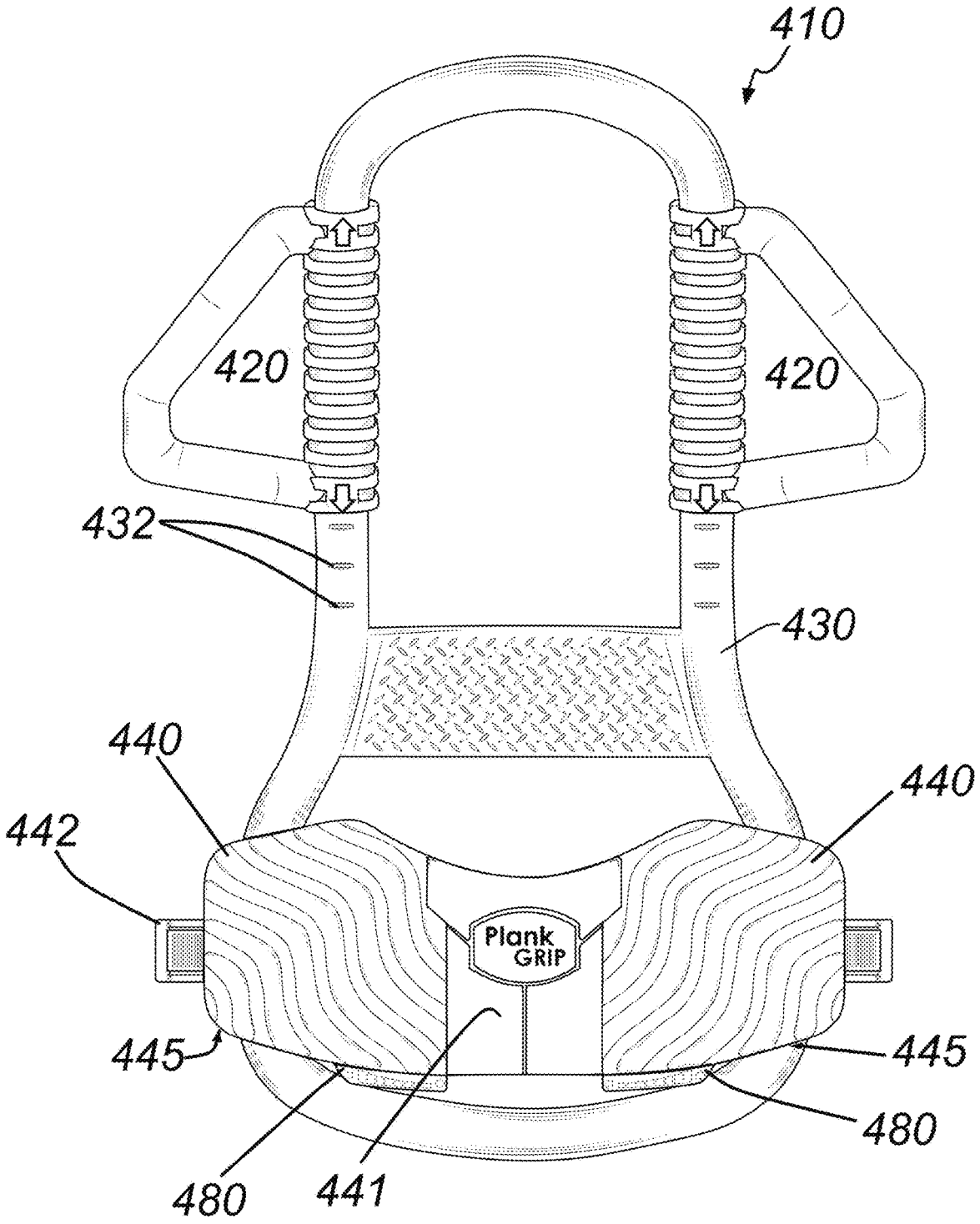
FIG. 20F is a top-down view of the exercise apparatus of FIG. 18, in accordance with the eighth exemplary embodiment of the present disclosure.
Figure 20G:
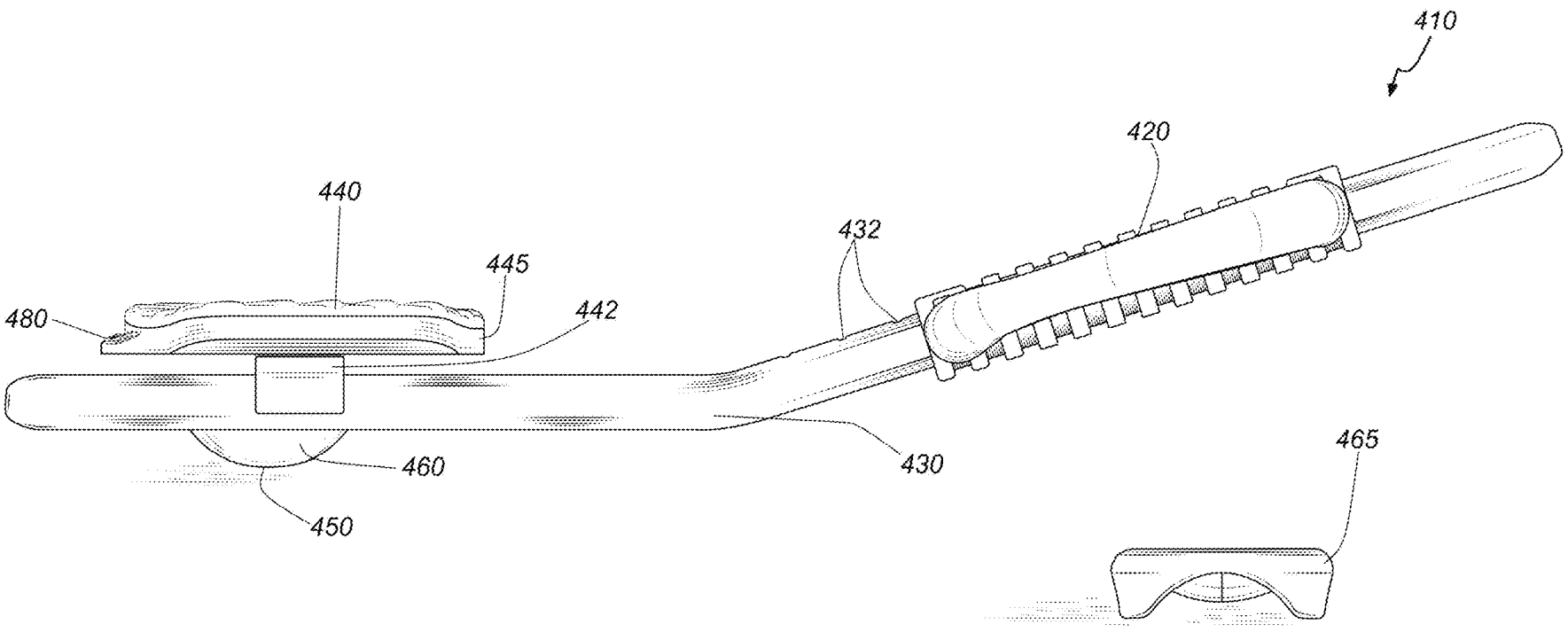
FIG. 20G is another side perspective of the exercise apparatus of FIG. 18, in accordance with the eighth exemplary embodiment of the present disclosure.

FIG. 20 is a rear-view illustration of an exercise apparatus 410 of FIG. 18, in accordance with the eighth exemplary embodiment of the present disclosure. The apparatus 410 as shown in FIG. 20 illustrates a destabilization device 460 which is positioned under a substantially center point of the apparatus 410. The destabilization device 460 may include a semispherical structure which has a lowered edge that is positioned to contact a ground surface. In one example, the destabilization device 460 may include a semispherical structure formed from plastic, rubber, or similar material, which can support the weight of the apparatus 410 with a user on it. The destabilization device 460 may function as previously described, with the exception that it may allow movement of the apparatus 410 in more than one rotational degree of freedom. Using a semispherical surface as a destabilization device 460, as opposed to a curved surface along two dimensions, may allow three rotational degrees of freedom which provide enhanced destabilization movement. Also shown in FIG. 20 shows the destabilization device 460 without a stand 465 (that may be integrated into or a separate attachment to the apparatus 410) that may rest on the ground surface, preventing wobbling or shifting. FIG. 20A shows the stand 465 as it may appear connected to the apparatus 410 in FIG. 18, while FIG. 20C illustrates a version of the stand 465 detached. The features described above with reference to the eighth exemplary embodiment are further illustrated in greater detail in FIGS. 20B, 20C, 20D, 20E, 20F, and 20G.

The apparatus 410 of FIG. 20.1 includes hand grips 420, preferably made of plastic, rubber or similar material but also composed of metal or other similar materials, each of which hand grip 420 is carried on a portion of the frame member 430. The hand grips 420 are preferably adjustable, such that they are, for example, rotatable about their respective attachment sites to the frame 430, although, in some embodiments, they may be non-movably attached to the frame member 430. In addition, the distance between the hand grips 420 and the at least one arm support pad 440 can be modified depending on a user's body size. The hand grips 420 may be movable by repositioning each of the hand grips 420 until the extended connector 456 on which they are mounted is locked within one of a plurality of preselected positions located at spaced intervals on the frame member 430. The extended connector 456 may include features to retain it within the hole 436 with the actuatable engagement device 472, such as a biased, pop-up or snap connector. Specifically, in FIG. 20.1, the actuatable engagement device 472 is a pop-up connector. Another type of extended connector 456 may utilize a tab and slot system, where when the extended connector 456 is moved into the hole, a tab on the interior sidewall of the hole 436 is received within a shortened slot in the extended connector 456. In the alternative, the extended connector 456 may be adjusted with a twist-collar mechanism (not shown) where the extended connector 456 meets the first and second legs 433, 434 by supplying friction annularly around the connection point between them. There are many possible adjustment mechanisms suitable for providing the adjustments disclosed herein. Once the extended connector 456 achieves a fully-inserted position, the tab may be positioned beyond the slot in the extended connector. It is contemplated that many types of cavities, male and female mating structures, ridges, and the like, will provide suitable adjustment for the hand grips 420. As with many of the various possible components of the frame member 430, including the first and second legs 433, 434, support bar 442, extended connector 444, lateral support bar 446, and lateral extended connector 447, such components may have a substantially cylindrical shape, a partially cylindrical shape, or a non-cylindrical shape such as a square shape, e.g., when square tubing members are used to form a component. Any cross-sectional shape may be utilized, and another component associated therewith to coordinate adjustment may have a corresponding shape.

Relative to FIG. 20.1, the apparatus 410 may have arm support pads 440 mounted on the support bar 442, preferably at opposite ends of the support bar 442, such that the arm support pads 440 are constantly positioned on the peripheral corners of the apparatus 410 during use. The support bar 442 may be positioned in a lateral direction, relative to a general length of the apparatus 410, and allows the arm support pads 440 to be adjusted by extending the lateral extended connector 444 on which they are mounted until it is locked at one of a plurality of preselected positions located at spaced intervals on the support bar 442. The lateral extended connector 444 may include features to retain it within the hole 436 with the actuatable engagement device 472, such as a biased, pop-up or snap connector. Specifically, in FIG. 20.1, the actuatable engagement device 472 associated with the lateral extended connector 444 is a pop-up connector. Accordingly, the arm support pads 440 may be positioned between an extended position, a retracted position and various positions in between. Likewise, the arm support pads 440 may also have a rotatable connection the frame member 130.

The apparatus 410 as shown in FIG. 20.1 may include a destabilization device 460, as shown in FIG. 20.1 and described in further detail herein relative to FIGS. 18-20 and elsewhere herein. The destabilization device of FIG. 20.2 is positioned under at least a portion of the frame member 430, such as along support bar 442 or lateral support bar 446. The destabilizing device 460 may be permanently affixed to apparatus 410 or, in the preferred embodiment, removably attachable. To facilitate a removable attachment, for example, as shown in FIG. 19.2, a threaded rod 467 may be used, though any number of attachment means are acceptable as long as they facilitate a removable attachment. The destabilization device 460 may include a semispherical structure 462 which has a lowered edge that is positioned to contact a ground surface. In one example, the semispherical structure 462 may be formed from plastic, rubber, or similar material, which can support the weight of the apparatus 410 with a user on it. Using a semispherical surface as a destabilization device 460 may allow three rotational degrees of freedom which provide enhanced destabilization movement, but many different shapes for the destabilization device 460 are contemplated, such as a spherical structural, as long as it accomplishes a destabilization effect. In addition, a ball-and-joint mechanism would also provide satisfactory destabilization. The destabilization device 460 of FIG. 20.2 may be attached to the apparatus 410 along support bar 442 or lateral support bar 446, which may have an adjustable length.

As shown in FIG. 20.1, lateral support bar 446 is fixedly connected to the frame member and is adjustable with utilization of lateral extended connector 447. However, in some embodiments, the lateral support bar 446 may be omitted, detachable, or of a fixed length. For example, FIG. 20.3 shows an embodiment of apparatus 410 without the lateral support bar 446. The lateral support bar 446 may also be positioned anywhere along the frame member 430. As with all adjustments described herein, the preferred mode of adjustments of apparatus 410, allows the user to carry out adjustments with an unaided hand and without tools.

In the preferred embodiment, a pad support member 490 is provided for the arm support pads 440. The pad support structure 490 may be composed of plastic, metal, wood or similar material. Portions of pad support structure 490 may extend laterally at least as far as the exterior lateral edges the arm support pads 440. This arrangement allows the apparatus 410 to have appropriate stability for various planking exercises, particularly side planks and push-up planks. In addition, areas of the pad support structure may be left open in order to allow users to enclose an edge of the arm support pads 440 with their fingers while using them as push-up blocks or for push-up planks.

FIG. 20.4 shows an isometric side view of the apparatus 410 of FIG. 20.1, in accordance with the ninth exemplary embodiment of the present disclosure. The description of features described relative to FIG. 20.1 above are equally applicable to those features with same numbers shown in FIG. 20.4.

In addition, as shown in FIG. 20.5, the first and second legs 433, 434 of the apparatus 410 may have a rotatable connection 427 to the frame member 430, allowing further adjustments. Of course, many adjustment mechanisms described in the present disclosure be combined or omitted from the apparatus 410 in order to provide a satisfactory user experience.

Figure 21:
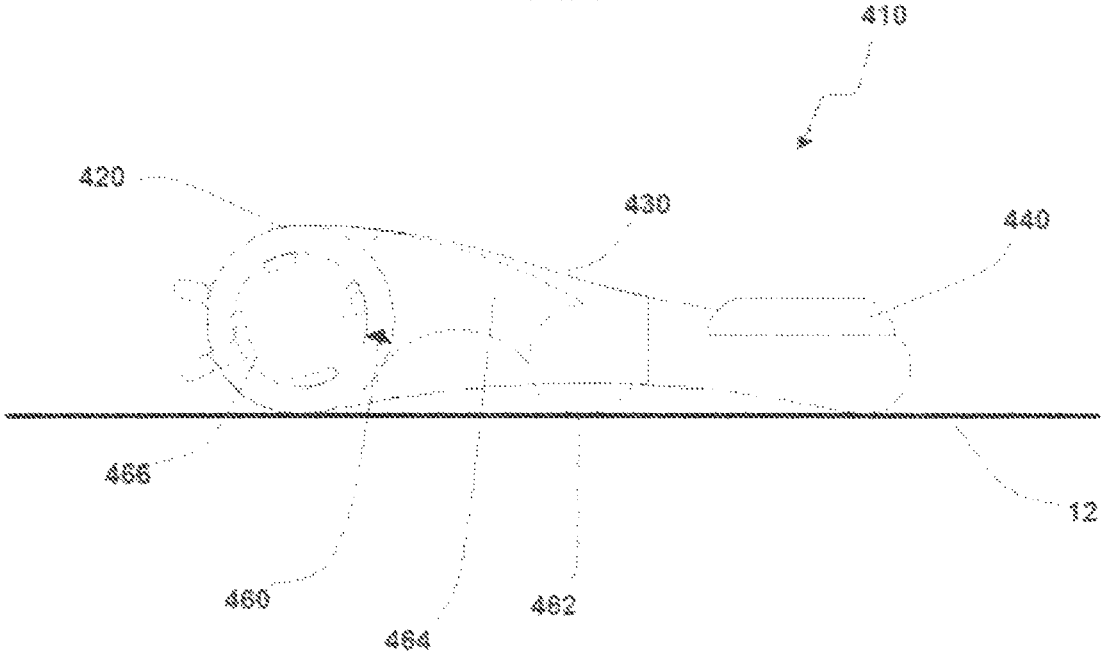
FIGS. 21-22 are side-view illustrations of an exercise apparatus, in accordance with a tenth exemplary embodiment of the present disclosure.
Figure 22:
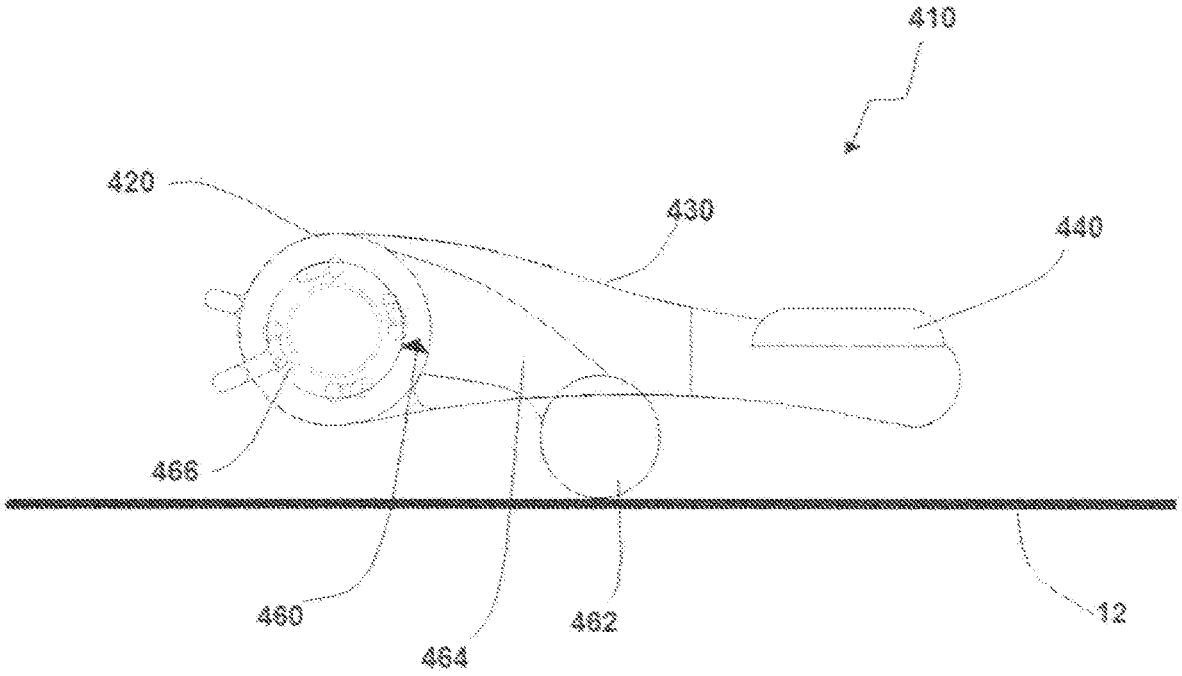

FIGS. 21-22 are side-view illustrations of an exercise apparatus, in accordance with the tenth exemplary embodiment of the present disclosure. Similar to the destabilization device 460 of FIG. 20, FIGS. 21-22 illustrate a variation of a destabilization device 460 which can provide three rotational degrees of freedom. As is shown in FIGS. 21-22, the destabilization device 460 may include a semispherical structure 462 which is carried on an arm 464 that is movable between retracted and extended positions. A joint 466 may be used to move the arm 464, thereby moving the semispherical structure 462 between the retract position, shown in FIG. 21, to an extended position, shown in FIG. 22. The joint 466 may use levers to unlock a center section of the joint 466 to allow movement of the arm 464 or to lock the joint 466 to prevent arm 464 movement, such as by using a locking ball. In use, extending the arm 464 may increase the destabilization effect on the apparatus 410 whereas lowering or retracting the arm 464 may lessen the destabilization effect. Accordingly, a user can adjust the destabilization device 460 to achieve the desired destabilization effect.

Figure 23:
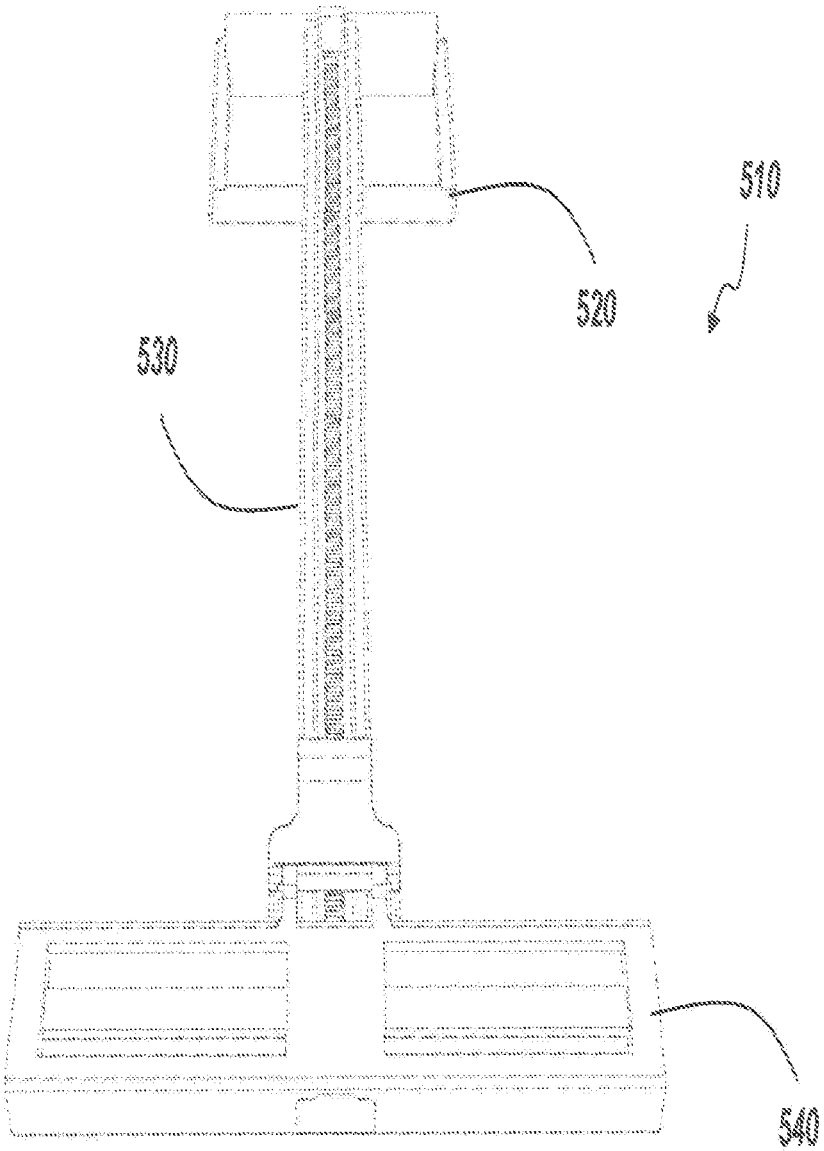
FIGS. 23-24.1 are isometric view illustrations of an exercise apparatus, in accordance with an eleventh exemplary embodiment of the present disclosure.
Figure 24:
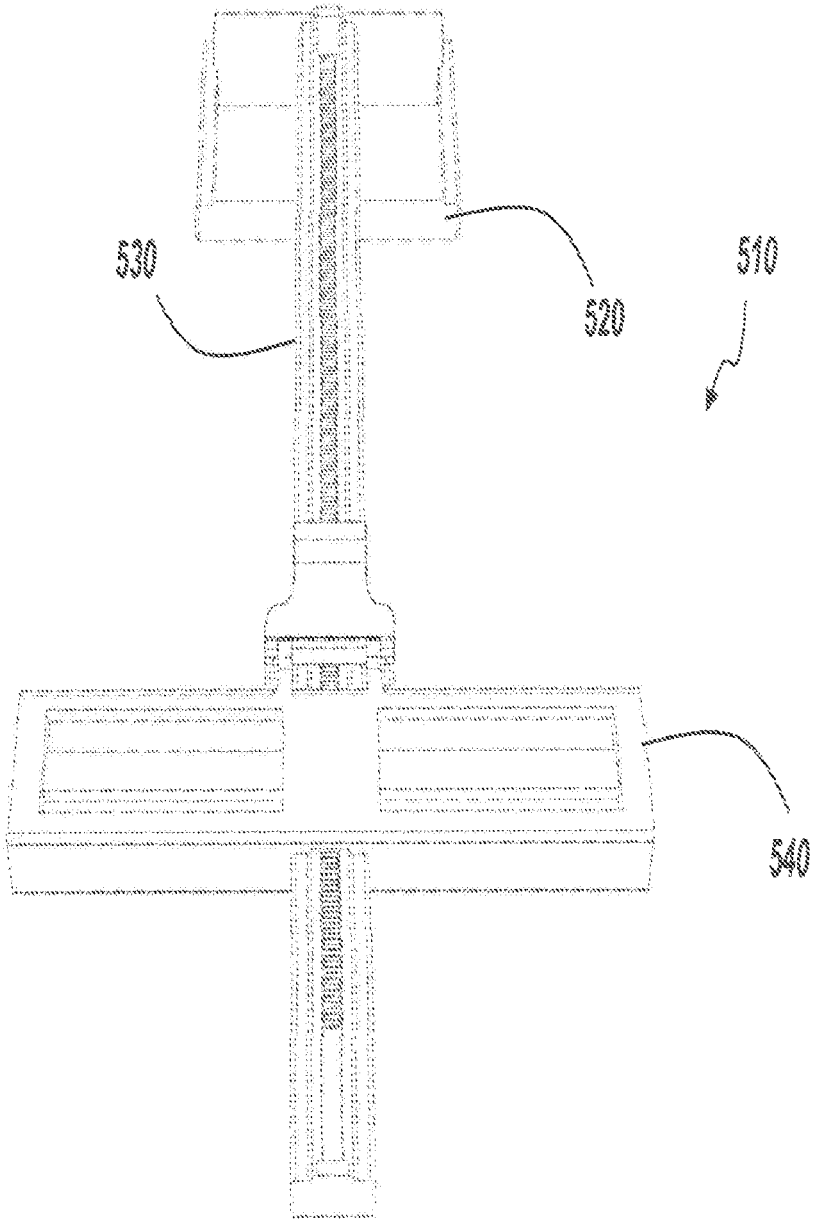

FIGS. 23-24.1 are isometric view illustrations of an exercise apparatus 510, in accordance with the eleventh exemplary embodiment of the present disclosure. The exercise apparatus 510, which may be referred to herein as 'apparatus 510' may be substantially similar to the other apparatuses described within this disclosure and may include any of the features, components, or functions discussed relative to any other figure herein. As is shown in FIGS. 23-24, the apparatus 510 includes a central frame member 530 which is connected between a hand grip portion 520 and an arm support pad portion 540. (It is noted that the soft, resiliently deformable foam arm support pads that would engage with the arm support pad portion are omitted from FIGS. 23-24, and the foam grip coverings that would cover the hand grip portion 520 are omitted from FIGS. 23-24.1.) The hand grip portion 520 is configured to rotate upward for user-contact and, as shown in FIGS. 23-24, downward for storage or grip variations. In FIG. 24.1, the hand grip portion 520 is shown in a user-ready position, being upturned vertically in a sufficient position to be grasped by the user, and in some embodiments may be fixed such upturned position. FIG. 24.1 further shows foam pads 542 engaged with slots 545 in the arm support pad portion 540, the entire lower surface of which, together with the lower surface of the apparatus, is resting in flat contact with flat ground surface. (Although the foam pads 542 shown in FIG. 24.1 are squarish in shape, the preferred shape is a curvilinear to match ergonomically the shape of a person's forearm.) In the preferred embodiment, the foam pads 542 have protrusions from a lower surface thereof allowing the foam pads 542 to engage with the slots 545. The central frame member 530 may permit adjustability of the arm support pad portion 540 along the length of the central frame member 530. The central frame member 530 may use, for example, a track system or telescoping mechanisms which allow the arm support pad portion 540 to be moved to selected locations along its length. FIG. 23 depicts the arm support pad portion 540 positioned at a distal end of the central frame member 530, whereas FIG. 24 depicts the arm support pad portion 540 positioned toward a middle section of the central frame member 530. The arm support pad portion 540 itself may also include a track or telescopic mechanism to allow lateral movement of arm support pads.

Figure 25:
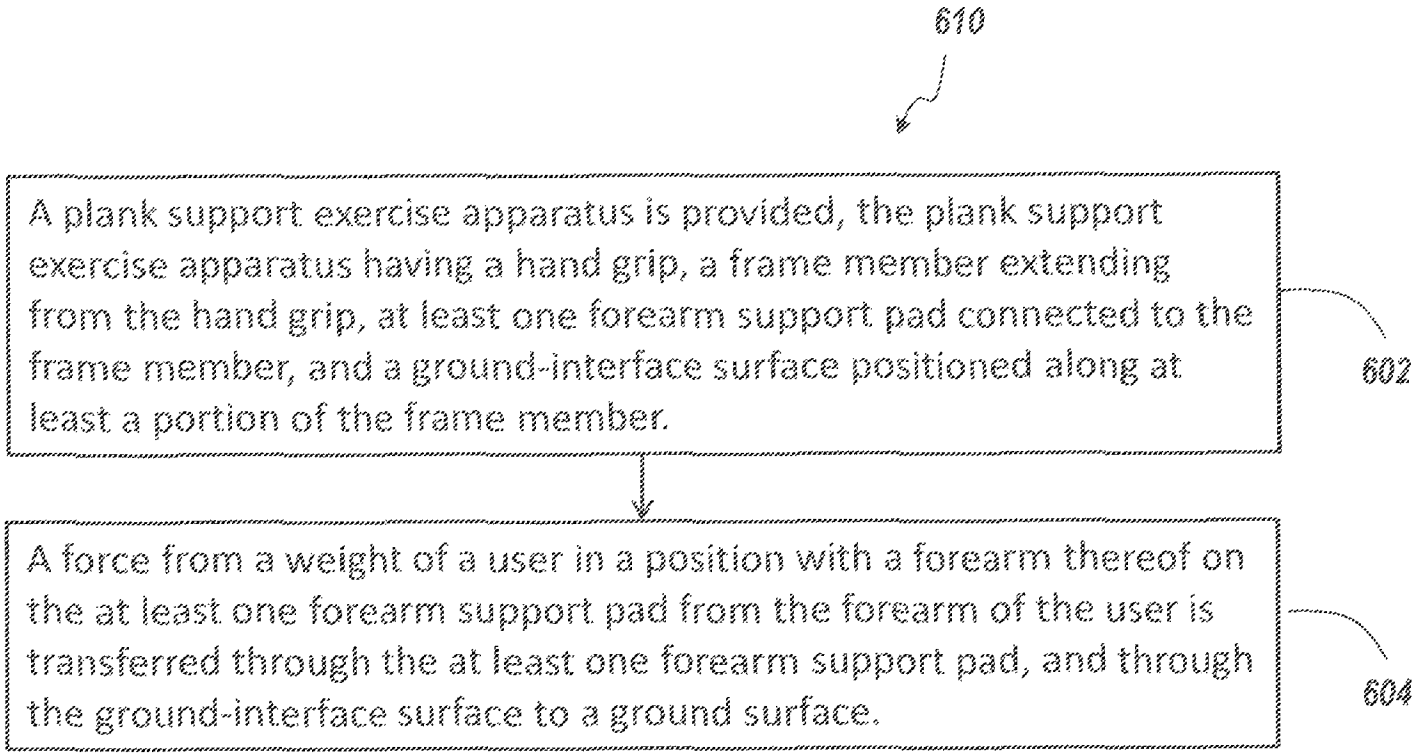
FIG. 25 is a flowchart illustrating a method of using an exercise apparatus, in accordance with a twelfth exemplary embodiment of the disclosure.

FIG. 25 is a flowchart 600 illustrating a method of using an exercise apparatus, in accordance with the twelfth exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the As is shown by block 602, an exercise apparatus is provided, the exercise apparatus having a hand grip, a frame member associated with the hand grip, at least one forearm support pad connected to the frame member, and a ground-interface surface positioned along at least a portion of the frame member. A force from a weight of a user in a position with a forearm thereof on the at least one forearm support pad from the forearm of the user is transferred through the at least one forearm support pad, and through the ground-interface surface to a ground surface (block 604).

The method may include any additional number of steps, processes, and functions, including any disclosed within this disclosure. For example, the method may include moving the at least one forearm support pad along a length of the frame member, and/or moving a hand grip along a length of the frame member. The method may further include destabilizing the exercise apparatus with a destabilizing device, thereby facilitating a destabilizing movement of the exercise apparatus. The controlled, destabilizing movement may further comprise rotational freedom.

It should be emphasized that the above-described embodiments of the present disclosure, particularly, any preferred embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed:

1. An exercise apparatus for enhancing a user's abdominal strengthening, facilitating the user's torso extension in a downward-facing position, the apparatus comprising:

a frame having a centerline defined as an imaginary vertical plane equidistant between its outer left and right sides, and a midway axis defined by an imaginary axis equidistant between its forwardmost and rearmost extents, the frame comprising a handle or grip structure and at least one rigid mounting surface, the rigid mounting surface extending to at least one perimeter side of an arm support pad disposed on it, wherein the arm support pad comprises at least one layer of padding for cushioning an upper limb of the user and is mounted to the frame at one or more points, including at least one point rearward and spaced away from the midway axis;

wherein the handle or grip structure includes at least two upwardly extending elongated grip portions arranged respectively on opposite sides of the centerline, each configured to extend in paths that are parallel or converging relative to each other and the centerline for most of their respective upward lengths, and further comprises a first portion configured for grasping and a second portion configured to fit into a cavity integrally formed within the body of the rigid mounting surface, wherein the arm support pad is positioned to contact a portion of the user's upper limb when the first portion is grasped; and a weight-bearing element, intersected by the centerline and configured to engage a ground surface, comprising a curved or contoured surface symmetrically disposed about a pivot axis, wherein the pivot axis aligns or substantially coincides with an axis of symmetry of the curved or contoured surface, thereby allowing the frame to undergo rotational or tilting movement about the pivot axis relative to the ground surface.

2. The apparatus of claim 1, wherein the frame's outer left and right sides are formed, in whole or in part, as a unitary one-piece structure, and wherein the handle or grip portion includes an angled portion, the central axis of which extends directly upward from a point that is integrally formed within said unitary one-piece structure.

3. The apparatus of claim 1, wherein the outer left and right sides are, in whole or in part, formed from a unitary one-piece structure.

4. The apparatus of claim 1, wherein at least one handle or grip portion is releasably mounted to the frame.

5. The apparatus of claim 1, wherein the handle or grip structure maintains a substantially uniform profile along substantially its entire length, such that at least one cross section of the handle or grip structure at its proximal extremity is substantially the same in outer profile compared to a cross section at its distal extremity.

6. The apparatus of claim 1, wherein the handle or grip structure comprises at least one grip portion, the majority of whose length is formed by a unitary one-piece construction, the at least one grip portion having a closed-curve outer profile along all or part of its length and terminating in at least one free end whose cross section near said free end is substantially the same as at least a portion of the closed-curve outer profile, thereby defining a terminal extremity of said one-piece construction.

7. The apparatus of claim 1, wherein, in a configuration in which a plane of the user-contacting surface is positioned substantially parallel to the ground, the bottom plane of the arm support pad is positioned at a vertical height substantially equal to or below that of at least a portion of the support structure.

8. An exercise apparatus for enhancing a user's abdominal strengthening, facilitating the user's torso extension in a downward-facing position, the apparatus comprising:

a frame having a centerline defined as an imaginary vertical plane dividing its left and right halves and a midway axis defined as an imaginary axis equidistant between its forwardmost and rearmost extents in plan view, the frame comprising a handle that includes a left elongated side and a right elongated side, each extending rigidly and symmetrically from an apex, arch, or other span central to the left and right elongated sides, said span straddling the centerline near the forwardmost points of said elongated sides and being arranged to extend between their uppermost grippable portions, when viewed from the side;

a rigid linear support member defining a substantially straight central axis from end to end in plan view, wherein the rigid linear support member spans between the left elongated side and the right elongated side at a pair of substantially parallel sections of said elongated sides, with the rigid linear support member coupled to the elongated sides at or near its opposite ends and with its central axis oriented perpendicular relative to the centerline in plan view;

at least one arm support pad, with a user-contacting surface positioned to contact a forearm of the user when the handle is grasped, while a portion of the user's lower limbs is in contact with a ground surface, and the user's knees are positioned behind the rearmost edge of the frame; and a component positioned between a pair of imaginary vertical planes that are parallel to the centerline and intersect the opposite ends of the rigid linear support member, the component having an exterior surface that includes a convex curved portion which, in a side view or in a cross section parallel to the centerline, includes a substantially continuous arc, wherein, with either the user-contacting surface of the at least one arm support pad or a portion of the frame positioned substantially parallel to the ground surface, at least a portion of the convex curved portion is positioned lower than the frame and, in plan view, is intersected by a vertical plane that includes at least a segment of the central axis of the rigid linear support member, and wherein at least a portion of the component is positioned both posterior to the midway axis and proximate to the centerline.

9. The apparatus of claim 8, wherein the left elongated side and the right elongated side are permanently connected, and wherein the rigid support surface forms part of a unitary one-piece structure that further includes a mounting cavity or recess having an axis of insertion that is substantially perpendicular or otherwise non-oblique relative to the centerline and oriented horizontally in at least one use position.

10. The apparatus of claim 8, wherein the at least one arm support pad comprises two separate arm support pads, each disposed in direct contact with a corresponding rigid support surface underlying all or part of its padding, and wherein said rigid support surfaces are spaced apart in the region directly between the two arm support pads.

11. The apparatus of claim 8, the at least one arm support pad comprises two separate arm support pads, each disposed at least partially in direct contact with a corresponding rigid support surface underlying all or part of its padding, the respective rigid support surfaces each configured as a base comprising a one-piece construction extending to the perimeter of the associated arm support pad, resulting in two separate bases, with their respective one-piece structures spaced apart and detached from the other in the region directly between the arm support pads.

12. The apparatus of claim 8, wherein at least one point where the apparatus contacts the ground surface is located directly under, or within the footprint of, at least one of:

the rigid linear support member or the component.

13. The apparatus of claim 8, wherein in plan view, the at least one arm support pad extends at least as far rearward as a rearmost section of at least one of the elongated sides.

14. The apparatus of claim 8, wherein at least a portion of the component is configured to be in dynamic contact with the ground surface, and the rigid linear support member is configured to remain substantially perpendicular to the centerline throughout said dynamic contact.

15. The apparatus of claim 8, wherein, in a side view, the frame comprises an outermost lateral structure that, between the front edge and the rear edge of the at least one arm support pad, does not extend substantially above an upper plane of said arm support pad.

16. The apparatus of claim 8, wherein the rigid linear support member is a shaft supporting the component or connecting it to the apparatus.

17. The apparatus of claim 8, wherein the rigid linear support member is configured such that, at at least one cross section taken parallel to the centerline and including all of the unitary one-piece structure at that cross section, the outer profile is substantially closed and symmetrical.

18. The apparatus of claim 8, wherein, in at least one use configuration where either the user-contacting surface of the at least one arm support pad or a portion of the frame is oriented substantially parallel to the ground surface, the convex curved portion of the component contacts the ground surface, and the component is the sole component on the apparatus that includes such a convex curved portion.

19. An exercise apparatus for enhancing a user's abdominal strengthening, facilitating the user's torso extension in a downward-facing position, the apparatus comprising:

a frame having a centerline defined as an imaginary vertical plane dividing its left and right halves and a midway axis defined as an imaginary axis equidistant between its forwardmost and rearmost extents in plan view, the frame comprising a structural element of rigid construction with either a continuous curve or one or more symmetrically placed bends that extends across the centerline, spanning the uppermost portions of a left elongated arm and a right elongated arm and being connected to or integrally formed with each elongated arm at or near their uppermost portions when viewed from the side;

at least one arm support pad, with a user-contacting surface, wherein, when viewed from the side in at least one configuration, each elongated arm includes a bend where a section before the bend extends at a lesser angle relative to a horizontal plane than the section after the bend, which angles upward to form an upward-angled portion for gripping, at least in part higher than the user-contacting surface of the at least one arm support pad, with the user-contacting surface positioned to contact a forearm of the user when the upward-angled portions are grasped, while a portion of the user's lower limbs is in contact with a ground surface, and the user's knees are positioned behind the rearmost edge of the frame, and wherein, for each elongated arm, a cross section of the arm below the highest point of the bend has substantially the same outer perimeter as a cross section of the arm above the highest point of the bend, each cross section being taken perpendicular to the arm's central axis; and a component with an exterior surface that includes a convex curved portion which, in a side view or in a cross section parallel to the centerline, includes a substantially continuous arc, wherein, in a configuration where either the user-contacting surface of the at least one arm support pad or a portion of the frame is oriented substantially parallel to the ground surface, at least part of the convex curved portion is positioned lower than the frame, and wherein at least a portion of the component is positioned both posterior to the midway axis and proximate to the centerline.

20. The apparatus of claim 19, wherein the left elongated arm and the right elongated arm are integrally formed as a unitary one-piece structure, and wherein the at least one arm support pad comprises two separate arm support pads, each disposed at least partially in direct contact with a corresponding base underlying all or part of its padding, the respective bases each formed at least in part of a unitary one-piece construction that is spaced apart and detached from the other in the region directly between the arm support pads.

21. The apparatus of claim 19, wherein at least one point where the apparatus contacts the ground surface is, in plan view, located directly under, or within the footprint of, the component.

22. The apparatus of claim 19, wherein in plan view, the at least one arm support pad extends at least as far rearward as a rearmost section of at least one of the elongated arms.

23. The apparatus of claim 19, comprising a rigid linear support member defining a substantially straight central axis from end to end in plan view, wherein the rigid linear support member spans the centerline with its central axis fixed perpendicular relative to the centerline.

24. The apparatus of claim 23, wherein at least a portion of the component is configured to be in dynamic contact with the ground surface, and the rigid linear support member is configured to remain substantially perpendicular to the centerline throughout said dynamic contact.

25. The apparatus of claim 19, wherein there is at least one point where the apparatus contacts the ground that is located on or adjacent to the centerline and, in plan view, directly under, or within the footprint of, the component.

26. The apparatus of claim 19, wherein, in a side view, the frame comprises an outermost lateral structure that, between the front edge and the rear edge of the at least one arm support pad, does not extend substantially above an upper plane of said arm support pad.

27. The apparatus of claim 19, further comprising a rigid linear support member spanning the left elongated arm and the right elongated arm, said support member defining a substantially straight central axis from end to end in plan view and being oriented perpendicular to the centerline, with the component mounted to the rigid linear support member such that the component is positioned at least in part at the centerline and, when viewed in plan, is intersected by a vertical plane that includes at least a segment of the central axis of the rigid linear support member.

28. The apparatus of claim 19, wherein, for each elongated arm, the upward-angled portion immediately contiguous with the bend extends along a non-diverging path relative to the upward-angled portion of the opposite elongated arm, such that the lateral separation between the two portions does not increase along their lengths.

29. The apparatus of claim 19, wherein, in at least one use configuration where either the user-contacting surface of the at least one arm support pad or a portion of the frame is oriented substantially parallel to the ground surface, the convex curved portion of the component contacts the ground surface, and the component is the sole component on the apparatus that includes such a convex curved portion.

30. An exercise apparatus for enhancing a user's abdominal strengthening, facilitating the user's torso extension in a downward-facing position, the apparatus comprising:

a left support arm and a right support arm positioned on opposite sides of a vertical centerline plane, each comprising a straight segment with a central axis which has an invariable lateral spacing relative to the other during use;

a left handle provided on the left support arm;

a right handle provided on the right support arm;

a pair of arm support pads, comprising a left arm support pad and a right arm support pad, each having a respective base connected to the left and right support arms, respectively, with padding on each of the arm support pads extending from the center to the perimeter, wherein the pair of arm support pads is configured to engage the user's forearms when the left handle and the right handle are grasped; and one or more rounded elements, each with a curved surface, configured for dynamic contact, wherein each of the left handle and the left arm support pad associated with the left support arm is configured to move in a linear direction, independently from the right support arm, wherein an axis positioned through a center of at least one of the one or more rounded elements is constantly perpendicular to the vertical centerline plane during use.

31. The apparatus of claim 30, wherein the linear movements of the left and right bases occur along respective paths of predetermined finite length.

32. The apparatus of claim 30, wherein each base is formed as a single, unitary structure, extending from the portion in contact with the padding of the corresponding arm support pad downward around the lowest extent of said base's outer perimeter.

33. The apparatus of claim 30, wherein each base integrally comprises a cavity or opening allowing it to be connected to its corresponding handle, with an axis of insertion substantially perpendicular or otherwise non-oblique relative to the centerline.

34. The apparatus of claim 33, wherein the axis of insertion is further oriented substantially horizontal.

35. The apparatus of claim 30, wherein the linear movement of the respective bases of the left and right support arms occurs along one or more rigid support surfaces which together include at least a pair of elongated channels or grooves, the channels or grooves configured symmetrically on opposite sides of the vertical centerline plane, and wherein each base engages its corresponding channel or groove with a portion whose bottom surface is positioned substantially flush with or upwardly adjacent to a rigid planar exterior surface along an upper face of the support surfaces or upwardly adjacent to a rigid, planar upper face of at least one of the one or more rigid support surfaces.

36. The apparatus of claim 30, wherein each of the left and right support arms comprises an arm portion integrally formed with the support arm that, in at least one use configuration, extends upward and lies within the user's grasp when a respective handle portion is held, the arm portion thereby forming at least part of the respective handle portion.

37. An exercise apparatus for enhancing a user's abdominal strengthening, facilitating the user's torso extension in a downward-facing position, the apparatus comprising:

a frame having a centerline defined as a plane, fixed in orientation relative to the frame, dividing its left and right halves, which are integrally formed as a unitary one-piece structure or permanently joined, the frame comprising a left elongated arm and a right elongated arm running substantially parallel to or converging toward each other and the centerline along part of their lengths, wherein each elongated arm includes a permanent bend or curvature in said arm's central axis near an upward-angled portion that serves as a handle or grip, and wherein the two elongated arms are rigidly spaced from each other, either by an arch spanning their uppermost handle or grip portions or by one or more structural members or frame portions that are fixed relative to the centerline and abutting at least one of the elongated arms at points substantially the same height as said arm's central axis;

at least one arm support pad, comprising a user- contacting surface, wherein at least one handle or grip portion is fixedly angled at a non-zero angle relative to the plane of the user-contacting surface, wherein the padding of the arm support pad is in direct contact with a rigid support surface that underlies all or a portion of the padding, and wherein the user-contacting surface is further configured to contact a forearm of the user when the at least one handle or grip portion is grasped, while a portion of the user's lower limbs is in contact with a ground surface, and the user's knees are positioned behind the rearmost edge of the frame;

a rigid linear support member, linear in that, in plan view, said member has a central axis whose laterally opposed ends are fixed on a common line substantially perpendicular to the centerline, wherein the central axis is defined as an imaginary path that runs through the centers of successive cross sections taken from one laterally opposed end to the other, and wherein the central axis is fixed within a plane that is permanently oriented substantially perpendicular to the centerline, said plane being configured to be substantially vertical; and a plurality of points where the apparatus contacts a ground surface, including points on a component having an exterior surface with a convex curved portion which, in a side view or in a cross section parallel to the centerline, includes a substantially continuous arc, wherein the convex curved portion is positioned such that at least a portion of it is lower than the frame and, in plan view, is located at least in part directly under the rigid linear support member's central axis, and wherein, in a configuration where the user-contacting surface of the arm support pad or a portion of the frame is substantially parallel to the ground surface, at least one of the plurality of points of ground contact is located along the arc, and the outermost lateral edge of the arm support pad or its rigid support surface coincides with an imaginary vertical plane parallel to the centerline, such that all of the plurality of points of ground contact on the same side of the centerline as the imaginary vertical plane are located inward of said plane.

38. The apparatus of claim 37, wherein the rigid linear support member comprises a unitary one-piece structure having two opposite terminal ends that define the major dimension of said unitary one-piece structure, and wherein the rigid linear support member is coupled to the frame with said opposite ends substantially equidistant from the centerline.

39. The apparatus of claim 37, wherein the at least one arm support pad comprises two pads, one positioned on the left and one on the right, each pad disposed on a rigid support surface, and wherein the rigid support surfaces are physically separate from one another, in whole or in part, in the region directly between the two pads.

40. The apparatus of claim 37, wherein the underside of the rigid support surface includes a mounting cavity or recess engaged with a rigid support member, the mounting cavity having an axis of insertion perpendicular or otherwise non- oblique relative to the centerline.

41. The apparatus of claim 37, wherein the component has a side-to-side dimension that exceeds its front-to- back dimension.

42. The apparatus of claim 37, wherein the frame is divided into a front half and a back half divided by a midway axis, defined as an imaginary axis equidistant from the frame's forwardmost and rearmost extents in plan view, wherein at least a portion of the convex curved portion is configured to be positioned in dynamic contact with the ground surface, wherein in plan view, the common line connecting the laterally opposed ends of the rigid linear support member is configured to remain substantially perpendicular to the centerline throughout said dynamic contact, and wherein at least a portion of the component is positioned both posterior to the midway axis and proximate to the centerline.

43. The apparatus of claim 37, wherein the rigid linear support member is a shaft supporting the component or connecting it to the apparatus.

44. The apparatus of claim 37, wherein at least a portion of the convex curved portion is configured to be positioned in dynamic contact with the ground surface, and the plane defined by the rigid linear support member that contains the rigid linear support member's central axis is configured to remain substantially perpendicular to the centerline throughout said dynamic contact.

45. The apparatus of claim 37, wherein the left elongated arm and the right elongated arm have a single, fixed lateral spacing arrangement relative to each other.

46. The apparatus of claim 37, wherein the at least one arm support pad is releasably mounted to the frame.

47. The apparatus of claim 37, wherein at least one handle or grip portion is releasably mounted to the frame.

48. The apparatus of claim 37, wherein the rigid linear support member is configured such that, at at least one cross section taken parallel to the centerline and including all of the unitary one-piece structure at that cross section, the outer profile is substantially closed and symmetrical.

49. The apparatus of claim 37, wherein a portion of the component is located at the centerline, and wherein the component has a side-to-side dimension that exceeds its front-to-back dimension.

50. The apparatus of claim 37, wherein the number of components, each having a convex curved portion including a substantially continuous arc and being configured to dynamically engage the ground, is fewer than three.

51. The apparatus of claim 37, wherein the rigid support surface is incorporated in at least one rigid base on which the arm support pad is disposed, the base being positioned beneath a bottom surface of the arm support pad in direct contact with at least a portion of said bottom surface and extending around or proximate to at least half of the perimeter of the arm support pad, and wherein said base integrally comprises a cavity or opening allowing connection to at least one of the elongated arms along an axis of insertion that is substantially perpendicular or otherwise non-oblique relative to the centerline.

52. An exercise apparatus for enhancing a user's abdominal strengthening, facilitating the user's torso extension in a downward-facing position, the apparatus comprising:

a frame having a front half and a back half divided by a midway axis, the midway axis being an imaginary axis that, in at least one use configuration of the apparatus as viewed in plan, is equidistant from the apparatus's forwardmost and rearmost extents, and wherein the frame further has a centerline defined as an imaginary vertical plane dividing its left and right halves;

a pair of handles or grip portions fixedly positioned on opposite sides of the centerline;

at least one arm support pad mounted to the frame, comprising a user-contacting surface, wherein at least one handle or grip portion is fixedly angled at a non-zero angle relative to the plane of the user-contacting surface, wherein at least a portion of the padding of the arm support pad is configured to be in direct contact with a contoured or otherwise formed surface, a portion of which is fixedly positioned at the centerline rearward of the arm support pad's front edge, and wherein the user-contacting surface is further configured to contact a forearm of the user when the handle or grip portions are grasped, while a portion of the user's lower limbs is in contact with a ground surface, and the user's knees are positioned behind the rearmost edge of the frame;

one or more rigid linear support members, at least one of which defines, in plan view, a substantially straight central axis whose laterally opposed ends are located on a line perpendicular to the centerline, such that the central axis of the rigid linear support member is fixed within a plane defined by the rigid linear support member, said plane being permanently oriented substantially perpendicular to the centerline, and wherein at least one of the one or more rigid linear support members is disposed behind the midway axis in plan view; and a plurality of points where the apparatus contacts a ground surface, including points on a component having an exterior surface with a convex curved portion which, in a side view or in a cross section parallel to the centerline, includes a substantially continuous arc, wherein, in a configuration where the user-contacting surface of the arm support pad or a portion of the frame is substantially parallel to the ground surface, the convex curved portion is positioned such that at least a portion of it is lower than the frame and, in plan view, is located at least in part directly under the rigid linear support member's central axis, with at least one point of the convex curved portion in contact with the ground surface directly under the rigid linear support member, and wherein, in said configuration, the forwardmost ground contact point of the apparatus is always located behind the forwardmost handle or grip portion.

53. The apparatus of claim 52, wherein at least a portion of the convex curved portion is configured to be positioned in dynamic contact with the ground surface, and the rigid linear support member is configured to remain substantially perpendicular to the centerline throughout said dynamic contact.

54. The apparatus of claim 52, wherein the frame includes a portion that projects upward to define the upward-angled central axis of at least one handle or grip portion.

55. The apparatus of claim 52, wherein, in a side view, the frame comprises an outermost lateral structure that, between the front edge and the rear edge of the arm support pad, does not extend substantially above an upper plane of the arm support pad.

56. The apparatus of claim 52, where portions of the left and right halves are integrally formed as a unitary one-piece structure, and the contoured or otherwise formed surface is permanently located at least partially at the centerline.

57. The apparatus of claim 52, wherein, in all use positions of the at least one arm support pad, an imaginary line bisecting it into left and right halves remains substantially parallel to the centerline.

58. The apparatus of claim 52, wherein, in at least one use position as viewed in plan, a leftmost outer edge of the frame and a rightmost outer edge of the frame are substantially parallel to each other within a region bounded by a front edge plane and a rear edge plane of the at least one arm support pad.

59. The apparatus of claim 52, wherein the frame is configured to extend to an outer lateral edge of the at least one arm support pad.

60. The apparatus of claim 52, wherein the at least one arm support pad is integrally associated with a cavity or opening allowing it to be connected to its corresponding handle along an axis of insertion that is substantially perpendicular or otherwise non-oblique relative to the centerline and oriented substantially horizontally.

61. The apparatus of claim 52, wherein the component has a side-to-side dimension that exceeds its front-to-back dimension.

62. The apparatus of claim 52, wherein the rigid linear support member is a shaft supporting the component or connecting it to the apparatus.

63. The apparatus of claim 52, wherein the rigid linear support member is configured such that, at at least one cross section taken parallel to the centerline and including all of the unitary one-piece structure at that cross section, the outer profile is substantially closed and symmetrical.

64. The apparatus of claim 52, wherein the number of components, each having a convex curved portion including a substantially continuous arc and being configured to dynamically engage the ground, is fewer than three.

65. An exercise apparatus for enhancing a user's abdominal strengthening, facilitating the user's torso extension in a downward-facing position, the apparatus comprising:

a front half and a back half divided by a midway axis, the midway axis being an imaginary axis that, in at least one use configuration of the apparatus as viewed in plan, is equidistant from the apparatus's forwardmost and rearmost extents;

a support structure of rigid construction and generally symmetrical geometry having a centerline defined as an imaginary vertical plane dividing the support structure into left and right halves, wherein the support structure comprises at least one arm support pad having a user-contacting surface and a base on which said arm support pad is disposed, wherein the base is positioned beneath a bottom surface of the arm support pad in direct contact with at least a portion of said bottom surface and extends around or proximate to at least half of the perimeter of the arm support pad, and wherein, in a side view, the support structure comprises an outermost lateral structure that, between the front edge and the rear edge of the arm support pad, does not extend substantially above an upper plane of the arm support pad's padding;

at least one elongated arm, comprising a first section angled less steeply than a second section, and a permanent bend or joint therebetween, the first and second sections formed as a single, inseparable piece;

a pair of handles or grip portions, at least one of which is disposed on the elongated arm near the permanent bend or joint at a forwardmost section of the elongated arm, the pair positioned on opposite sides of the centerline, extending upward in paths that are parallel or converging relative to each other and the centerline for most of their respective upward lengths, wherein the pair are connected such that, at all times during their use, they are positioned, at least in part, in the front half, wherein the at least one arm support pad is positioned on or connected to the support structure at an attachment point in the back half behind the midway axis and comprises a user-contacting surface, wherein at least one handle or grip portion is fixedly angled at a non-zero angle relative to the plane of the user-contacting surface, and wherein the user-contacting surface is further configured to contact a forearm of the user when at least one of the handle or grip portions is grasped and the arm support pad is in its most distal position relative to said handle or grip portion, while a portion of the user's lower limbs is in contact with a ground surface, and the user's knees are positioned behind the rearmost edge of the support structure; and one or more stationary, non-rolling ground-contacting members, each ground-contacting member having at least one surface located at or below the lowest plane of the support structure when viewed from the side, each configured to be in direct, level contact with the ground surface while the support structure is arranged substantially parallel to the ground surface, wherein the one or more ground-contacting members collectively provide multiple points of contact for stability, including at least three coplanar points of contact arranged in a single plane on the ground surface during use: a first point in a first region, a second point in a second region, and a third point in a third region, the first and second regions being laterally spaced apart across the centerline, and the third region being spaced from both the first and second regions, with at least one of these coplanar points being positioned beyond a vertical plane that runs parallel to the centerline and intersects an arm support pad on the same side of the centerline, and wherein all three coplanar points are configured to be stationary relative to adjacent portions of support structure, ensuring they always reside at the lowest point of their respective ground-contacting member during use.

66. The apparatus of claim 65, wherein the at least one arm support pad comprises two arm support pads whose relative lateral spacing is adjustable.

67. The apparatus of claim 66, the relative lateral spacing is adjustable along at least one path where portions of each of the two arm support pads remain substantially in the same horizontal plane.

68. The apparatus of claim 65, wherein the pair of handle or grip portions extend from a rigid cross member spanning the centerline and positioned either directly between or above the highest points of the handle or grip portions when viewed from the side.

69. The apparatus of claim 65, wherein in plan view, the at least one arm support pad extends at least as far rearward as a rearmost section of the at least one elongated arm, and wherein the at least one elongated arm is rigidly spaced from the centerline, either by an arch spanning from its uppermost handle or grip portion to at least the centerline or by a structural member or part of the support structure that is fixed relative to the centerline and abuts the at least one elongated arm at substantially the same height as at least one point along said arm's central axis.

70. The apparatus of claim 65, wherein the support structure comprises a unitary one-piece section comprising a first portion permanently fixed at the centerline at a location that, in side view, is located between the front and rear edges of the at least one arm support pad, and a second portion integrally shaped to receive and at least partially enclose the at least one elongated arm.

71. The apparatus of claim 65, wherein the at least one arm support pad comprises at least two separate arm support pads, each with its own base, and wherein the respective bases are physically separated from one another, in whole or in part, in the region directly between the two pads.

72. The apparatus of claim 65, wherein at least a portion of the at least one arm support pad is configured to be in direct contact with a contoured or otherwise formed surface, a portion of which is fixedly positioned at the centerline rearward of said arm support pad's front edge.

73. The apparatus of claim 65, wherein at least one handle or grip portion is fixedly positioned such that, in all use configurations, it always resides closer to the forwardmost edge of the at least one arm support pad than to the midpoint between the forwardmost and rearmost edges of said arm support pad.

74. The apparatus of claim 65, wherein the pair of handle or grip portions are configured, at least in part, in a fixed, non-vertical orientation.

75. The apparatus of claim 65, wherein the support structure defines at least a portion of the perimeter of the apparatus on both the apparatus's left and right sides, and wherein, in at least one use position when viewed in plan, along at least a portion of the region bounded by the front edge plane and the rear edge plane of the at least one arm support pad, the extreme lateral edges formed of the left and right sides are substantially parallel.

76. The apparatus of claim 65, comprising a front half and a back half divided by a midway axis, defined as an imaginary axis equidistant from the apparatus's forwardmost and rearmost extents in plan view, wherein, in at least one configuration where the arm support pad is in its most distal position relative to the handle or grip portion, at least a portion of the arm support pad is located in the back half.

77. The apparatus of claim 65, wherein the support structure is formed such that a majority of its left and right outer sides, on opposite sides of the centerline, are constructed as a single, unitary structure.

78. The apparatus of claim 65, wherein, in all use positions of the arm support pad, an axis bisecting it into left and right halves remains substantially parallel to the centerline.

79. The apparatus of claim 65, wherein the first section of the at least one elongated arm is located at a lower vertical height than the second section, with the permanent bend or joint angled upward, and wherein a cross section of the first section, taken before the bend or joint, has substantially the same outer perimeter as a cross section of the at least one elongated arm at a higher region above the bend, each cross section being taken perpendicular to the arm's central axis.

80. The apparatus of claim 65, wherein the base integrally comprises a cavity or opening allowing it to be connected and fixed relative to the at least one elongated arm, with an axis of insertion substantially perpendicular or otherwise non-oblique relative to the centerline.

81. The apparatus of claim 65, wherein the elongated arm is integrated into a unitary one-piece structure that has a closed-curve profile at both its proximal and distal extremities.

82. The apparatus of claim 65, wherein the at least one elongated arm or at least one handle or grip portion is connected to an adjoining portion of the support structure via an insertion axis that is substantially parallel to the centerline.

83. The apparatus of claim 65, wherein the at least one arm support pad is releasably mounted to the support structure.

84. The apparatus of claim 65, wherein at least one handle or grip portion is releasably mounted to the support structure.

85. The apparatus of claim 65, wherein a position of the at least one arm support pad is adjustable relative to a fixed point on the support structure.

86. The apparatus of claim 65, wherein a position of at least one handle or grip portion is adjustable relative to a fixed point on the support structure.

87. The apparatus of claim 65, wherein, in a configuration in which a plane of the user-contacting surface is positioned substantially parallel to the ground, the bottom plane of the at least one arm support pad is positioned at a vertical height substantially equal to or below that of at least a portion of the support structure.

88. The apparatus of claim 65, wherein the support structure is formed such that a majority of its left and right outer sides, on opposite sides of the centerline, are constructed as a single, unitary structure, wherein, in all use positions of the arm support pad, an axis bisecting it into left and right halves remains substantially parallel to the centerline, wherein, when viewed in plan, the at least one arm support pad extends at least as far rearward as a rearmost section of the at least one elongated arm, and wherein the at least one elongated arm is rigidly spaced from the centerline, either by an arch spanning from its uppermost handle or grip portion to at least the centerline or by a structural member or part of the support structure that is fixed relative to the centerline and abuts the at least one elongated arm at substantially the same height as at least one point along said arm's central axis.

89. An exercise apparatus for enhancing a user's abdominal strengthening, facilitating the user's torso extension in a downward-facing position, the apparatus comprising:

a front half and a back half divided by a midway axis, defined as an imaginary axis equidistant from the apparatus's forwardmost and rearmost extents in plan view, in at least one use configuration of the apparatus;

a support structure of rigid construction and generally symmetrical geometry having a centerline defined as an imaginary vertical plane dividing the support structure into left and right halves;

a pair of handles or grip portions, positioned on opposite sides of the centerline, extending upward in paths that are parallel or converging relative to each other and the centerline for most of their respective upward lengths;

at least one arm support pad, comprising a user- contacting surface and a base resting on and connected to the support structure, wherein at least one handle or grip portion is fixedly angled at a non-zero angle relative to the plane of the user-contacting surface, wherein at least a portion of the padding of the arm support pad is configured to be in direct contact with the base positioned under the bottommost surface of the padding and extending around or proximate to substantially all or a majority of the perimeter of the padding, wherein each of a left handle or grip portion and a right handle or grip portion is individually positionable and fixed at a cavity or opening integrally formed in the support structure, wherein the handle or grip portions are configured such that, at all times during their use, they are positioned, at least in part, in the front half, and wherein the user-contacting surface is further configured to contact a forearm of the user when the handle or grip portions are grasped and the arm support pad is in its most distal position relative to a handle or grip portion, while a portion of the user's lower limbs is in contact with a ground surface, and the user's knees are positioned behind the rearmost edge of the support structure; and one or more stationary, non-rolling ground-contacting members, each ground-contacting member having at least one surface located at or below the lowest plane of the support structure when viewed from the side, each configured to be in direct, level contact with the ground surface while the support structure is arranged substantially parallel to the ground surface, wherein the one or more ground-contacting members collectively provide multiple points of contact for stability, including at least three coplanar points of contact arranged in a single plane on the ground surface during use: a first point in a first region, a second point in a second region, and a third point in a third region, the first and second regions being laterally spaced apart across the centerline, and the third region being spaced from both the first and second regions, with at least one of these coplanar points being positioned beyond a vertical plane that runs parallel to the centerline and intersects an arm support pad on the same side of the centerline, and wherein all three coplanar points are configured to be stationary relative to adjacent portions of support structure, ensuring they always reside at the lowest point of their respective ground-contacting member during use.

90. The apparatus of claim 89, wherein the at least one arm support pad comprises a left arm support pad and a right arm support pad, and wherein the spacing between the left arm support pad and the right arm support pad is adjustable along a linear track member that follows a path substantially perpendicular to the centerline and substantially flat from end to end, with portions of each pad remaining substantially aligned in the same horizontal plane during adjustment.

91. The apparatus of claim 89, wherein the support structure is formed such that a majority of its left and right outer sides, on opposite sides of the centerline, are constructed as a single, unitary structure, and wherein the at least one arm support pad is mounted to the support structure at an attachment point in the back half behind the midway axis.

92. The apparatus of claim 89, wherein the at least one arm support pad is releasably mounted to the support structure.

93. The apparatus of claim 89, wherein a position of at least one handle or grip relative to the at least one arm support pad is adjustable.

94. The apparatus of claim 89, wherein the base is positioned at least in part above the bottom plane of the support structure.

95. The apparatus of claim 89, wherein the support structure includes, as a part of its unitary one-piece structure, a portion that extends along the centerline at a location at least as far rearward as the midway axis.

96. The apparatus of claim 89, wherein the support structure comprises a rigid portion permanently fixed at the centerline and spanning the left and right sides of the support structure, said portion being located, in side view, between the front and rear edges of the at least one arm support pad.

97. The apparatus of claim 89, wherein, in all use positions of the at least one arm support pad, an imaginary line bisecting it into left and right halves remains substantially parallel to the centerline.

98. An exercise apparatus for enhancing a user's abdominal strengthening, facilitating the user's torso extension in a downward-facing position, the apparatus comprising:

a left half and a right half defined by an imaginary centerline;

one or more rigid support surfaces, collectively defining a left portion and a right portion on opposite sides of the centerline;

at least one channel or groove formed in the left portion and at least one channel or groove formed in the right portion, for a total of at least two distinct channels or grooves that are non- contiguous across the centerline, each channel or groove including or being proximate to at least one rigid edge or surface defining a linear, flat path of travel at a constant height relative to a ground surface, each channel or groove extending in the direction of travel;

at least one support pad mounted on a base positionable along at least one of the channels or grooves and configured for sliding or linear movement along said channel or groove, with the at least one rigid edge or surface positioned to guide said movement, wherein the support pad is configured to contact an upper limb of the user, while a portion of the user's lower limbs is in contact with a ground surface, and the user's knees are positioned behind an imaginary vertical plane containing an end of the at least one channel or groove on the left and an end of the at least one channel or groove on the right; and one or more ground-contacting surfaces, defined as a stable surface in contact with the ground surface during use, positioned below the one or more rigid support surfaces, wherein at least one point of contact with the ground surface is located beyond a vertical plane that runs parallel to the centerline and intersects a support pad on the same side of the centerline.

99. The apparatus of claim 98, wherein portions of the at least one channel or groove on the left, the at least one channel or groove on the right, and an intervening region of the one or more rigid support surfaces separating said channels or grooves are integrally formed as part of the same unitary one-piece structure.

100. The apparatus of claim 98, wherein portions of the left and right borders of at least one channel or groove, a recessed surface spanning between said borders, and at least one end of said channel or groove, are integrally formed as part of a unitary one-piece structure, and wherein at least one surface of said borders is substantially flat and planar along a length of the channel or groove.

101. The apparatus of claim 98, comprising a front half and a back half defined by an imaginary midway axis equidistant from the apparatus's forwardmost and rearmost extents in plan view, wherein the at least one support pad is positioned entirely posterior to the midway axis in at least one configuration.

102. The apparatus of claim 98, wherein the at least one support pad comprises a left support pad and a right support pad, each mounted on its own base and configured for independent movement along at least one channel or groove on the left and at least one channel or groove on the right, respectively.

103. The apparatus of claim 98, wherein a handle or a grip portion is positioned for grasping by the user's hand while the at least one support pad supports a forearm of the user.

104. The apparatus of claim 98, wherein a handle or grip portion is positioned for grasping by the user's hand while the at least one support pad supports the user's forearm, the handle or grip portion and the support pad being configured to move together in a direction that includes, at least in part, a forward direction.

105. The apparatus of claim 98, wherein the at least one support pad includes a left support pad and a right support pad, each mounted on its own base and configured for independent movement along at least one channel or groove on the left and at least one channel or groove on the right, respectively, wherein a handle or grip portion is positioned for grasping by the user's hand while the at least one support pad supports the user's forearm.

106. The apparatus of claim 98, wherein the at least one support pad includes a left support pad and a right support pad, each mounted on its own base and configured for independent movement along at least one channel or groove on the left and at least one channel or groove on the right, respectively, wherein a pair of handle or grip portions are positioned for grasping by the user's hands while the left support pad and the right support pad support the respective forearms of the user, and wherein each handle or grip portion and its corresponding support pad are configured to move together in a direction that includes, at least in part, a forward direction.

107. The apparatus of claim 98, wherein the base is formed as a unitary one-piece structure with a portion extending substantially flush with or below the uppermost plane of at least one of the one or more rigid support surfaces collectively defining the left portion and the right portion.

108. The apparatus of claim 98, wherein an elongated arm extends from the base of the at least one support pad, wherein the elongated arm includes a lesser-angled section proximal to the base and, extending from an upward bend or angled joint, a steeper-angled section comprising a handle or grip portion, and wherein, for each elongated arm, a cross section of the arm below the highest point of said bend or joint has substantially the same outer perimeter as a cross section of the arm above the highest point of said bend or joint, each cross section being taken perpendicular to the arm's central axis.

109. The apparatus of claim 98, wherein the at least one arm support pad includes a left arm support pad and a right arm support pad, each mounted on its own base with an elongated arm extending from the base, and configured for independent movement along at least one channel or groove on the left and at least one channel or groove on the right, respectively, wherein each elongated arm comprises a lesser-angled section proximal to the arm support pad's base and, extending from an upward bend or angled joint, a steeper-angled section that includes a handle or grip portion, and wherein, for each elongated arm, a cross section of the arm below the highest point of said bend or joint has substantially the same outer perimeter as a cross section of the arm above the highest point of said bend or joint, each cross section being taken perpendicular to the arm's central axis.

110. The apparatus of claim 98, wherein portions of the left and right borders of at least one channel or groove on the left, and portions of the left and right borders of at least one channel or groove on the right, and at least one end of each said channel or groove, are integrally formed as part of the same unitary one-piece structure, wherein the at least one support pad includes a left arm support pad and a right arm support pad, each mounted on its own base with an elongated arm extending from the base, and configured for independent movement along at least one channel or groove on the left and at least one channel or groove on the right, respectively, and wherein each elongated arm comprises a lesser-angled section proximal to the arm support pad's base and, extending from an upward bend or angled joint, a steeper-angled section that includes a handle or grip portion.

111. The apparatus of claim 110, wherein each handle or grip portion and its corresponding base are configured to move together in a direction that includes, at least in part, a forward direction.

112. The apparatus of claim 98, wherein a portion of the one or more rigid support surfaces is configured to be positioned as the outermost lateral structure along an outer lateral edge of the at least one arm support pad.

113. The apparatus of claim 98, wherein the base comprises a unitary, one-piece structure, extending from a position in contact with the at least one support pad downward around the lowest extent of the base's outer perimeter, said lowest extent being directly adjacent to at least one of the one or more rigid support surfaces in each use position in which the base is disposed on at least one of the left portion or the right portion.

114. The apparatus of claim 98, wherein portions of the left and right borders of at least one channel or groove are integrally formed in a unitary one-piece structure, and wherein, in plan view and for at least a portion of the base's sliding or linear movement, the base passes directly over, with its geometric center proximate to, either the channel or groove itself or the unitary one-piece structure from which the left and right borders are formed.

115. An exercise apparatus for enhancing a user's abdominal strengthening, facilitating the user's torso extension in a downward-facing position, the apparatus comprising:

a support structure of rigid construction and generally symmetrical geometry having a centerline defined as an imaginary vertical plane dividing the support structure into left and right halves, wherein the support structure integrally comprises a track member having a left section and a right section;

at least one arm support pad positioned on or connected to the support structure, comprising a user-contacting surface and having a base extending around or proximate to substantially all or a majority of the perimeter of its padding, the base positioned under the bottommost surface of the padding in direct contact with at least a portion thereof;

a pair of handles or grip portions, at least one of which is positioned on an elongated arm extending from the base, wherein the pair are positioned on opposite sides of the centerline, extending upward in paths that are parallel or converging relative to each other and the centerline for most of their respective upward lengths, fixedly angled at a non-zero angle relative to the plane of the user-contacting surface, wherein the elongated arm includes a lesser-angled section proximal to the base and, extending from an upward bend or angled joint, a steeper-angled section comprising a grip portion, wherein the at least one arm support pad is movable along at least one of the left or right section of the track member, with the base remaining substantially level throughout its movement, wherein each section of the track member defines a linear, flat path of travel and includes at least one channel or groove extending along the path of travel and terminating proximate the limit of travel in at least one direction, wherein portions of the left and right outer sides of the track member, along with at least one end of the channel or groove on the left section and at least one end of the channel or groove on the right section, are integrally formed from a unitary piece of material, and wherein the user-contacting surface is configured to contact a forearm of the user when at least one of the handle or grip portions is grasped and the arm support pad is in its most distal position relative to said handle or grip portion, while a portion of the user's lower limbs is in contact with a ground surface, and the user's knees are positioned behind the rearmost edge of the support structure; and one or more stationary, non-rolling ground-contacting members, each ground-contacting member having at least one surface located at or below the lowest plane of the support structure when viewed from the side, each configured to be in direct, level contact with the ground surface while the support structure is arranged substantially parallel to the ground surface, wherein the one or more ground-contacting members collectively provide multiple points of contact for stability, including at least three coplanar points of contact arranged in a single plane on the ground surface during use: a first point in a first region, a second point in a second region, and a third point in a third region, the first and second regions being laterally spaced apart across the centerline, and the third region being spaced from both the first and second regions, with at least one of these coplanar points being positioned beyond a vertical plane that runs parallel to the centerline and intersects an arm support pad on the same side of the centerline, and wherein all three coplanar points are configured to be stationary relative to adjacent portions of support structure, ensuring they always reside at the lowest point of their respective ground-contacting member during use.

116. The apparatus of claim 115, wherein the at least one arm support pad comprises a left arm support pad and a right arm support pad, each having its own base from which an elongated arm extends, each elongated arm comprising the handle or grip portion associated with said base, each base being independently movable along its respective left or right section of the track member while remaining substantially level throughout its movement.

117. The apparatus of claim 115, each base has a bottom surface positioned substantially flush with or upwardly adjacent to a rigid planar exterior surface along an upper face of the left section or the right section.

118. An exercise apparatus for enhancing a user's abdominal strengthening, facilitating the user's torso extension in a downward-facing position, the apparatus, comprising:

a front half and a back half divided by a midway axis, defined as an imaginary axis equidistant from the apparatus's forwardmost and rearmost extents when viewed in plan, in at least one use configuration of the apparatus;

a support structure, comprising a left portion and a right portion, the two portions being separated by an imaginary centerline generally aligned with the user's midline when viewed in plan during use, each of rigid construction and positioned on opposite sides of the centerline, the left and right portions being generally symmetrically arranged and configured to underlie respective upper limbs of the user at or distal to the elbow, wherein at least one of the left or right portions includes a section positioned proximate the midway axis;

one or more arm support pads, at least one of which includes a user-contacting surface configured to engage a portion of the user's upper limb at or distal to the elbow, and a base positioned beneath a bottom surface of said at least one arm support pad in direct contact with at least a portion of said bottom surface, the base extending around or proximate to at least half of the perimeter of the arm support pad, wherein, in at least one use position of the arm support pad, either the left portion or the right portion is intersected by an imaginary transverse vertical plane substantially equidistant from the front and rear edges of the arm support pad, wherein at least one of the left or right portions includes an elongated opening formed in a rigid exterior surface thereof, bounded by rigid opposing edges and extending in a substantially linear fashion, formed at least in part in the rear portion, wherein the exterior surface in which the elongated opening is formed has an upper edge extending in a substantially horizontal plane and includes at least one point in the rear portion that is spaced away from the midway axis, wherein, in at least an initial use position, the base is positioned substantially entirely in the back half of the apparatus and is configured to be supported at one or more points, including at least one point located on the rear portion spaced away from the midway axis, wherein the elongated opening is disposed at least in part beneath the base and configured to align the base therewith, wherein the perimeter of the base remains free from direct attachment to at least a portion of the left portion or the right portion on which it is disposed, wherein the left and right portions are further configured such that, across all use positions in which the at least one arm support pad is disposed on at least one of the left portion or the right portion, the arm support pad remains at a substantially constant vertical height relative to the ground surface, wherein, in plan view of the region between the base's left and right edges, at least one of the left or right portions extends beyond the front and rear ends of the base in at least one use position, and wherein the user-contacting surface is configured to engage a portion of the upper limb at or distal to the elbow, while a portion of the user's lower limbs is in contact with a ground surface, and the user's knees are positioned behind the rearmost edge of the at least one elongated opening; and one or more stationary, non-rolling ground-contacting members, defined as a ground-contacting member having at least one surface located at or below the lowest plane of at least one of the left portion or the right portion when viewed from the side, each configured to be in direct, level contact with the ground surface while the left portion and the right portion are arranged substantially parallel to the ground surface, wherein the one or more ground-contacting members collectively provide multiple points of contact for stability, including at least three coplanar points of contact arranged in a single plane on the ground surface during use: a first point in a first region, a second point in a second region, and a third point in a third region, the first and second regions being laterally spaced apart across the centerline, and the third region being spaced from both the first and second regions, with at least one of these coplanar points being positioned beyond a vertical plane that runs parallel to the centerline and intersects the at least one arm support pad on the same side of the centerline, and wherein all three coplanar points are configured to be stationary during use.

119. The apparatus of claim 118, wherein the arm support pad is configured to move along a substantially linear path along at least one of the left portion or right portions, maintaining a constant distance from the ground across all use positions of the pad.

120. The apparatus of claim 119, wherein, at least on one side of the centerline, all of the one or more arm support pads configured to move along the same substantially linear path, are carried by a common base.

121. The apparatus of claim 118, wherein the base has a bottom surface positioned substantially flush with or upwardly adjacent to a rigid, planar upper face of at least one of the left or right portions.

122. The apparatus of claim 118, wherein the at least one arm support pad comprises a left arm support pad and a right arm support pad, each with its own base detached from one another across the centerline.

123. The apparatus of claim 118, wherein each base has an elongated handle or grip structure associated with it, said handle or grip structure having a substantially cylindrical outer profile and extending upward for grasping while the user's upper limb is engaged with at least one of the one or more arm support pads.

124. The apparatus of claim 118, wherein the base is formed as a single, unitary structure, extending from the portion in contact with the padding downward around the base's perimeter to its lowest extent.

125. The apparatus of claim 118, wherein an elongated arm, extending from the base, comprises a proximal section extending at a lesser angle relative to the base, transitioning through an upward bend or angled joint into a steeper-angled section that includes a handle or grip portion, and wherein, when viewed in plan, the base or a portion of its unitary one-piece structure extends at least as far rearward as a rearmost section of the elongated arm.

126. The apparatus of claim 118, wherein, in at least one use position as viewed in plan, a leftmost outer edge of the left portion and a rightmost outer edge of the right portion are substantially parallel to each other within a region bounded by a front edge plane and a rear edge plane of the at least one arm support pad.

127. The apparatus of claim 118, wherein a position of the base is adjustable relative to a fixed point on least one of the left or right portions.

128. The apparatus of claim 118, wherein a position of at least one handle or grip portion is adjustable relative to a fixed point on least one of the left or right portions.

129. The apparatus of claim 118, wherein, in a side view, the at least one arm support pad is positioned at least partially in the back half in at least one use position, and at least one of the left or right portions comprises an outermost lateral structure that, between the front edge and the rear edge of the at least one arm support pad, does not extend above an upper plane of the arm support pad.

130. The apparatus of claim 118, wherein the elongated opening includes a first elongated opening on the left portion and a second elongated opening on the right portion, with the majority of the respective lengths of each of said elongated openings occupying one side or the other of the centerline.

131. The apparatus of claim 130, wherein the at least one arm support pad comprises a left arm support pad and a right arm support pad, each with its own base configured to be detached from one another across the centerline and be positioned along the first elongated opening and the second elongated opening, respectively, and wherein each base is configured to move along a substantially linear path along at least one of the left portion or right portions.

132. The apparatus of claim 131, wherein, in a configuration in which the user-contacting surface is substantially parallel to the ground, each base is configured to maintain a constant distance from the ground across all use positions of the pad.

133. The apparatus of claim 118, wherein the base comprises a rigid, unitary one-piece structure, the substantial entirety of said structure being located in the back half in at least one use position.

134. The apparatus of claim 118, wherein the at least one arm support pad comprises a left arm support pad and a right arm support pad, each with its own base configured to be detached from one another across the centerline, wherein, in a side view, the at least one arm support pad is positioned at least partially in the back half in at least one use position, and at least one of the left or right portions comprises an outermost lateral structure that, between the front edge and rear edge of the at least one arm support pad, does not extend above an upper plane of the arm support pad, and wherein the base upon which the at least one arm support pad is disposed comprises a unitary one- piece structure, the substantial entirety of which is located in the back half in at least one use position.

135. The exercise apparatus of claim 134, wherein each base is configured to move along a substantially linear path along at least one of the left portion or right portions, maintaining a constant distance from the ground across all use positions of the pad.

136. The exercise apparatus of claim 135, wherein there is a handle or grip structure extending from each base, the handle or grip structure comprising an elongated grippable section.

137. The exercise apparatus of claim 134, wherein, in a configuration of the apparatus in which the elongated opening is arranged non-obliquely relative to the centerline, an imaginary line that is, at every point along its length, laterally equidistant from the leftmost and rightmost edges of the at least one arm support pad remains substantially parallel to the centerline throughout all use positions in which the at least one arm support pad is disposed on at least one of the left portion or the right portion, and wherein, in at least one use configuration, at least one of the left or right portions extends rearward of the base disposed on it, with the perimeter of the base remaining free from direct attachment to the upper rear edge of said left or right portion.

138. The exercise apparatus of claim 118, wherein, in at least one use configuration of the apparatus, at least one of the left or right portions includes a section irremovably fixed proximate the midway axis.

139. The exercise apparatus of claim 118, wherein, in a configuration of the apparatus in which the elongated opening is arranged non-obliquely relative to the centerline, an imaginary line that is, at every point along its length, laterally equidistant between the leftmost and rightmost edges of the at least one arm support pad remains substantially parallel to the centerline throughout all use positions of the at least one arm support pad.

140. The exercise apparatus of claim 118, wherein, in at least one use configuration, at least one of the left or right portions extends rearward of the base disposed on it, with the perimeter of the base remaining free from direct attachment to the upper rear edge of said left or right portion.

141. The exercise apparatus of claim 118, wherein a position of the at least one arm support pad is movable relative to a fixed point on the elongated opening.

142. The exercise apparatus of claim 118, wherein the elongated opening extends beyond the perimeter boundary of the at least one arm support pad along at least one linear dimension of the perimeter in plan view.

143. The exercise apparatus of claim 118, wherein, along the entire length of the elongated opening, said length corresponding to its longest extent, the spacing between said opening's longitudinal edges is narrower than the width of the at least one arm support pad that overlies it.

144. The exercise apparatus of claim 143, wherein the elongated opening comprises a first elongated opening on the left portion and a second elongated opening on the right portion, with the majority of the respective lengths of each of said elongated openings occupying one side or the other of the centerline.

145. An exercise apparatus for enhancing a user's abdominal strengthening, facilitating the user's torso extension in a downward-facing position, the apparatus comprising:

a front half and a back half divided by a midway axis, defined as an imaginary axis equidistant from the apparatus's forwardmost and rearmost extents when viewed in plan, in at least one use configuration;

a left half and a right half defined by an imaginary centerline when viewed in plan, in at least one use configuration;

one or more arm support pads, each being disposed on at least one base, said at least one base extending to the perimeter of the corresponding arm support pad and directly underlying its padding;

one or more rigid support surfaces, collectively comprising a left portion and a right portion positioned symmetrically on opposite sides of the centerline;

a first elongated opening and a second elongated opening, the first elongated opening being formed in the left portion and the second elongated opening being formed in the right portion; wherein each elongated opening extends in a substantially linear fashion in a direction of travel and has a pair of opposite longitudinal edges that run along its longest dimension; wherein at least one of the elongated openings has its opposite longitudinal edges formed, in whole or in part, by a single unitary one-piece structure; wherein at least one of the one or more arm support pads is movable along an elongated opening of the left or right portion underlying that pad's base while remaining at a substantially constant vertical height relative to a flat ground surface throughout its movement along the elongated opening; wherein, in plan view and for at least a portion of that movement, the base passes directly over, with its geometric center proximate to, the elongated opening or the unitary one- piece structure from which the opposite longitudinal edges are formed; and wherein at least one of the one or more arm support pads is configured to engage a forearm of the user at or distal to the elbow, while a portion of the user's lower limbs is in contact with a ground surface and the user's knees are positioned behind an imaginary vertical plane containing a rear edge of the left and right portions in at least one use configuration; and one or more ground-contacting surfaces, defined as a stable surface in contact with the ground surface during use, positioned below the one or more rigid support surfaces, wherein at least one point of contact with the ground surface is located beyond a vertical plane that runs parallel to the centerline and intersects a support pad on the same side of the centerline.

146. The exercise apparatus of claim 145, wherein at least one of the elongated openings is configured to movably receive a corresponding base and align the movement of said base along its path of travel.

147. The exercise apparatus of claim 146, further comprising at least one rigid support structure integrally underlying at least a portion of the rigid support surface on which the base is carried, and wherein, in at least one use configuration of the apparatus, a portion of the at least one rigid support structure, viewed in plan between the base's left and right edges, extends beyond both the front and rear ends of the base.

148. The exercise apparatus of claim 145, wherein, in at least one use configuration, the forwardmost and rearmost points of support for at least one base that are located directly beneath said base on the one or more support surfaces are located on a single unitary one-piece construction.

149. The exercise apparatus of claim 145, wherein an elongated handle or grip is connected to a base of at least one arm support pad, and wherein, at each point along said base's path of travel along at least one elongated opening, said at least one arm support pad is configured to engage a portion of the user's forearm at or distal to the elbow while the handle or grip is grasped.

150. The exercise apparatus of claim 149, wherein, in at least one use configuration, the central axis of the elongated handle or grip connected to a base remains at a constant lateral spacing from the centerline throughout the movement of the base along at least one elongated opening.

151. The exercise apparatus of claim 145, wherein, in at least an initial use position, the base is positioned substantially entirely in the back half of the apparatus.

152. The apparatus of claim 145, wherein the at least one arm support pad comprises two arm support pads, each pad being disposed on a respective base configured to move along a corresponding one of the first and second elongated openings, the two bases being independently movable relative to one another and travelling along a substantially linear path of travel.

153. The exercise apparatus of claim 152, wherein, in at least one configuration, one base is on the left portion and the other base is on the right portion, and each base's path of travel is confined to its respective side of the centerline and terminates on that side in at least one use configuration of the apparatus.

154. The exercise apparatus of claim 152, wherein each of the first and second elongated openings is configured such that its linear extent lies wholly to the either one side or the other of the centerline in at least one use configuration.

155. The apparatus of claim 145, wherein the base is formed as a single, unitary structure, extending from the portion in contact with the padding of the arm support pad downward around the lowest extent of the base's outer perimeter.

156. An exercise apparatus for enhancing a user's abdominal strengthening, facilitating the user's torso extension in a downward-facing position, the apparatus comprising:

a left handle or grip portion and a right handle or grip portion positioned on opposite sides of a vertical centerline plane, each being laterally spaced from the vertical centerline plane;

a pair of arm support pads, comprising a left arm support pad and a right arm support pad, each having a respective base connected to the left and right handles or grip portions, respectively, with each base spanning the underside of the corresponding arm support pad, wherein the pair of arm support pads is configured to engage a portion of the user's upper limbs at or distal to the elbow when the left and right handles or grip portions are grasped, wherein the left arm support pad and the left handle or grip portion are configured to move independently from the right arm support pad and the right handle or grip portion, each base being configured to move along a substantially linear path of predetermined finite length that lies substantially coplanar with the linear path of the other base, and wherein the left handle or grip portion and the right handle or grip portion are each configured to maintain a constant lateral spacing relative to the vertical centerline plane throughout said linear movement, in at least one use configuration.

157. The apparatus of claim 156, wherein each base integrally comprises a cavity or opening allowing it to be connected to its corresponding handle or grip portion.

158. The apparatus of claim 156, comprising one or more rigid support surfaces that are, at least in part, planar in shape, the apparatus further having a front half and a back half divided by a midway axis, the midway axis being an imaginary axis that, in at least one use configuration of the apparatus as viewed in plan, is equidistant from the apparatus's forwardmost and rearmost extents, wherein each base, in at least one use position thereof, is positioned at least in part in the back half, and wherein the linear movement of the respective bases occurs along portions of the one or more rigid support surfaces, allowing each base to remain at a substantially constant vertical height relative to the ground surface during its linear movement.

159. The apparatus of claim 158, wherein at least one of the rigid support surfaces includes an elongated opening extending in the direction of travel, the opening being configured to guide the path of travel of at least one of the bases.

160. The apparatus of claim 156, wherein the paths of travel of the respective bases are configured to extend non-obliquely relative to one another along substantially their entire lengths.

161. The apparatus of claim 156, wherein the central axes of the respective handle or grip portions are arranged substantially parallel to each other.

162. The apparatus of claim 156, comprising one or more rigid support surfaces that are, at least in part, planar in shape, upon which at least one of the bases is disposed, the apparatus further comprising one or more ground-contacting surfaces, defined as a stable surface in contact with the ground surface during use, positioned below the one or more rigid support surfaces, wherein at least one point of contact with the ground surface is located beyond a vertical plane that runs parallel to the centerline and intersects a support pad on the same side of the centerline.

* * * * *